US008033324B2

(12) United States Patent
Mukasa et al.

(10) Patent No.: US 8,033,324 B2
(45) Date of Patent: Oct. 11, 2011

(54) JET FLOW GENERATING APPARATUS, ELECTRONIC APPARATUS, AND JET FLOW GENERATING METHOD

(75) Inventors: Tomoharu Mukasa, Saitama (JP); Kazuhito Hori, Kanagawa (JP); Hiroichi Ishikawa, Kanagawa (JP); Kanji Yokomizo, Kanagawa (JP); Norikazu Nakayama, Kanagawa (JP)

(73) Assignee: Sony Corporation, Tokyo (JP)

( * ) Notice: Subject to any disclaimer, the term of this patent is extended or adjusted under 35 U.S.C. 154(b) by 804 days.

(21) Appl. No.: 10/982,283

(22) Filed: Nov. 3, 2004

(65) Prior Publication Data

US 2005/0121171 A1 Jun. 9, 2005

(30) Foreign Application Priority Data

Nov. 4, 2003 (JP) ..... P2003-374922
Feb. 12, 2004 (JP) ..... P2004-035815
Aug. 9, 2004 (JP) ..... P2004-232581

(51) Int. Cl.
*F28F 7/00* (2006.01)
*H05K 5/00* (2006.01)

(52) U.S. Cl. ..... 165/80.3; 165/121; 181/145

(58) Field of Classification Search ..... 165/80.3, 165/104.31, 104.33, 104.34, 121, 80.4; 181/148, 181/153, 166, 199, 206, 239; 381/71.1, 71.5, 381/71.8

See application file for complete search history.

(56) References Cited

U.S. PATENT DOCUMENTS 3,029,743 A * 4/1962 Johns ..... 417/322
4,109,108 A * 8/1978 Coxon et al. ..... 381/71.5
4,648,807 A * 3/1987 Tippetts et al. ..... 417/413.2
4,665,549 A * 5/1987 Eriksson et al. ..... 381/71.5
4,753,318 A * 6/1988 Mizuno et al. ..... 181/204
4,923,031 A * 5/1990 Carlson ..... 181/144
5,058,702 A * 10/1991 Alessandro ..... 181/206
5,077,601 A * 12/1991 Hatada et al. ..... 257/722
5,270,484 A 12/1993 Tsuchiya et al.
5,692,054 A * 11/1997 Parrella et al. ..... 381/71.3
5,758,823 A * 6/1998 Glezer et al. ..... 239/4
5,798,465 A * 8/1998 Ziada et al. ..... 73/861.21

(Continued)

FOREIGN PATENT DOCUMENTS

JP SHO 55-014920 2/1980

(Continued)

OTHER PUBLICATIONS

Japanese Office Action issued on Aug. 3, 2010 corresponding to Japanese Patent Appln. No. 2004-232581, Nov. 22, 2010.

*Primary Examiner* — Tho V Duong
(74) *Attorney, Agent, or Firm* — K&L Gates LLP

(57) ABSTRACT

A jet flow generating apparatus that suppresses noise as much as possible and effectively radiates the heat generated by a heat generating member, an electronic device that is equipped with the jet flow generating apparatus, and a jet flow generating method are provided. According to the present invention, a jet flow generating apparatus comprises a plurality of chambers each having an opening and each containing a coolant, a vibrating mechanism for vibrating the coolant contained in each of the plurality of chambers so as to discharge the coolant as a pulsating flow through the openings, and a control unit for controlling the vibration of the vibrating mechanism so that the sound waves generated by the coolant discharged from the plurality of chambers weaken each other.

18 Claims, 29 Drawing Sheets

U.S. PATENT DOCUMENTS

| | | | | |
|---|---|---|---|---|
| 6,123,145 | A | 9/2000 | Glezer et al. | |
| 6,588,497 | B1 | 7/2003 | Glezer et al. | |
| 6,937,472 | B2 * | 8/2005 | Pokhama | 361/700 |

FOREIGN PATENT DOCUMENTS

| | | | |
|---|---|---|---|
| JP | SHO 55-101800 | | 8/1980 |
| JP | SHO 58-140491 | | 8/1983 |
| JP | SHO 62-159798 | | 7/1987 |
| JP | SHO 62-159799 | | 7/1987 |
| JP | 02-213200 | | 8/1990 |
| JP | HEI 02-213200 | | 8/1990 |
| JP | HEI 03-012493 | | 1/1991 |
| JP | 03-116961 | | 5/1991 |
| JP | 05-173988 | | 7/1993 |
| JP | 06-309262 | | 11/1994 |
| JP | HEI 08-314572 | | 11/1996 |
| WO | WO 03/036098 | A1 | 5/2003 |
| WO | WO 2005/008348 | A2 | 1/2005 |

* cited by examiner

| | RATIO [%] OF HARMONICS AGAINST BASIC WAVE WHEN DRIVEN WITH RATED INPUT | RATIO [%] OF HARMONICS AGAINST BASIC WAVE WHEN DRIVEN WITH 40% OF RATED INPUT |
|---|---|---|
| FIRST ORDER COMPONENT | 100 | 100 |
| SECOND ORDER COMPONENT | 9.48 | 6.11 |
| THIRD ORDER COMPONENT | 3.50 | 1.67 |

| FREQUENCY [Hz] | RATIO [%] OF HARMONICS AGAINST BASIC WAVE IN DRIVE SIGNAL BEFORE ADJUSTED | RATIO [%] OF HARMONICS AGAINST BASIC WAVE IN DRIVE SIGNAL AFTER ADJUSTED |
|---|---|---|
| 100 | 100 | 100 |
| 200 | 1.64 | 0.258 |
| 300 | 0.700 | 0.0306 |

JET FLOW GENERATING APPARATUS, ELECTRONIC APPARATUS, AND JET FLOW GENERATING METHOD

CROSS REFERENCES TO RELATED APPLICATIONS

This application claims priority to Japanese Patent Document Nos. JP2003-374922 filed on Nov. 4, 2003, JP2004-035815 filed on Feb. 12, 2004, and JP2004-232581 filed on Aug. 9, 2004, the entire disclosures of which are incorporated herein by reference.

BACKGROUND OF THE INVENTION

The present invention relates to a jet flow generating apparatus that generates a jet flow and cools a heat generating member such as an electronic part with the generated jet flow, an electronic device that is equipped with the jet flow generating apparatus, and a jet flow generating method.

As the performance of PCs (Personal Computers) has been advanced, the calorific powers of heat generating members such as ICs (Integrated Circuits) have been adversely increased. To solve such a problem, various heat radiating technologies have been proposed and/or practically used. As one of heat radiating methods, there is a method wherein heat radiating fins made of metal such as aluminum are attached to an IC, and the generated heat by the IC is transferred to the fins to radiate the heat. Alternatively, there is another method wherein hot air that stays in a casing of a PC may be forcedly exhausted with a fan, and cool air around the PC is forcedly introduced around the heat generating members with the fan. Alternatively, there is still another method wherein, with both heat radiation fins and a fan, while the contact area of the heat generation member with air is increased with the heat radiation fins, the fan forcedly exhausts the hot air around the heat radiation fins.

However, there is a problem that a thermal boundary layer of fin surface is generated on the downstream side of the heat radiation fins by the forced conversion of air by the fan, it is difficult to effectively take away the heat. To solve such a problem, for example, it is considered that the air speed of the fan may be increased so as to thin the thermal boundary layer. But, there is a problem that nose of a bearing portion of the fan and wind cut noise of the fan are generated by increasing the number of rotations of the fan in order to increase the air speed.

As a method for breaking the thermal boundary layer and effectively releasing the heat of the heat radiation fins, a combined jet flow can be used. In this method, air that is moved by a piston or the like is jetted from a hole formed on one end of a chamber. The air jetted from this hole is called a combined jet flow. The combined jet flow promotes the mixing of air, breaks the thermal boundary layer, and more effectively radiates the heat than the forced convection generated by a conventional fan. See U.S. Pat. No. 6,123,145.

However, according to the technology described therein, since air vibration generated by a reciprocating motion of the piston is propagated as a sound wave, the sound is heard as noise. Further, as the clock frequencies of ICs have been increased in recent years, the heats generated by the ICs have been proportionally increased. Thus, to break the thermal boundary layer formed in the vicinity of the heat radiation fins, much more air should be discharged to the IC and the heat radiation fins than before. Thus, in the apparatus shown in FIG. 1A and so forth of U.S. Pat. No. 6,123,145 that vibrates the vibration film and jets air, it is necessary to increase the amplitude of the vibration so as to increase the jet flow amount of the air. Thus, if the frequency of the vibration film is in an audio frequency range, the noise of the vibration film will become a problem to solve.

SUMMARY OF THE INVENTION

The present invention relates to a jet flow generating apparatus that generates a jet flow and cools a heat generating member such as an electronic part with the generated jet flow, an electronic device that is equipped with the jet flow generating apparatus, and a jet flow generating method.

An embodiment of the present invention is to provide a jet flow generating apparatus that suppresses noise as much as possible and effectively radiates the heat generated by a heat generating member, an electronic device that is equipped with the jet flow generating apparatus, and a jet flow generating method.

An embodiment of the present invention is a jet flow generating apparatus that comprises a plurality of chambers each having an opening and each containing a coolant, a vibrating mechanism for vibrating the coolant contained in each of the plurality of chambers so as to discharge the coolant as a pulsating flow through the openings, and a control unit for controlling the vibration of the vibrating mechanism so that the sound waves generated by the coolant discharged from the plurality of chambers weaken each other.

According to the present invention, "weaken each other" means that the sound waves generated by a plurality of discharging means weaken each other in a part or entire a region to which the sound waves are propagated. This definition will be applied to the following description.

According to the present invention in an embodiment, the control unit is configured to cause the sound waves generated in the plurality of chambers to weaken each other. Thus, even if the heat generated by the heat generating member increases as the clock frequency of an IC chip or the like increases, the generated heat can be effectively radiated and noise can be prevented from generating.

Since the control unit is configured to cause the sound waves generated in the chambers to weaken each other, the control unit needs to control at least one of the phases, frequencies, and amplitudes of the sound waves.

According to an embodiment of the present invention, when the distance of adjacent openings of at least one set of chambers is denoted by d (m) and the wave length of the sound wave generated in the chamber is denoted by $\lambda$ (m), the condition of $d<\lambda/2$ is satisfied. In this case, assuming that the wave length $\lambda$ of the sound wave of each of the plurality of chambers is almost the same, since the maximum amplitudes of the sound waves generated by the openings of each chamber do not strengthen each other, noise can be prevented from generating as much as possible.

According to an embodiment of the present invention, each of the chambers can have various structures as long as the condition of $d<\lambda/2$ is satisfied.

When there are two chambers, if the vibrating mechanism is caused to vibrate so that the phases of the sound waves generated in respective chambers are shifted by $360°/2=180°$ to each other, the sound waves weaken each other, since the wave forms of the sound waves generated in the chambers are inverted from each other.

When there are four discharging means A, B, C, and D, if the wave lengths and amplitudes of the sound waves generated in individual chambers are the same, the phases of the wave forms of the sound waves generated by the discharging means A and B are the same, and the phases of the wave forms of the sound waves generated by the discharging means C and D are shifted by 180° from the phases of those by the discharging means A and B, the sound waves weaken each other.

When the number of chambers is n (where n=2, 3, 4, . . . ) and the wave lengths and amplitudes of the sound waves generated in the chambers are the same, the control unit can control the chambers so that they generate the sound waves that have phase differences of 360°/n. As a result, the whole system having n chambers weakens a combined wave form of the sound waves.

When the number of chambers is n (n=2, 3, 4, . . . ), the wave length of each of the sound waves generated in the chambers is λ, the amplitudes of the sound waves are almost the same, and the distance of adjacent openings is d (m), the condition of $d<\lambda/\{2(n-1)\}$ can be also satisfied. In this case, the distance between the most distant openings is given by $\lambda/\{2(n-1\}\}$. Since the wave length is sufficiently larger than this distance, the combined wave forms of the sound waves generated by the discharging means weaken each other regardless of the positions and directivity of the discharging means. In other words, since the maximum amplitude of the sound waves generated by openings of the chambers do not strengthen, noise can be prevented from generating as much as possible.

When there are three chambers A, B, and C, if the wave length of each of the sound waves generated in these chambers is denoted by λ, the amplitudes of the sound waves generated in the chambers A and B are the same and denoted by "a". The amplitude of the sound wave generated in the chamber C is 2×a and the phase of the sound wave is inverse of the phase of each of the sound waves) generated in the chambers A and B), the same effect as the above structure can be obtained. In this case, the combined wave form of the sound waves generated in the chambers A, B, and C becomes flat because the crest portions and trough portions of the wave forms weaken each other. As a result, a muting effect can be obtained.

In the foregoing case, when the condition of $d<\lambda/\{6(n-1)\}$ is satisfied, the sound can more weaken than the case that one chamber has one vibrating mechanism that has one vibration plate.

Besides the case that the shapes, sizes, and so forth of chambers are the same, as long as only the foregoing condition of d and λ are satisfied, the shapes and sizes of chambers are not restricted. In addition, the arrangement of two chambers is not restricted. Thus, when an electronic device having a heat generating member is equipped with the jet flow generating apparatus according to the present invention, the arrangement of the heat generating member and the jet flow generating apparatus can be suitably changed. Thus, an electronic device can be easily designed.

According to an embodiment of the present invention, the control unit is configured to control the vibrations of the vibrating mechanism in the range from 80 to 150 (Hz). Thus, in the hearing characteristic of human, the noise level can be decreased to 1/20 or less than a sound wave at, for example, 1 (kHz). As a result, the heat generating member can be cooled without a tradeoff for quietness.

According to an embodiment of the present invention, the jet flow generating apparatus further includes a sound absorbing member or a lid member disposed at one of the plurality of chambers. As a result, the noise of the apparatus can be further decreased.

According to an embodiment of the present invention, the vibrating mechanism has a vibration plate disposed in each of the plurality of chambers. According to the present invention in an embodiment, as the number of the vibration plates is increased or the amplitude of the vibration plate is increased, the discharge amount of the combined jet flow by the vibrations of the plurality of vibration plates can be increased. Thus, even if the calorific power of the heat generating member such as an IC chip increases as the clock frequency thereof increases, the generated heat can be effectively radiated. On the other hand, even if the number of vibration plates is increased or the amplitudes thereof are increased, since the control unit controls the vibrations of coolants so that the sound waves vibrated by the plurality of vibration plates weaken each other. Thus, while the heat is effectively radiated, the noise of the apparatus can be prevented from generating.

According to an embodiment of the present invention, the vibrating mechanism has a vibration plate that partitions at least one set of the chambers. Openings may be formed in accordance with the numbers by which each of the chambers is partitioned by a plurality of vibration plates. Alternatively, the number of vibration plates may be larger than the numbers partitioned by the plurality of vibration plates. In addition, of course, the number of vibration plates may be one or more. When the number of vibration plates is one, the control unit is configured to control the vibration plate so that it sinusoidally vibrates. Thus, the control unit causes the sound waves generated from the plurality of openings to weaken each other.

According to an embodiment of the present invention, the control unit is configured to control the phase difference of respective sound waves generated in the plurality of chambers to be 360°/n, where n represents the number of chambers. As a result, harmonics other than the n-th harmonics weaken each other. In this case, harmonics contain frequency components that are multiples of other than n-th harmonics weaken each other. In this case, "the phase difference of respective sound waves" means a phase difference of each of respective sound waves focused on only basic frequencies of individual sound waves.

According to an embodiment of the present invention, the control unit is configured to control the amplitudes of the sound waves generated in the plurality of chambers so that the amplitude becomes almost the same. In addition, n is set so that the noise level of a combined wave of n-th harmonics is lower than the noise level of the sound wave generated in one of the plurality of chambers. When the phases of the sound waves are set to be 360°/n, pn-th harmonics (where p is any integer of 2 or greater) also strengthen each other. However, since the amplitude of a harmonic higher than the n-th harmonics is small, the amplitude of the combined wave of the pn-th harmonics is smaller than the amplitude of a sound wave generated in one chamber.

According to an embodiment of the present invention, the vibrating mechanism has vibration plates almost symmetrical to a plane perpendicular to a first direction which is the direction of the vibration. Since the vibrating mechanism has such a symmetrical structure, the amplitudes and so forth of the sound waves and their harmonics become the same amplitude as much as possible. Thus, the quietness can be further improved.

According to an embodiment of the present invention, the control unit is configured to vibrate the vibrating mechanism with a lower input than a rated input of the vibrating mechanism. As a result, since the harmonic components are decreased, the noise of the apparatus can be suppressed. In this case, the "input" means, for example, a supply power or voltage.

According to an embodiment of the present invention, the vibrating mechanism has a first vibration plate asymmetrical to a plane perpendicular to the direction of vibration, and a second vibration plate having almost the same shape as the first vibration plate, vibrating almost in the same direction as the direction of the vibration of the first vibration plate, and being disposed in the opposite direction of the first vibration plate. In the structure, although the vibration plates are asymmetrical, when they are disposed in their opposite directions, the symmetry of the vibrating mechanism can be assured as a whole. Thus, the wave forms of the sound waves generated in the plurality of chambers become the same as much as possible. As a result, the quietness of the apparatus can be improved. As examples of asymmetrical vibration plates, speakers each having a coil portion and a magnetic portion can be used.

According to an embodiment of the present invention, the control unit has a first signal generating unit for generating a drive signal that causes the vibrating mechanism to vibrate at the first frequency, and a second signal generating unit for generating a drive signal that causes the driving mechanism to vibrate at the first frequency, but not vibrate at a second frequency that is different from the first frequency. The second frequency is a harmonic component of the first frequency as a basic frequency. Thus, when the vibrations at the first frequency weaken each other, even if a vibration plate having a conventional distortion component is used, the noise of the apparatus can be effectively decreased.

According to an embodiment of the present invention, the jet flow generating apparatus further comprises a sound wave detecting unit for detecting the sound waves generated in the plurality of chambers. The control unit is configured to control the sound waves in accordance with a sound wave detection signal. This feedback control securely quiets the jet flow generating apparatus. In addition, even if the vibration characteristic varies due to the aged tolerance of the vibrating mechanism, the noise of the apparatus can be decreased.

According to an embodiment of the present invention, the plurality of chambers is composed of a first chamber group and a second chamber group each of which is composed of at least two chambers. The vibrating mechanism has a first vibration plate for vibrating the coolant contained in the first chamber group, and a second vibration plate for vibrating the coolant contained in the second chamber group. The control unit is configured to control the vibrations of the first and second vibration plates so that the sound waves generated in the first chamber group weaken each other and that a first combined sound wave generated in the first chamber group and a second combined sound wave generated in the second chamber group weaken each other. According to the present invention, the first combined sound wave weakened in the first chamber group and the second combined wave weakened in the second chamber group are further combined and further weakened by each other. Thus, the noise of the apparatus can be further decreased.

According to an embodiment of the present invention, the jet flow generating apparatus further comprises a sound wave generating unit for generating another sound wave that further weakens the weakened combined sound wave. Thus, the noise of the apparatus can be further decreased. The sound wave generating unit needs to generate only a sound wave having a reverse phase and the same amplitude of the weakened combined sound wave.

According to an embodiment of the present invention, the vibrating mechanism has a vibration plate. The jet flow generating apparatus further comprises a casing having a through-hole and forming a chamber group partitioned by the vibration plate. The vibrating mechanism has an actuator, disposed outside the casing, for driving the vibration plate, and a rod passing through the through-hole and moved in synchronization with the motion of the actuator. The chamber group has n chambers partitioned by (n−1) vibration plates, where n is any integer of 2 or greater. The actuator is, for example, electro-magnetically driven. This definition is applied to the following description. When the actuator is disposed inside the casing, there is a possibility in which the heat of the actuator remains in the chamber. When the heat remains in the casing, the capacity of the heat radiation will decrease. However, according to the present invention, such a disadvantage can be solved.

According to an embodiment of the present invention, the jet flow generating apparatus further comprises a casing having a through-hole and forming a chamber group partitioned by the vibration plate. The vibrating mechanism has an actuator, disposed outside the casing, for driving the vibration plate, and a rod passing through the through-hole and moved in synchronization with the motion of the actuator. According to the present invention, the actuator is disposed outside the casing. The chambers can be structured so that their volumes, shapes, or the like are the same as much as possible. Thus, the effect of the decrease of the noise can be improved. Like the foregoing embodiment, since the actuator is not disposed in the casing, the problem in which the heat remains in the chamber can be solved.

According to an embodiment of the present invention, the jet flow generating apparatus further comprises an absorbing member, disposed in the casing, for absorbing the vibrations of the rod, the direction of the rod is referred to as the second direction that is different from the first direction. The absorbing member can suppress the shaking of the rod. As a result, the absorbing member allows the vibration plate to stably vibrate. In addition, since the absorbing member is disposed so that it covers the through-hole, the coolant in the casing can be prevented from leaking from the through-hole when the vibration plate vibrates.

According to an embodiment of the present invention, the jet flow generating apparatus further comprises a first bearing, the first bearing being used for the rod, the first bearing being disposed in the through-hole or in the vicinity thereof. The first bearing is not limited to a solid substance, but a fluid substance. In the other embodiments of the present invention, unless "solid" or "fluid" is specifically described, that definition is applied. In particular, when a fluid bearing is used, the air tightness of the casing and quietness of the apparatus are improved. As an example of the liquid substance, oil is used.

According to an embodiment of the present invention, the rod passes through the vibration plate. The jet flow generating apparatus further includes a second bearing, the second bearing being used for the rod. Thus, the second bearing is disposed at a position opposite to the first bearing. Thus, the rod can be more stably moved than the foregoing rod. In addition, since the rod extends from one end to the other end of the casing, the chambers can be structured so that the volumes, shapes, or the like are the same. Thus, the noise of the apparatus can be further decreased. The rod may or may not pass through the first casing at a position opposite to the first bearing.

According to an embodiment of the present invention, the jet flow generating apparatus further comprises a seal member that blocks the casing passing through the through-hole from the outside. Thus, since the air tightness of the chamber is improved, the apparatus can effectively generate a jet flow. The seal member may be solid or fluid. This definition will be applied to the following description.

According to an embodiment of the present invention, the jet flow generating apparatus further includes a seal member for sealing the casing against the space formed between the rod and the first bearing. Thus, since the air tightness of the chamber is improved, the apparatus can effectively generate the jet flow. The seal member may be disposed on the second bearing.

According to an embodiment of the present invention, the jet flow generating apparatus further includes a first casing forming a first chamber group partitioned by a first vibration plate of the vibration plates, and a second casing forming a second chamber group partitioned by a second vibration plate of the vibration plates. The vibrating mechanism has an actuator, disposed between the first casing and the second casing, for driving the first and second vibration plates, and a rod, passing through the first and second through-holes and connecting the first and second vibration plates, and moved in synchronization with the motion of the actuator. According to the present invention, one actuator can vibrate at least two vibration plates. Thus, the discharge amount of the coolant can be increased with a low electric power. As a result, the cooling efficiency can be improved.

According to an embodiment of the present invention, the jet flow generating apparatus further includes a first bearing, the first bearing being used for the rod, the first bearing being disposed in the first through-hole or in the vicinity thereof. Thus, the rod is stably moved. Likewise, the jet flow generating apparatus may further comprise a bearing, the bearing being used for the rod, the bearing being disposed in a second through-hole.

According to an embodiment of the present invention, the rod passes through the first vibration plate. The jet flow generating apparatus further includes a second bearing, the second bearing being used for the rod, the second bearing being disposed at a position opposite to the first bearing of the first casing. Thus, since the rod is more stably moved than the foregoing rod for which only the first bearing is used, the vibration plate stably vibrates. Likewise, the rod may pass through a second vibration plate. The jet flow generating apparatus may further comprise a bearing, the bearing being used for the rod, the bearing being disposed at a position opposite to the first bearing of the first casing.

According to an embodiment of the present invention, the jet flow generating apparatus further includes a third casing having a third through-hole through which the rod passes, the third casing forming a third chamber group partitioned by a third vibration plate connected to the rod passing through the third through-hole. According to the present invention, the number of casings can be adjusted in accordance with, for example, the number of heat generating members to be cooled and the arrangement thereof. In addition, although the discharge amount of the coolant can be increased in proportion with the number of casings, the apparatus needs only one actuator. Thus, the power consumption, cost, and size of the jet flow generating apparatus can be decreased.

According to an embodiment of the present invention, the jet flow generating apparatus further includes at least one of a first seal member for sealing the first casing passing through the first through-hole against the outside and a second seal member for sealing the second casing passing through the second through-hole against the outside. Thus, since the air tightness of the chamber is improved, a jet flow can be effectively generated. The seal members may be solid or fluid.

According to an embodiment of the present invention, the actuator is configured to contact the first and second casings so that the actuator covers the first and second through-holes. The jet flow generating apparatus further comprises a seal member for sealing the first casing against the second casing through a space between the rod and the actuator. The present invention is especially effective when the first casing and the second casing are connected by the actuator. According to the present invention, since the seal member can seal the inside of the first casing against the inside of the second casing, coolants can be effectively discharged from the first and second casings.

According to an embodiment of the present invention, the actuator is configured to contact the first and second casings so that the actuator covers the first and second through-holes. The actuator has a bearing used for the rod, and a seal member for sealing the first casing against the second casing through a space between the rod and the bearing. Since the seal member can seal the inside of the first casing against the inside of the second casing, coolants can be effectively discharged from the first and second casings.

According to an embodiment of the present invention, the actuator has a fluid pressure generating unit for moving the rod with the pressure of a fluid. The fluid pressure generating unit may generate water pressure, hydraulic pressure, air pressure, or the like.

According to an embodiment of the present invention, the actuator has a rotor, and a link mechanism for transferring the rotational motion of the rotor to the rod. The actuator, which uses the rotor, is a rotational motor with which the cost can be reduced in comparison with a linear motor.

According to an embodiment of the present invention, the jet flow generating apparatus further comprises a casing. The casing has a side wall, and a discharge nozzle for coolant, the discharge nozzle having a first end and a second end that protrude from the side wall to the outside and the inside of the casing, respectively, the casing forming each of the chambers. Since the second end of the nozzle is disposed in the chambers, the nozzle can be as large as possible. Thus, the frequency of the generated sound can be decreased. According to the hearing sense of human, as the frequency of a sound becomes lower, the volume thereof becomes lower. Consequently, according to the present invention, the generated sound can be decreased as low as possible.

According to an embodiment of the present invention, the jet flow generating apparatus further includes a bent nozzle through which the coolant is discharged from at least one of the chambers. Thus, the heat generating member can be cooled in accordance with the direction of the bent nozzle. Alternatively, at least one set of nozzles that protrude from the different chambers can be arranged in a direction different from the direction of the chambers so that the distance d is satisfied.

According to an embodiment of the present invention, the jet flow generating apparatus further includes a flexible nozzle through which the coolant is discharged from at least one of the chambers. Thus, the direction of the nozzle can be varied in accordance with the arrangement of the heat generating member.

According to an embodiment of the present invention, the jet flow generating apparatus further includes a first nozzle through which the coolant is discharged from at least one chamber to a first heat generating member, and a second nozzle through which the coolant is discharged to a second heat generating member that is different from the first heat generating member. Thus, the coolant can be discharged to a plurality of heat generating members disposed at different positions. A conventional fan that rotates an impeller cannot locally cool an object unlike the present invention. The first nozzle and the second nozzle may discharge the coolant from the same chamber. Alternatively, the first nozzle and the second nozzle may discharge the coolant from different chambers.

According to an embodiment of the present invention, the first nozzle is straightly formed, whereas the second nozzle is bent. Thus, in accordance with the arrangement of the heat generating member, it can cooled by the second nozzle, which is bent.

According to an embodiment of the present invention, the first nozzle has a first flow path. The first flow path has a first length and a first sectional area perpendicular to the flow direction of the coolant. The second nozzle has a second flow path. The second flow path has a second length that is larger than the first length and a second sectional area that is larger than the first sectional area. Thus, the resistance of the second flow path can be prevented from increasing. As a result, a proper amount of coolant can be discharged from the second nozzle.

According to an embodiment of the present invention, the jet flow generating apparatus further comprises a casing disposed on a heat sink having a plurality of heat radiation fins, having a side surface almost perpendicular to the heat radiation fins, the casing forming at least one of the plurality of chambers, and at least one set of nozzles that are bent, protrude from the side surface of the casing toward the heat radiation fins, and discharge the coolant. Thus, in comparison with the structure in which the side surface of the casing in which a nozzle is disposed faces the heat sink, the jet flow generating apparatus can be easily disposed against the heat sink. In addition, according to the present invention, the enveloped volume of the heat sink and the jet flow generating apparatus can be decreased as much as possible.

According to an embodiment of the present invention, the vibrating mechanism has a vibration plate that is a side wall vertically disposed in the direction of the vibration, the side wall having a first end portion and a second end portion that are opposite in the direction of the vibration, a first supporting member for supporting the first end portion, and a second supporting member for supporting the second end portion. Since the side wall is supported by the first supporting member and the second supporting member arranged in the direction of the vibration, the vibration plate can be stably vibrated, not laterally vibrated. Since the vibrating plate is prevented from being laterally vibrated, if the driving mechanism that vibrates the vibration plate is electro-magnetically driven, the stator and the movable member can be prevented from colliding. Since they hardly collide, the space between the stator and the movable portion can be narrowed, the magnetic field applied to the coil can be strengthened. As a result, the driving mechanism can effectively produce a driving force. In addition, since they hardly collide, vibrations of higher modes can be suppressed. As a result, the noise of the apparatus can be decreased.

According to an embodiment of the present invention, the vibrating mechanism has a vibration plate that has a side wall disposed in the direction of the vibration and a supporting member that slidably supports the side wall in the direction of the vibration. Thus, since the supporting area of the side wall that the bearing member supports can be increased, the vibration plate can be stably vibrated, not laterally vibrated.

According to an embodiment of the present invention, the vibrating mechanism has a lubricant interposed between the side wall and the supporting member. Thus, the vibration plate can be smoothly vibrated. In addition, the air-tightness of each of the chambers can be improved.

According to an embodiment of the present invention, the vibrating mechanism has a vibration plate, a supporting member for supporting the periphery of the vibration plate, a driving unit for driving the vibration plate, and a lead wire, connected between the vibration plate and the supporting member, for electrically transferring a control signal from the control unit to the driving unit. Thus, since the lead wire is integrally moved with the vibration plate and the supporting member, the lead wire can be prevented from breaking in comparison with a suspended lead wire.

According to an embodiment of the present invention, the supporting member has a threaded groove formed around the vibration plate. The lead wire is wired along the groove. Even if the lead wire is integrally moved with the vibration plate and the supporting member, if the lead wire is wired in the direction in which the displacement amount of the supporting member becomes large, nearly from the center of the vibration plate to the outside, since the lead wire is largely stressed, there is a possibility in which the lead wire will break. However, according to the present invention, such a problem can be solved. According to the present invention, the groove includes a shape like bellows.

An embodiment of the present invention is an electronic device comprising a heat generating member, a plurality of chambers containing a coolant, a vibrating mechanism for vibrating the coolant contained in the plurality of chambers so as to pulsatively discharge the coolant toward the heat generating member, and a control unit for controlling the vibration of the vibrating mechanism so that the sound waves generated by the coolant discharged from the plurality of chambers weaken each other.

According to the present invention, the heat generating member is, for example, an electric part such as an IC chip or a resistor or heat radiation fins. However, the heat generating member is not limited to these, but any one that generates heat. The electronic device is, for example, a computer, a PDA (Personal Digital Assistance), an electric appliance, or the like.

An embodiment of the present invention is a jet flow generating method comprising the steps of vibrating a coolant contained in a plurality of chambers each having an opening so as to pulsatively discharge the coolant through each of the openings, and controlling the vibrations of the coolant so that the sound waves generated by the coolant discharged from the plurality of chambers weaken each other.

According to the present invention, the sound waves generated in the plurality of chambers weaken each other. Thus, as the clock frequencies of such as IC chips as heat generating members increase, even if the heat thereof increases, the heat can be effectively radiated. In addition, the noise of the apparatus can be suppressed.

An embodiment of the present invention is a jet flow generating apparatus comprising a plurality of discharging means for pulsatively discharging a medium, and wave form adjusting means for adjusting at least either amplitudes or phases of the sound waves so that the sound waves generated by the plurality of discharging means are offset.

According to the present invention, the phrase "offset" means that the sound waves generated by a plurality of discharging means are offset or weakened each other partly or throughout a region in which the sound waves are propagated. This definition will be applied to the following description.

According to the present invention, the wave form adjusting means is configured to offset the sound waves generated by a plurality of discharging means. Thus, as the clock frequencies of heat generating members such as an IC chip increase, even if the calorific powers generated thereby increase, the heat can be effectively radiated there from. In addition, the noise of the apparatus can be suppressed.

The wave form adjusting means needs to adjust, for example, the phases or amplitudes of the sounds so as to offset the sound waves generated by the plurality of discharging means.

According to an embodiment of the present invention, the medium is a gas. The jet flow generating apparatus further comprises a vibrating member for vibrating the gas. The plurality of discharging means each has an opening through which the gas vibrated by the vibrating member is jetted outside the apparatus. The wave form adjusting means has control means for controlling the vibration of the vibrating member. Since the control means is configured to control the vibration of the vibrating member, the sound waves that are generated are offset and thereby the noise of the apparatus can be prevented from generating.

According to the present invention, when the distance of adjacent openings of at least one discharging means is denoted by d (m) and the wave length of a sound wave generated by one discharging means is denoted by $\lambda$ (m), the condition of $d<\lambda/2$ is satisfied. Each of the plurality of discharging means can have a chamber. In this case, when the wave length $\lambda$ of a sound wave of each of the chambers is almost the same, since the sound waves generated at the openings of each chamber do not strengthen with almost the maximum amplitude, the noise of the apparatus can be suppressed as much as possible.

As described above, according to the present invention, while noise is prevented from generating, heat generated by a heat generating member can be effectively radiated. In addition, noise owing to the vibrations of harmonic components as distortion components can be suppressed.

Additional features and advantages of the present invention are described in, and will be apparent from, the following Detailed Description of the Invention and the figures.

DETAILED DESCRIPTION OF THE INVENTION

The present invention relates to a jet flow generating apparatus that generates a jet flow and cools a heat generating member such as an electronic part with the generated jet flow, an electronic device that is equipped with the jet flow generating apparatus, and a jet flow generating method.

Next, with reference to the accompanying drawings, an embodiment of the present invention will be described.

Figure 1:
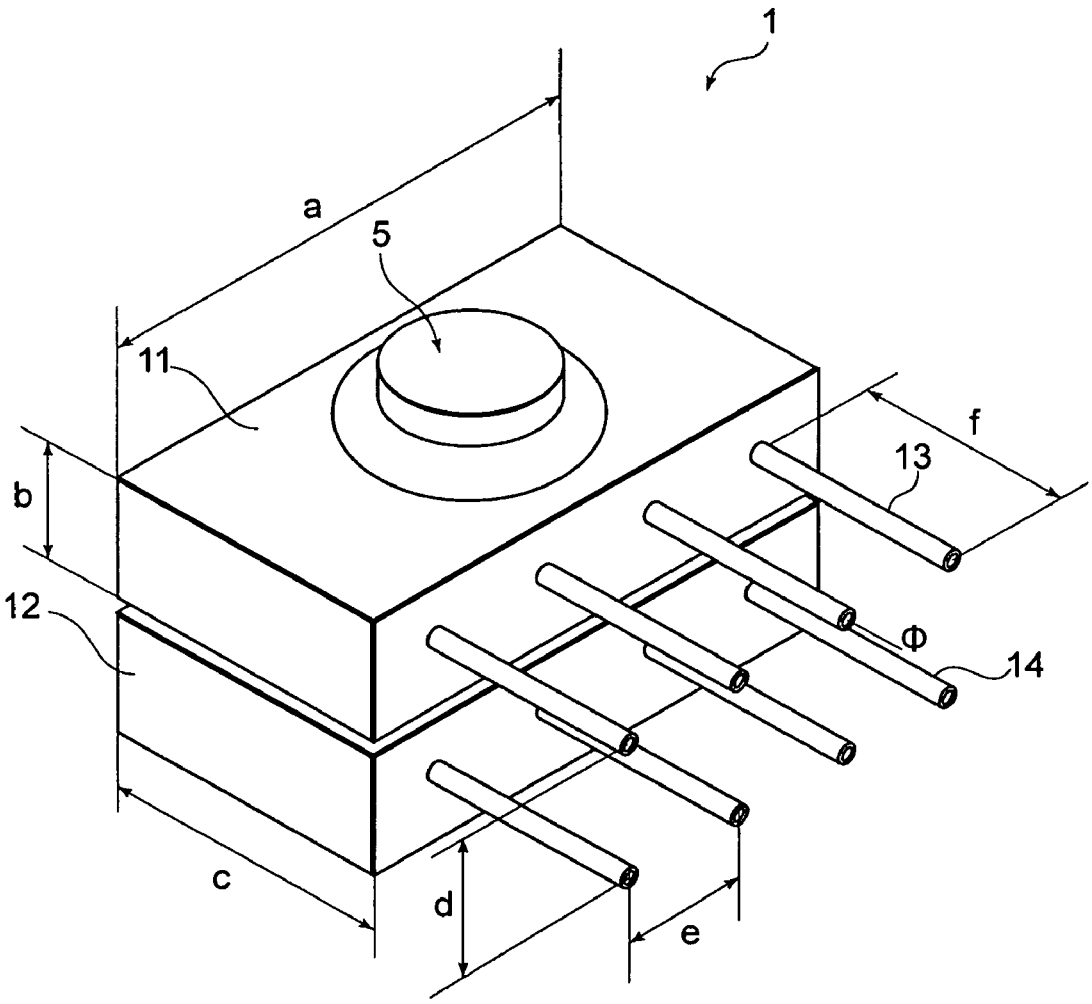
FIG. 1 is a perspective view showing a jet flow generating apparatus according to an embodiment of the present invention.
Figure 2:
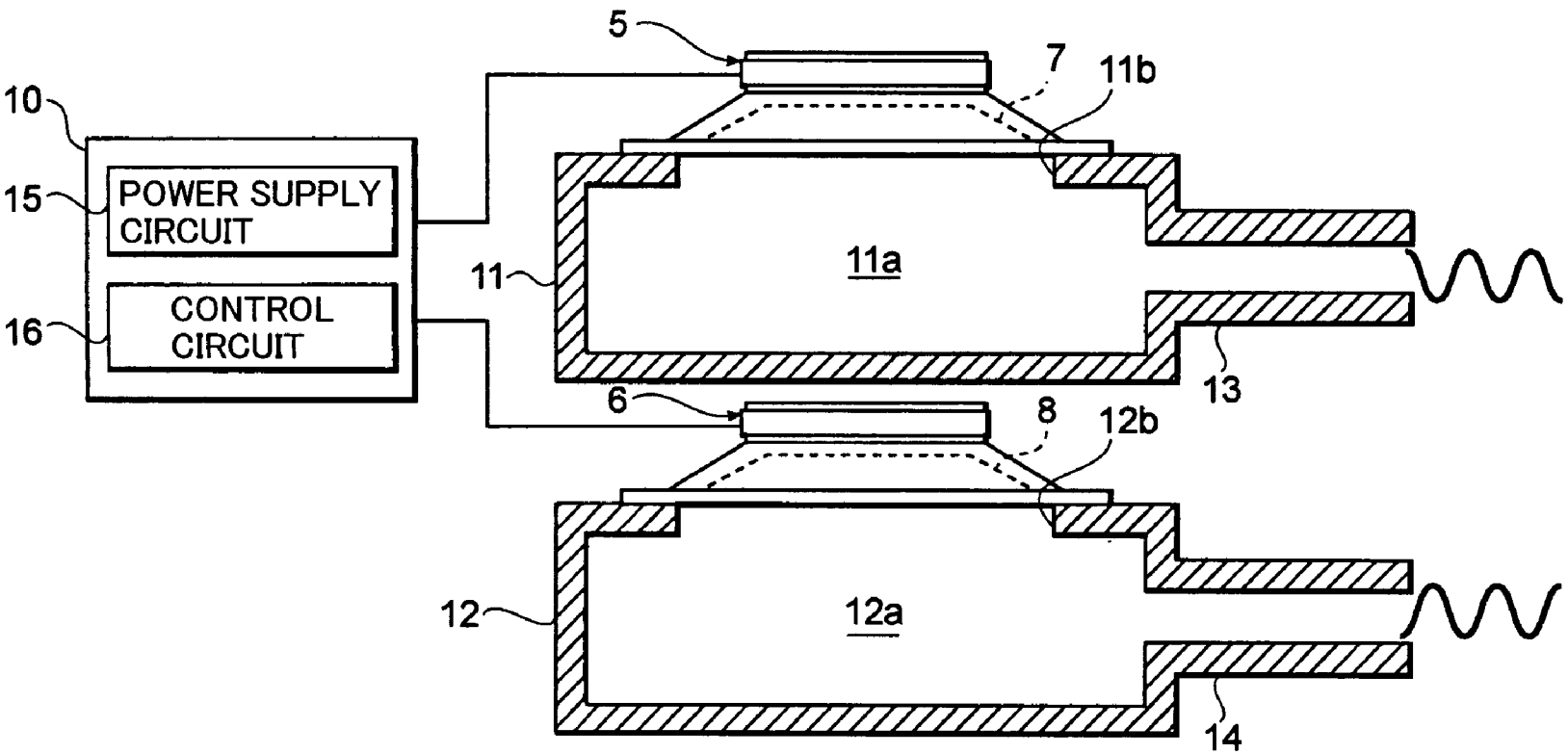
FIG. 2 is a sectional view showing the apparatus shown in FIG. 1.

FIG. 1 is a perspective view showing a jet flow generating apparatus according to an embodiment of the present invention. FIG. 2 is a sectional view showing the jet flow generating apparatus.

A jet flow generating apparatus 1 has, for example, two independent casings 11 and 12. The casings 11 and 12 have vibrating mechanisms 5 and 6, respectively. The vibrating mechanisms 5 and 6 have vibration plates 7 and 8, respectively. The vibration plates 7 and 8 are composed of a soft film material, for example, PET (polyethylene terephthalate) film or the like. The vibrating mechanisms 5 and 6 each have a structure of, for example, a speaker. The vibrating mechanisms 5 and 6 each are composed of a coil, a magnet, and so forth (not shown). The vibration plates 7 and 8 are asymmetrical with respect to the directions of the vibrations thereof.

The casings 11 and 12 form chambers 11*a* and 12*a*, respectively. The chambers 11*a* and 12*a* each are filled with a gas. As the gas, for example, air can be used. A plurality of nozzles 13 and 14 are disposed as openings on side surfaces of the casings 11 and 12, respectively. Each chamber may not have a plurality of nozzles 13 (or nozzles 14), but one nozzle 13 (or nozzle 14). In addition, as shown in FIGS. 1 and 2, the nozzles such as the nozzle 13 and so forth may not protrude from the casing 11 and so forth, respectively. Alternatively, the nozzles such as the nozzle 13 and so forth may be formed in the wall surfaces of the casing 11 and so forth.

Hole portions 11*b* and 11*b* are formed at the upper portions of the casings 11 and 12, respectively. The vibrating mechanisms 5 and 6 are disposed so that they cover the hole portions 11*b* and 12*b*, respectively.

The vibrating mechanisms 5 and 6 are controlled by a control unit 10. The control unit 10 has a power supply circuit 15 that applies a sinusoidal AC voltage to the vibrating mechanisms 5 and 6, and a control circuit 16 that controls the wave forms of the vibrations of the vibrating mechanisms 5 and 6. As will be described later, the control unit 10 causes the control circuit 16 to control the vibrating mechanisms 5 and 6 so that vibrations of air generated by the vibrating mechanisms 5 and 6 are offset or weakened.

The casings 11 and 12 are made of a highly rigid material such as a metal, for example, aluminum. The casings 11 and 12 are formed in, for example, a rectangular parallelepiped shape. The shapes, materials, openings, and so forth of the casings 11 and 12 are the same. Likewise, the shapes, materials, and so forth of the vibration plates 7 and 8 are the same.

Next, the operation of the jet flow generating apparatus 1 structured as described above will be described. The control unit 10 drives the vibrating mechanisms 5 and 6 so as to sinusoidally vibrate them: As a result, the volumes of the chambers 11*a* and 12*a* increase or decrease. As the volumes of the vibration plates 7 and 8 vary, the internal pressures of the chambers 11*a* and 12*a* also vary. Consequently, air streams pulsatively generate through the nozzles 13 and 14. When the vibration plate 7 deforms in the direction in which the volume of the chamber 11*a* increases, the internal pressure of the chamber 11*a* decreases. Thus, outer air of the casing 11 enters the chamber through the nozzles 13. In contrast, when the vibration plate 7 deforms in the direction in which the volume of the chamber 111*a* decreases, the internal pressure of the chamber 11*a* increases. As a result, air in the chamber 111*a* is jetted to the outside of the casing 11 through the nozzles 13. These operations apply to the vibrating mechanism 6, the chamber 12*a*, and so forth. When the jet air is discharged to, for example, a highly heated portion, it can be cooled.

On the other hand, the vibrations of the vibration plates 7 and 8 are propagated as sound waves in air. In other words, besides air jet flows through the nozzles 13 and 14, the vibrations of the vibration plates 7 and 8 cause dense and thin portions of air to be formed from the chambers 11*a* and 12*a* to the outside. As a result, a sound wave as a longitudinal wave takes place. The sound wave becomes noise. In particular, the noise sounds are generated mainly from the nozzles 13 and 14.

Figure 3:
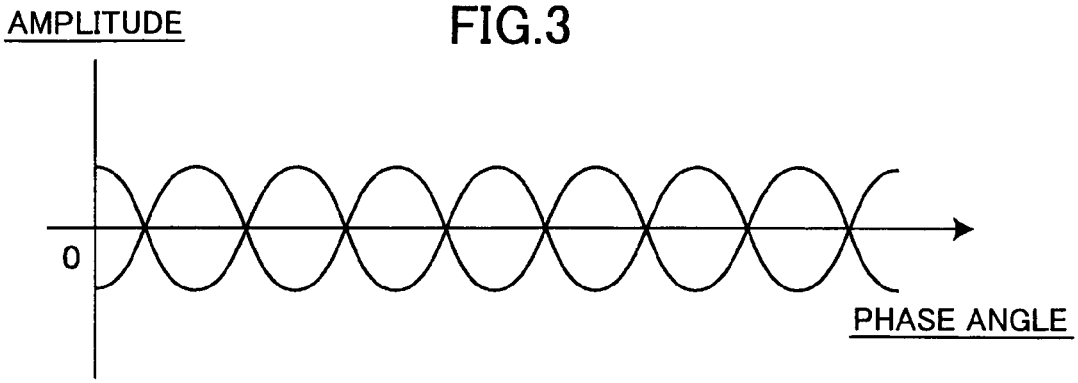
FIG. 3 are wave forms showing vibrations of two vibration plates.

To suppress the forgoing noise, as shown in FIG. 3, the vibrations of the vibration plates 7 and 8 are controlled by the control unit 10 so that the vibrations of air generated by the casings 11 and 12 are offset or weakened each other. Specifically, the vibrations are controlled so that the wave forms of the vibrations of the vibration plates 7 and 8 become the same and the phases thereof become inverse. Thus, since the wave forms weaken each other, the noise of the apparatus can be decreased.

Figure 4:
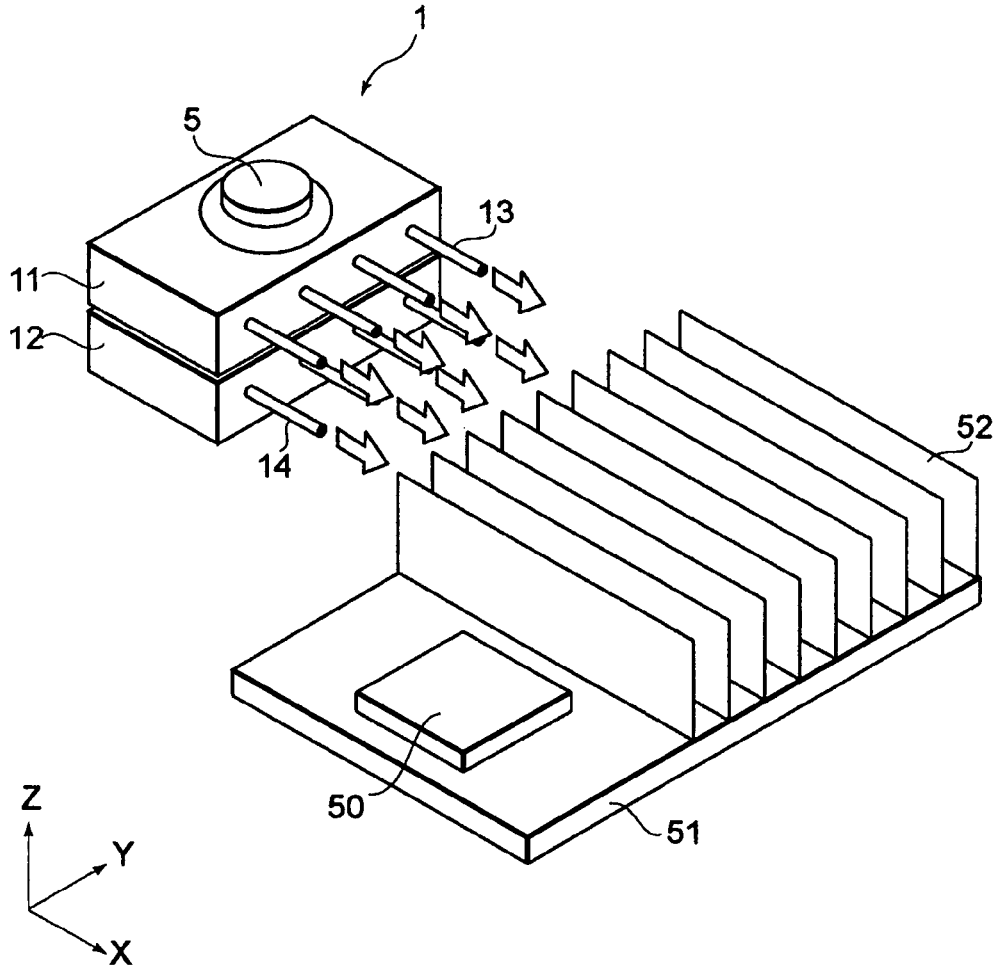
FIG. 4 is a perspective view showing an example in which heat of, for example, an IC chip is radiated.

FIG. 4 is a perspective view showing an example in which heat of, for example, an IC chip is radiated by the jet flow generating apparatus 1. The IC chip 50 is disposed in contact with a heat spreader (or a heat transporting member having a heat pipe function). A plurality of heat radiation fins 52 is mounted on a heat spreader 51. The jet flow generating apparatus 1 is disposed so that the air jet flows of the nozzles 13 and 14 face the heat radiation fins 52.

The heat generated by the IC chip 50 is spread by the heat spreader 51 and transferred to the heat radiation fins. Then, highly heated air remains in the vicinity of the heat radiation fins 52. As a result, a thermal boundary layer is formed. To remove it, for example, the vibrating mechanisms 5 and 6 vibrate so as to discharge the jet flows generated by the nozzles 13 and 14 toward the heat radiation fins 52. The jet flows break the thermal boundary layer. As a result, the heat is effectively radiated.

According to an embodiment of the present invention, as the number of vibrating mechanisms such as the vibrating mechanism 5 and so forth or the number of casings such as the casting 11 and so forth are increased or as the amplitudes of the vibrating mechanisms such as the vibrating mechanism 5 and so forth are increased, the flow amount of a combined jet flow owing to the vibrations of the vibrating mechanisms such as the vibrating mechanism 5 and so forth can be increased. Thus, as the clock frequencies of IC chips are increased, even if the calorific powers generated thereby are increased, the heat thereof can be effectively radiated. In contrast, even if the number of vibrating mechanisms such as the vibrating mechanism 5 and so forth is increased or the amplitudes thereof are increased, the control unit 10 controls the phases of the vibrations of the sound waves so that the sound waves weaken each other. In other words, while the heat can be effectively radiated, the noise can be prevented from generating.

In addition, according to the embodiment of the present invention, since the plurality of nozzles 13 (or 14) are arranged in the Y direction, the heat of a heat generating member can be effectively radiated in accordance with the length in the Y direction of the radiation fins such as the heat radiation fins 52 and so forth.

According to the embodiment of the present invention, since at least the vibration plates are sinusoidally vibrated and the sound waves are offset, the sound waves can be more effectively offset than the case that the noise is weakened by two fans that discharge air. Since the sound wave that is output from one fan is generally noisy, it might be difficult to mute the noise with those two fans.

Next, an experimental result about the noise decreasing effect using the jet flow generating apparatus 1 will be described. In the experiment, the jet flow generating apparatus 1 has the following dimensions.

a=100 (mm), b=18 (mm), c=50 (mm), d=20 (mm), e=25 (mm), f=40 (mm), diameters ϕ of nozzles 13 and 14=3 (mm) Condition (1)

In addition, the frequencies of the vibrating mechanisms 5 and 6 are around 100 (Hz), which is an audible range of human.

Figure 5:
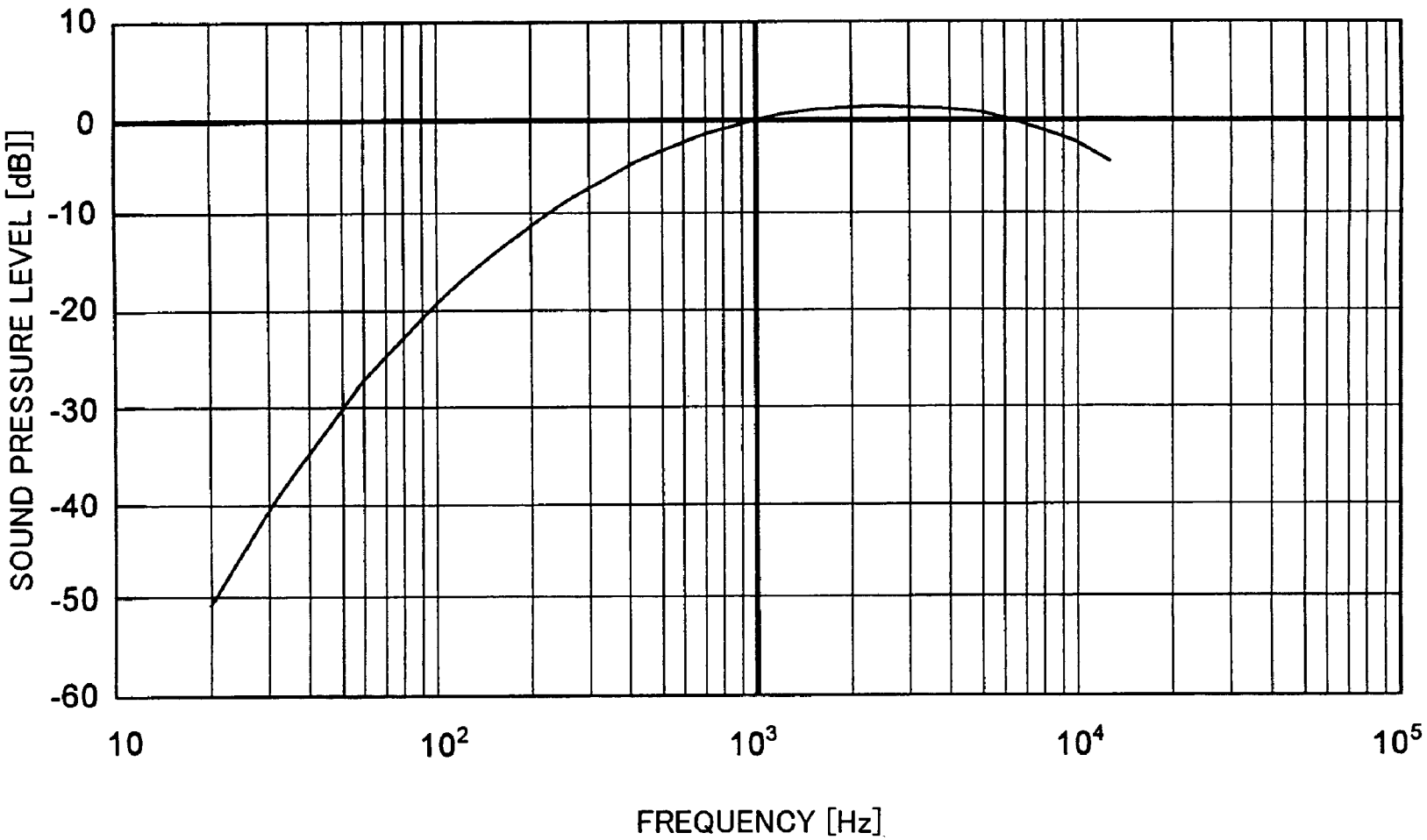
FIG. 5 is a graph (equal loudness curve of A characteristic) showing a characteristic of hearing sense of human.

FIG. 5 is a graph showing an audible characteristic of human. The graph is an equi-loudness curve (A characteristic) prescribed by JIS standard. The graph represents that in a frequency band from 20 (Hz) to 20 (kHz), when a human is exposed to the same sound pressure level, how he or she can hear it. In other words, the graph represents that with reference to a sound wave of 1 (kHz), at what intensity a human can hear sounds of individual frequencies. The graph shows that in the same sound pressure level, a human can hear a sound of 50 (Hz) weaker than a sound of 1 (kHz) by 30 (dB). The sound pressure level Lp (dB) is defined by the following formula (1).

$$Lp=20\log(p/p0) \quad \text{Formula (1)}$$

Where p represents the sound pressure (Pa), and p0 represents a reference sound pressure (20 μPa).

Figure 6:
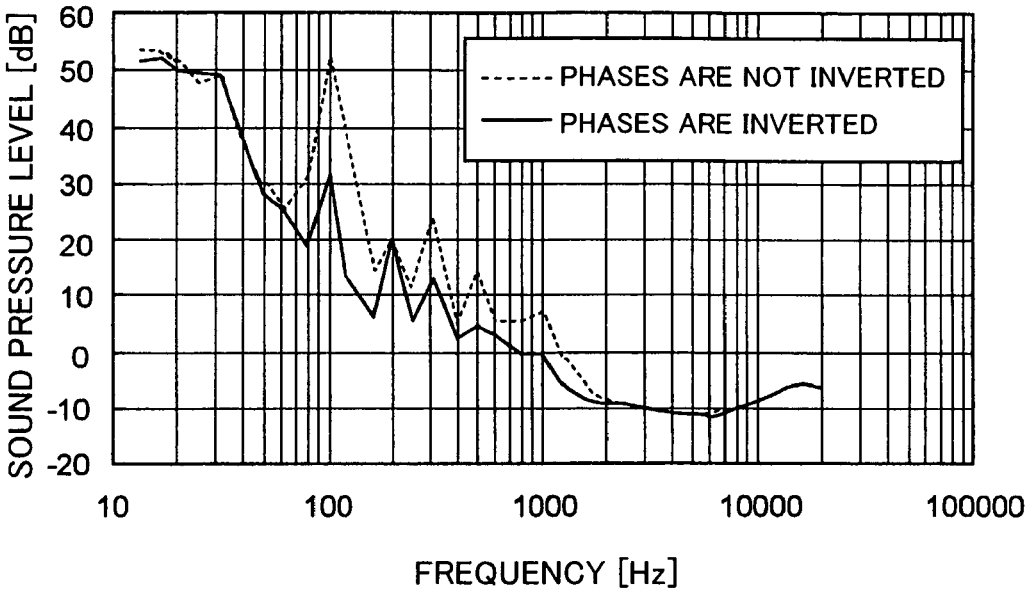
FIG. 6 is a graph showing a result of the measurement of noise of a jet flow generating apparatus using a sound pressure meter.

FIG. 6 is a graph showing a result of the measurement of noise by the jet flow generating apparatus 1 using a sound pressure meter. The graph shows a result of the measurement of the sound waves in a frequency band from around 20 (Hz) to 20 (kHz), which is an audible range of human. In addition, the graph shows "sound pressure level" rather than "noise level". Thus, the graph is not compensated with the foregoing A characteristic (the sound pressure level is not compensated in accordance with the audible characteristic of human). Consequently, the graph shown in FIG. 6 represents that as the frequency becomes lower, the sound pressure level becomes higher. However, the noise that humans can hear does not almost vary. The graph shows that the sound waves most effectively weaken each other at 100 (Hz).

When the distance between the nozzles 13 and 14 (the distance between openings) is denoted by d as shown in FIG. 1, and the wave length of a sound wave is denoted by λ (m), $$d<\lambda/2 \quad \text{Formula (2)}$$

If the formula (2) is satisfied, the following effect can be obtained. In other words, the sound waves generated by the nozzles such as the nozzle 13 and so forth do not strengthen each other with almost the maximum amplitude, the noise can be almost prevented from generating. Next, the reason why the foregoing effect can be obtained will be described.

Figure 7:
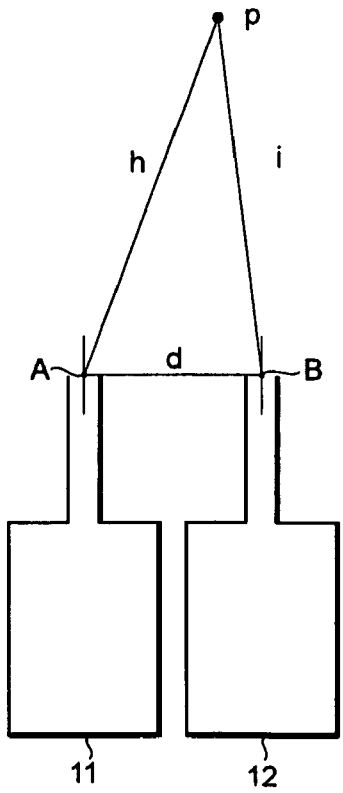
FIG. 7 is a schematic diagram describing a combined sound wave of the sound waves generated by two sound sources A and B.

As shown in FIG. 7, the distance between the opening 13 of the chamber 11*a* and the opening 14 of the chamber 12*a* is denoted by d. The distance of AP is denoted by h. The distance of BP is denoted by i. If |h−i| is smaller than ½ of the wave length λ of the sound waves generated by sound sources A and B of the chambers 11*a* and 12*a* and the phases of these sound waves are inverse, the two sound waves weaken each other. The triangle definition shows that the maximum limit of |h−1| is d, namely, |h−i|<d. Thus, d needs to be smaller than the half wave length, namely d<λ/2. When the distance d is defined in this manner, these two sound waves do not strengthen each other with the almost maximum amplitudes.

Figure 8:
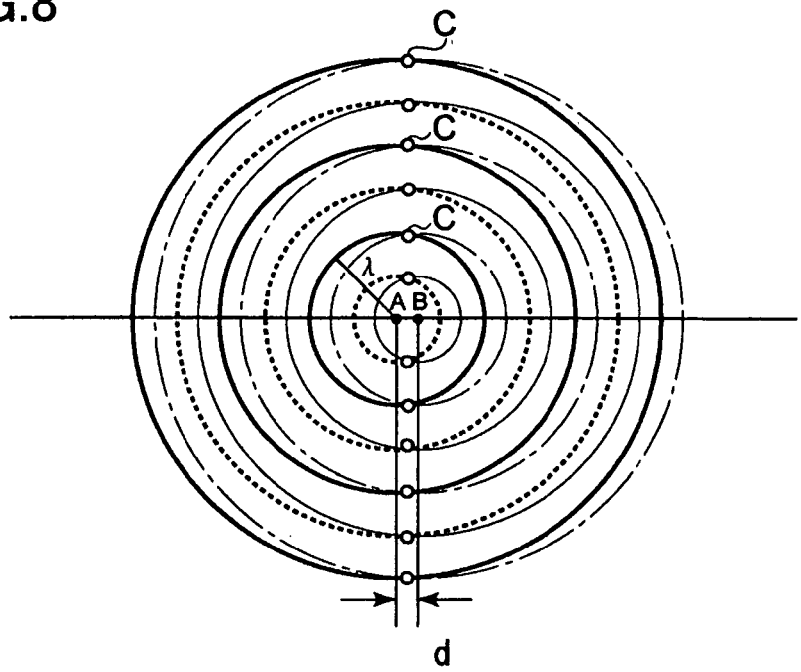
FIG. 8 is a schematic diagram describing a combined sound wave of the sound waves generated by two sound sources A and B.

This phenomenon can be also understood with wave fronts of the sound waves generated by the two sound sources A and B as shown in FIG. 8. In the drawing, a thick line represents a wave front of the sound source A, whereas a thin line represents a wave front of the sound source B. In addition, a solid line of the wave front represents a crest, whereas a broken line of the wave front represents a trough. The distance d between the sound sources A and B is d<λ/2 and the phases thereof are inverse. Thus, the two sound waves weaken each other at a plurality of points C (white circles) with the maximum amplitude. As a result, there are no positions that strengthen with the maximum amplitude.

According to the embodiment of the present invention, as long as the foregoing formula (2) is satisfied, the shapes of the chambers and so forth are not restricted.

For example, when the number of chambers is 2, if the phases of the sound waves generated in the chambers are shifted by 360°/2=180° and the vibration plates 7 and 8 are vibrated, the wave forms are inverted. As a result, the sound waves weaken each other.

Figure 9:
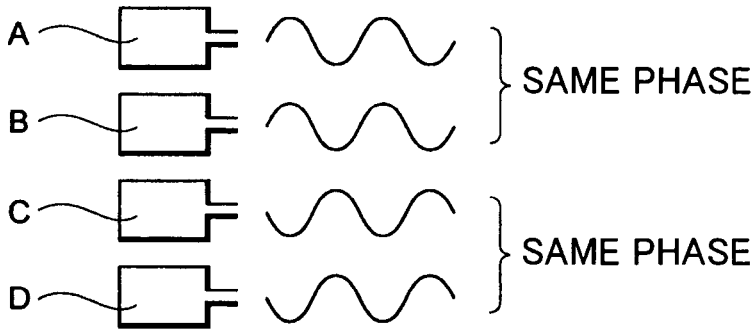
FIG. 9 are schematic diagrams describing a muting operation in the case that there are four chambers.

In addition, as shown in FIG. 9, when four chambers A, B, C, and D are used, if the wave lengths and amplitudes of the sound waves generated in the chambers A, B, C, and D are the same, the phases of the wave forms of the sound waves generated in the chambers A and B are the same, and the phases of the wave forms of the sound waves generated in the chambers A and B are the same and are shifted from those generated in the chambers C and D by 180° each, the sound waves weaken each other.

Figure 10:
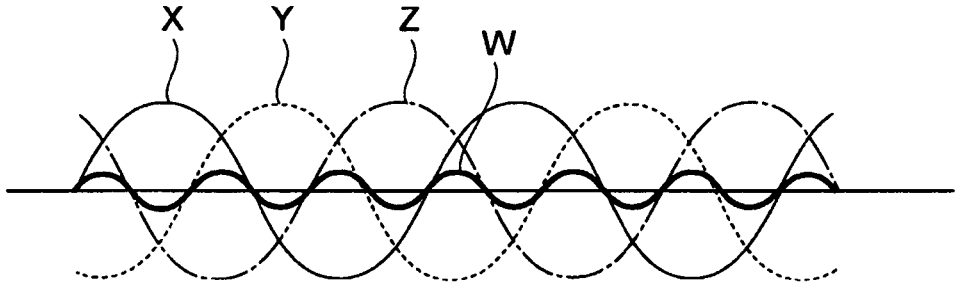
FIG. 10 is a schematic diagram showing wave forms in the case that there are three sound sources and their sound waves have different phases.

When the number of chambers is n (where n=2, 3, 4, . . . ) and the wave lengths and amplitudes of the sound waves generated in the chambers are almost the same, the control unit 10 may cause the wave forms of the sound waves generated in the chambers to have phase differences of 360°/n. Thus, combined waves of the sound waves of the entire system containing n chambers weaken each other. In reality, FIG. 10 shows phase differences of the sound waves in the case of, for example, n=3. The phase differences of three wave forms X, Y, and Z need to be shifted by 120° each. As a result, the combined wave is represented by a solid line W. Thus, the sound waves weaken each other.

When the number of chambers is n (where n=2, 3, 4, . . . ), the wave length of each of the sound waves generated in the chambers is X, the amplitudes thereof are almost the same, and the distance of adjacent openings of adjacent chambers is d (m), the following formula can be satisfied.

$$d<\lambda/\{2(n-1)\} \quad \text{Formula (3)}$$

In this case, the distance between openings that are the most spaced apart is $\lambda/\{2(n-1)\}$. Since the wave length is sufficiently larger than the distance, the combined wave forms of the sound waves generated in the chambers weaken each other regardless of the positions and directions thereof. In other words, since the maximum amplitudes of the sound waves generated by the openings of the chambers do no strengthen, the noise of the apparatus can be almost prevented from generating.

When three chambers A, B, and C are used, they can generate the sound waves of that the wave length of each of the sound waves generated in the chambers is λ, the wave forms of the sound waves generated in the chambers A and B have an amplitude a and the same phase, and the amplitude of a sound wave generated in the chamber C is 2×a, and the phase of the sound wave generated in the chamber C is shifted by 180° (from the phase of each of the sound waves generated in the chambers A and B). In this case, the crest portions and the trough portions of the wave forms of the sound waves generated in the chambers A, B, and C weaken each other. As a result, the combined wave form becomes flat. Consequently, the muting effect can be obtained.

Figure 11:
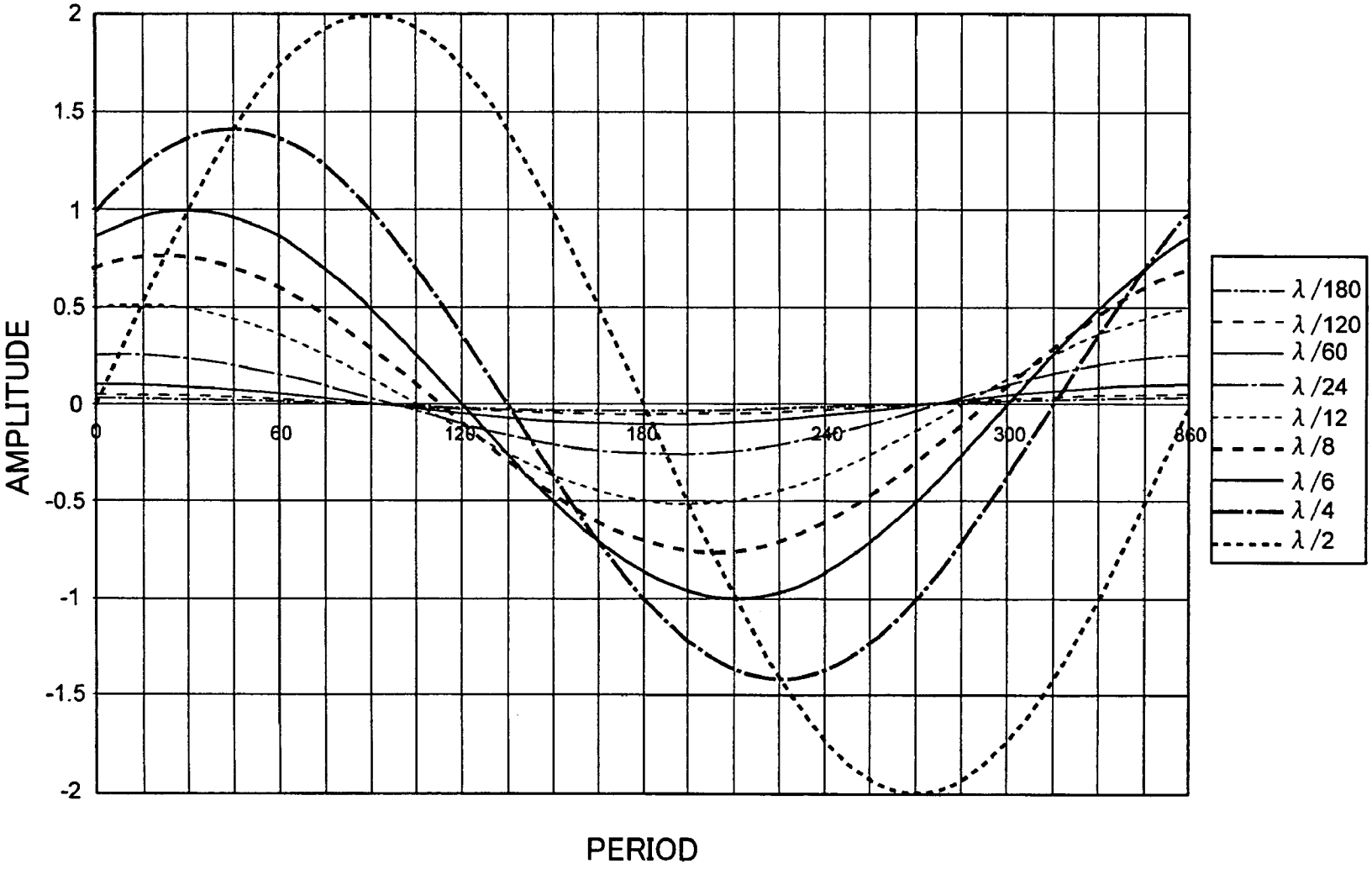
FIG. 11 is a graph showing calculated results of combined waves of two sound waves.

FIG. 11 is a graph showing combined waves of two sound waves with a parameter of a distance d ranging from λ/180 to λ/2 in the foregoing experiment using the jet flow generating apparatus 1. In the graph, it can be thought that the amplitude on the vertical axis represents a relative value of each parameter value. In this case, in addition to the foregoing experimental condition (1), the following condition was added.

Velocity of a sound wave=345 (m/s), frequency f=100 (Hz) Condition (2)

In this case, since λ=v/f, λ=3.45 (m). The amplitudes of the two sound sources are 1 each.

The graph shows that with d=λ/6, the amplitude becomes 1 (maximum). In other words, when the following equation is satisfied.

$$d<\lambda/6 \quad \text{Formula (4)}$$

It is clear that the sound of the two chambers is weaker than the sound of one chamber using one vibration plate. When three sound sources are used, it is necessary to satisfy the condition of 2d<λ/6. In other words, when the number of vibration plates is n (where n=2, 3, 4, . . . ), if the following condition is satisfied.

$$d<\lambda/\{6(n-1)\} \quad \text{Formula (5)}$$

The resultant sound is weaker than the sound of one chamber having one vibration plate.

As described above, when the condition (2) is satisfied, since λ=3.45 (m), it is necessary to satisfy d<λ/2=1.725 (m) given by the formula (2) or d<λ/6=0.575 (m) given by the formula (4). In the jet flow generating apparatus 1 used in the experiment, since d is 0.025 (m), the formulas (2) and (4) are sufficiently satisfied.

When the shapes, sizes, and so forth of two chambers are the same, if d satisfies only the foregoing formula (2) or formula (4), the shapes and sizes of the chambers are not restricted. In addition, the arrangement of the two chambers is not restricted, and nor are the shapes of the openings and nozzles. Thus, when the jet flow generating apparatus 1 is mounted in an electronic device having an internal heat generating member, the relation of the positions of the heat generating member and the jet flow generating apparatus 1 can be changed where necessary. As a result, an electronic device can be easily designed.

Figure 12:
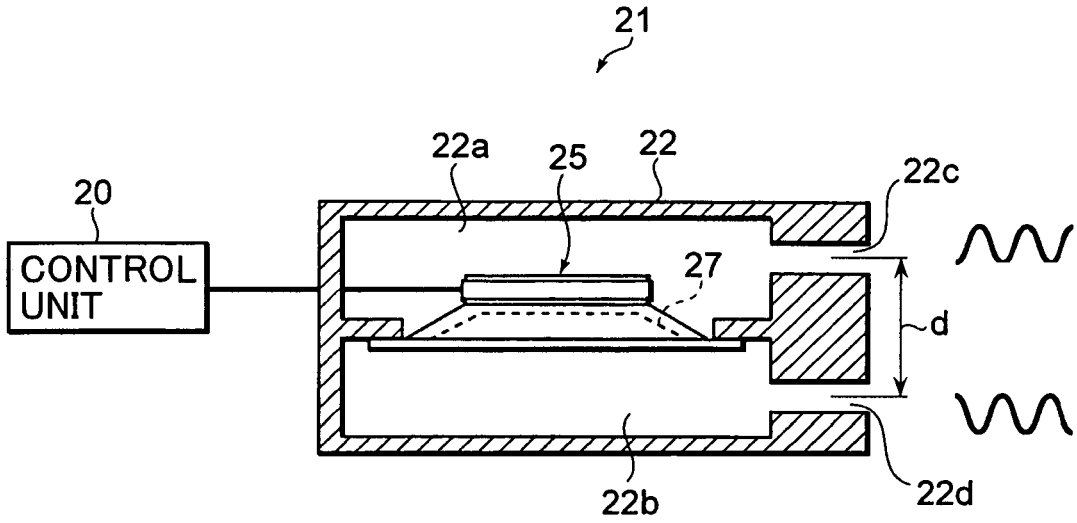
FIG. 12 is a sectional view showing a jet flow generating apparatus according to another embodiment.

FIG. 12 is a sectional view showing a jet flow generating apparatus according to another embodiment of the present invention. The jet flow generating apparatus according to this embodiment is denoted by reference numeral 21. The jet flow generating apparatus 21 is enclosed with one casing 22. The space in the casing 22 is partitioned by two chambers 22*a* and 22*b*. The shapes, volumes, and so forth of the chambers 22*a* and 22*b* are almost the same. The chambers 22*a* and 22*b* compose a chamber group. Openings 22*c* and 22*d* are formed in the partitioned chambers 22*a* and 22*b*, respectively. The opening 22*c* (or 22*d*) may be one opening or a plurality of openings. The shapes, sizes, and so forth of the openings 22*c* and 22*d* are almost the same. The materials and so forth of the casing 22, the vibration plate 27, and so forth of the jet flow generating apparatus 21 may be the same as those of the jet flow generating apparatus shown in FIG. 1. Like the foregoing embodiment, as a vibrating mechanism 25, for example, a speaker may be used. In addition, a control unit 20 that controls the vibrating mechanism 25 includes a power supply circuit and so forth that apply a sinusoidal AC voltage.

Next, the operation of the jet flow generating apparatus 21 having the foregoing structure will be described. The control unit 20 drives the vibrating mechanism 25 so as to sinusoidally vibrate the vibration plate 27. As a result, the internal pressures of the chambers 22*a* and 22*b* alternately increase and decrease. Thus, air streams generate through the openings 22*c* and 22*d*. The air streams alternately flow from the inside to the outside of the casing 22 and from the inside to the outside thereof. Since air is discharged to the outside of the casing 22, the air can be discharged to, for example, a highly heated portion so as to cool it.

On the other hand, besides the jet flows discharged from the openings 22*c* and 22*d*, the vibration of the vibration plate 27 propagate as sound waves in air through the openings 22*c* and 22*d*. The sound waves generated by the openings 22*c* and 22*d* are generated from the front surface and the rear surface of the same vibration plate. Since the shapes and so forth of the chambers 22*a* and 22*b* are the same as those of the openings 22*c* and 22*d*, the wave forms of the sound waves are the same and the phases thereof are inverted. Thus, since the sound waves generated through the openings 22*c* and 22*d* are offset, the noise of the apparatus is suppressed.

In particular, when the distance d between the openings 22*c* and 22*d* satisfies the foregoing formulas (2) and (3), the noise of the apparatus can be decreased.

When the jet flow generating apparatus 21 has, for example, three or more vibrating mechanisms as a modification of the embodiment shown in FIG. 12, if the amplitudes and phases of the vibration plates are adjusted, the sound waves weaken each other.

Figure 13:
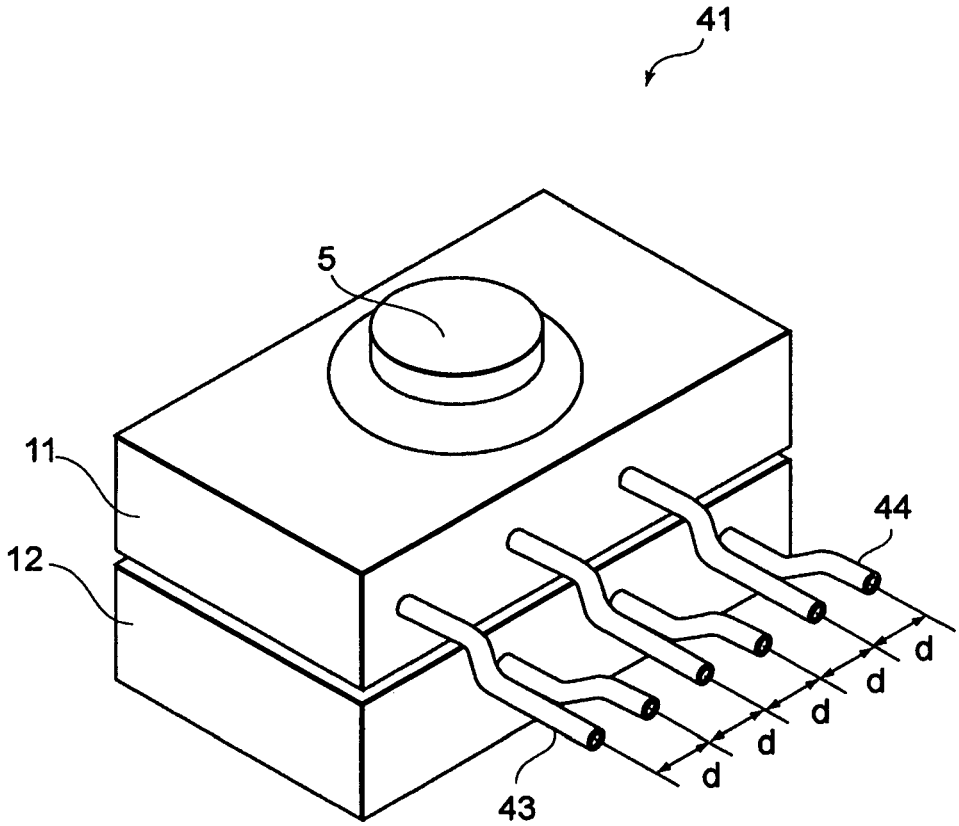
FIG. 13 is a perspective view showing a jet flow generating apparatus according to another embodiment.

FIG. 13 is a perspective view showing a jet flow generating apparatus according to another embodiment of the present invention. The jet flow generating apparatus according to this embodiment is denoted by reference numeral 41. The jet flow generating apparatus 41 has a plurality of nozzles 43 and a plurality of nozzles 44 that are alternately arranged at intervals of a distance d on the two casings 11 and 12. In particular, in the example, the plurality of nozzles 43 and the plurality of nozzles 44 are one-dimensionally arranged. In this structure, the same effect as the jet flow generating apparatuses according to the foregoing embodiments can be obtained. In other words, when only the distance d satisfies the foregoing formulas (2) and (3), the heat radiating process can be effectively performed while the noise is prevented from generating.

The present invention is not limited to the foregoing embodiments. Instead, the present invention can be applied to various modifications of the embodiments.

For example, the casings such as the casing 11 and so forth may have a sound absorbing member and a lid member. As the sound absorbing member, for example, glass wool can be used. Thus, the noise of the apparatus can be further decreased.

In the foregoing description, the shapes and materials of the chambers, the shapes of the openings, the shapes of the vibration plates, the shapes, materials, and so forth the vibration plates and the driving devices thereof are the same. However, as long as the wave forms of the sound waves generated by the openings of the chambers are the same and the phases of the sound waves are inverted, the shapes and so forth of the chambers and vibration plates may be different from each other.

According to the foregoing embodiments, as means for controlling wave forms so as to offset or weaken a plurality of the sound waves each other, the distance between adjacent openings formed in a chamber and the vibrations of the vibrating mechanisms are controlled. However, the present invention is not limited to that example. Alternatively, the wave forms can be adjusted depending on the shapes, materials, and structures of the chambers, and the shapes and so forth of the openings. In addition, the phases of the sound waves may be controlled. Moreover, the amplitudes and frequencies of the sound waves may be controlled so as to cause a plurality of the sound waves to weaken each other.

In the foregoing description, the number of openings formed in each chamber is not mentioned. Instead, many openings may be formed.

According to the foregoing embodiments, as the vibrating mechanism, a speaker is exemplified. Instead of the speaker, for example, a vibrating mechanism using a piezoelectric device may be used. In addition, the jet flow generating apparatuses according to the foregoing embodiments do not always need to have a vibrating mechanism. Instead, a jet flow may be generated by the rotation of a rotor like a roots pump.

Figure 14:
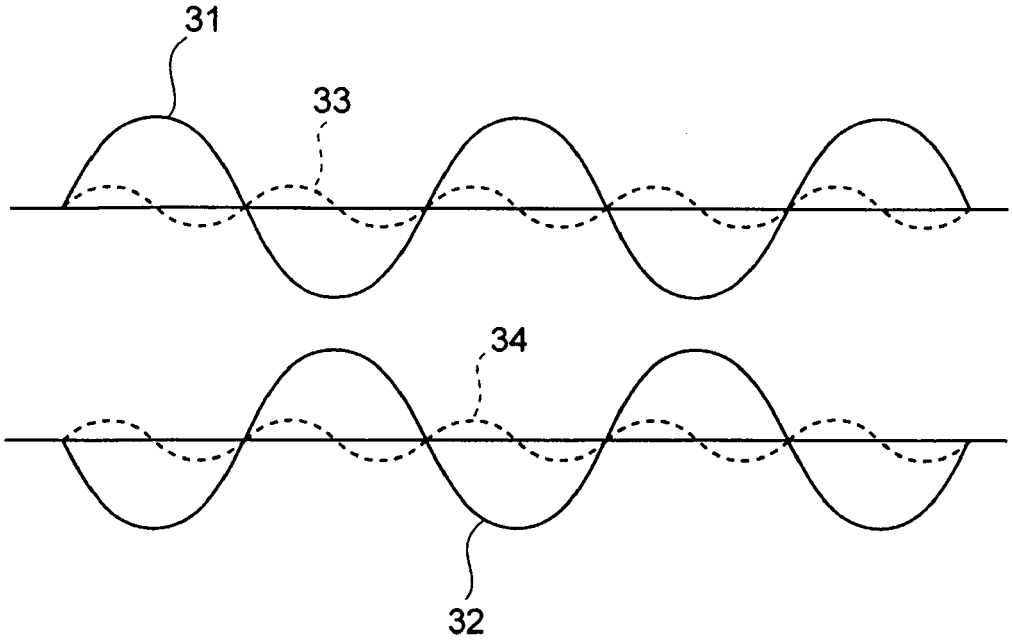
FIG. 14 is a schematic diagram showing wave forms in the case that, for example, two chambers described above are used and phases of the sound waves generated in the two chambers are shifted by 180°.

FIG. 14 is a graph showing wave forms of the sound waves generated in two chambers and whose phases are shifted by 180°. As shown in the graph, since wave forms 31 and 32 as basic frequency components are shifted by 180°, they weaken each other. However, since wave forms 33 and 34 of harmonics of the wave forms 31 and 32 have the same phase, they strengthen each other. Vibrations having harmonic components any integer times higher than the second harmonic component, namely a fourth harmonic, a sixth harmonic, and so forth strengthen each other. Thus, the noise of the apparatus is increased.

Figure 15:
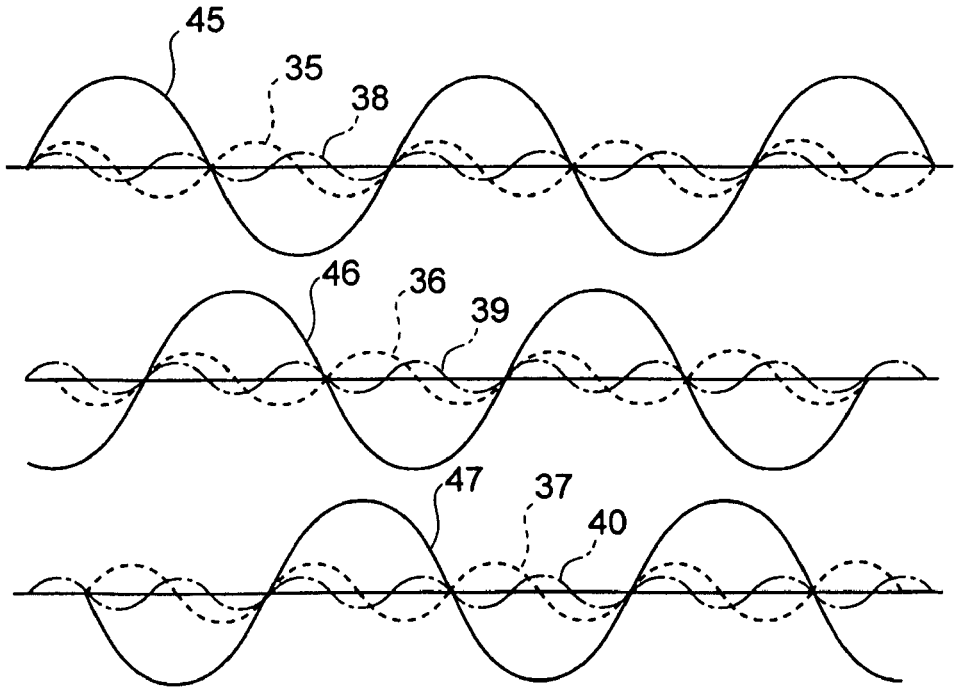
FIG. 15 is a schematic diagram showing wave forms of the sound waves generated in three chambers.

In addition, as shown in FIG. 15, even if phases of the sound waves are shifted by 120° each using, for example, three chambers, although the vibrations of the first basic waves 45, 46, and 47 and the second harmonics 35, 36, and 37 are offset, the vibrations of the third harmonics 38, 39, and 40 strengthen each other. In other words, when the number of chambers is n, although the vibrations having frequency components other than n-th harmonic are offset, the vibrations of the n-th harmonic strengthen each other. Thus, it is impossible to combine wave forms of a plurality of chambers so as to decrease the combined wave form of basic waves and decrease the combined wave form of all harmonics.

Generally, as the order number of a harmonic becomes larger, the amplitude thereof becomes smaller. Thus, according to the embodiment, it is preferred to control the sound waves using three or more chambers. The amplitude of a third harmonic is sufficiently small. In reality, this characteristic can be considered as follows.

When the noise levels of the first harmonic, second harmonic, and third harmonics of one chamber (sound source) are 20, 18, and 15 (dB A), respectively, namely n=1, the noise level of the chamber is around 22.9 (dBA). In this case, when a target noise level is 20 (dBA), the target cannot be satisfied. As described above, (dBA) represents a noise level in which the A compensation has been performed. This definition will be applied to the following description.

With n=2, first harmonics and third harmonics are offset. However, second harmonics strengthen each other. The noise level becomes 21 (dBA), which is twice higher than 18 (dBA) of second harmonics. Thus, the noise level does not satisfy the target.

Thus, according to the embodiment of the present invention, the condition of n=3 is applied. Although third harmonics strengthen each other, the sound waves of first harmonics and second harmonics are offset. The noise level becomes 19.8 (dBA), which is three times higher than 15 (dBA). This noise level satisfies the target. In other words, when three chambers are used, the phases of the sound waves generated in the three chambers are shifted by 120° each. As a result, the noise level can be more decreased than the target value.

In the example, although the target value of the noise level is 20 (dBA), the foregoing noise level 22.9 (dBA), which is a noise level of a sound wave generated in one chamber, may be designated as a target value.

Figures 16, 17:
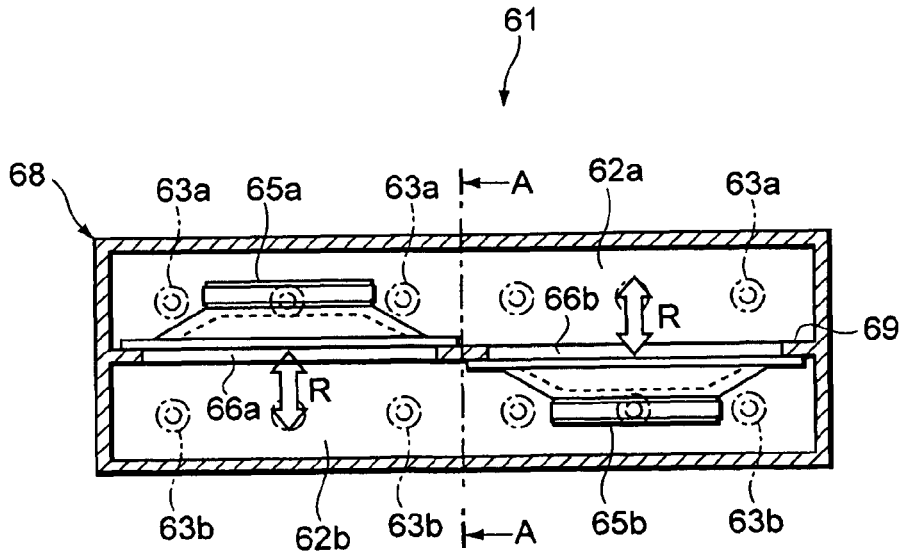
FIG. 16 is a table showing ratios of harmonics against a basic wave in the case that a speaker is driven with its rated input and 40% thereof.
FIG. 17 is a sectional view showing a jet flow generating apparatus according to another embodiment, the sectional view taken along line B-B shown in FIG. 18.

As another method for preventing a sound wave from not containing harmonics, the speaker (vibrating mechanism) can be driven with a drive power that is sufficiently lower than the rated input thereof. Generally, when the speaker is driven with a drive power close to the rated input, the ratio of harmonics contained in the generated sound wave increases. FIG. 16 is a table showing the ratio of amplitudes of harmonics against a basic wave in the case that a speaker is driven with its rated input (0.5 (W)) and 40 (%) (0.2 (W)) of the rated input. This table shows that when the speaker is driven with 40 (%) (0.2 (W)) of the rated input, harmonic components are decreased.

According to the embodiment, since the offset effect of the sound waves can be obtained against distortion components, the embodiment can be applied to a vibrating mechanism that distorts. Thus, an inexpensive vibrating mechanism can be used because the specifications thereof are not restricted. In addition, depending on the distortion ratio of the vibrating mechanism for use, the number of chambers for which noise is decreased can be minimized. Thus, the power consumption and space of the apparatus can be decreased.

Figure 18:
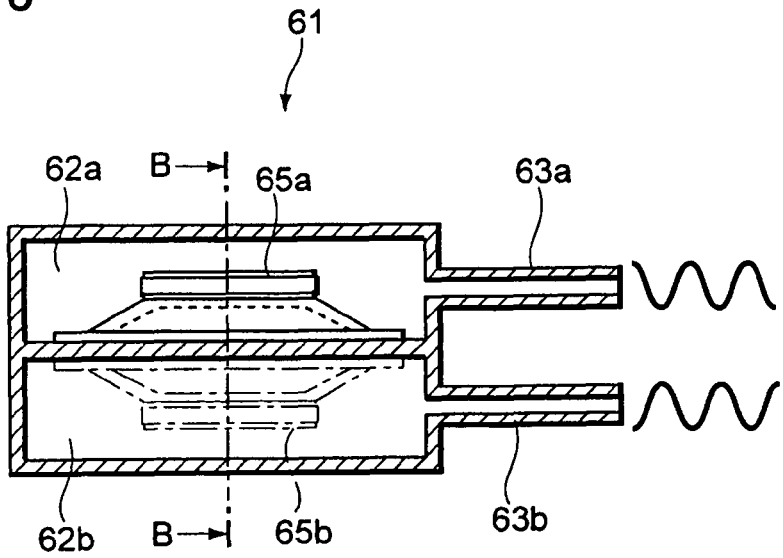
FIG. 18 is a sectional view taken along line A-A shown in FIG. 17.

FIG. 17 and FIG. 18 are sectional views showing a jet flow generating apparatus according to another embodiment of the present invention. FIG. 18 is a sectional view taken along line A-A of FIG. 17. FIG. 17 is a sectional view taken along line B-B of FIG. 18. The jet flow generating apparatus according to this embodiment is denoted by reference numeral 61. The jet flow generating apparatus 61 is enclosed in a casing 68 having chambers 62*a* and 62*b*. The chambers 62*a* and 62*b* are composed of the casing 68 and a wall 69 disposed therein. In the chambers 62*a* and 62*b*, vibrating mechanisms 65*a* and 65*b* are disposed, respectively. The vibrating mechanisms 65*a* and 65*b* each have the same structure as the vibrating mechanisms such as the vibrating mechanism 5 and so forth shown in FIG. 2. The casing 68 has nozzles 63*a* and 63*b* that pass through the inside of the chambers 62*a* and 62*b*, respectively. Air is discharged from the chambers 62*a* and 62*b* through the nozzles 63*a* and 63*b*, respectively. The vibrating mechanisms 65*a* and 65*b* are disposed so that they close opening portions 66*a* and 66*b*, respectively, formed in the wall 69. The vibrating mechanism 65*b* vibrates air in the chamber 62*a*. As a result, air is discharged from the nozzle 63*a*. The vibrating mechanism 65*a* vibrates air in the chamber 62*b*. As a result, air is discharged from the nozzle 63*b*. The vibrating mechanisms 65*a* and 65*b* are connected to a control unit (not shown) that is the same as the control unit 10 shown in FIG. 2. The control unit controls the vibrating mechanisms 65*a* and 65*b* so that the phases of the vibrations of the vibrating mechanisms 65*a* and 65*b* are inverted and the amplitudes of the vibrations thereof are the same.

The vibrating mechanisms 65*a* and 65*b* are disposed so that their vibration directions R are the same and their orientations are opposite. Thus, even if the vibrating mechanisms 65*a* and 65*b* are vibrating mechanisms or vibration plates that are asymmetrical like speakers, they can secure overall symmetry. Thus, the vibrating mechanisms 65*a* and 65*b* allow the wave forms of the sound waves generated by the nozzles 63*a* and 63*b* to become the same as much as possible. As a result, the quietness of the apparatus can be improved.

When the jet flow generating apparatus 21 shown in FIG. 12 is operated, since phases of harmonics as distortion components deviate, there is a possibility in which the offset effect of sounds waves generated in chambers 22*a* and 22*b* deteriorates.

However, when a vibrating mechanism (not shown) is symmetrical with respect to a plane perpendicular to the vibration direction R, even if one vibrating mechanism is used, the noise can be decreased. In this case, it is preferred that the material, size, shape, volume, and size or shape of opening portions (nozzles) of one chamber formed on the front side of the vibration plate should be the same as those of the other chamber formed on the rear side thereof. Thus, the sound waves generated in these chambers are inverted. In reality, as a vibrating mechanism symmetrical with respect to a plane perpendicular to the vibration direction R, a structure in which a first coil and a second coil are disposed on a first plane (for example, the front surface) of a proper flat member and a second plane (for example, the rear surface) thereof almost in parallel with the first plane, respectively, can be used. As the first coil and the second coil, for example, planar coils can be used. As the flat member, a soft resin or a rubber member can be used. In addition, a first magnet and a second magnet are disposed on the first plane and the second plane on which the first coil and the second coil are disposed, respectively. When a drive voltage is applied to the coils, the vibrating member can vibrate. The vibrating member can be disposed, for example, at the center of the chamber shown in FIG. 12. In addition, the first magnet and the second magnet can be disposed at the trough portion and the ceiling portion of the casing 22. Alternatively, the planar coils may be disposed on one of the first plane and second plane of the flat member.

Figure 19:
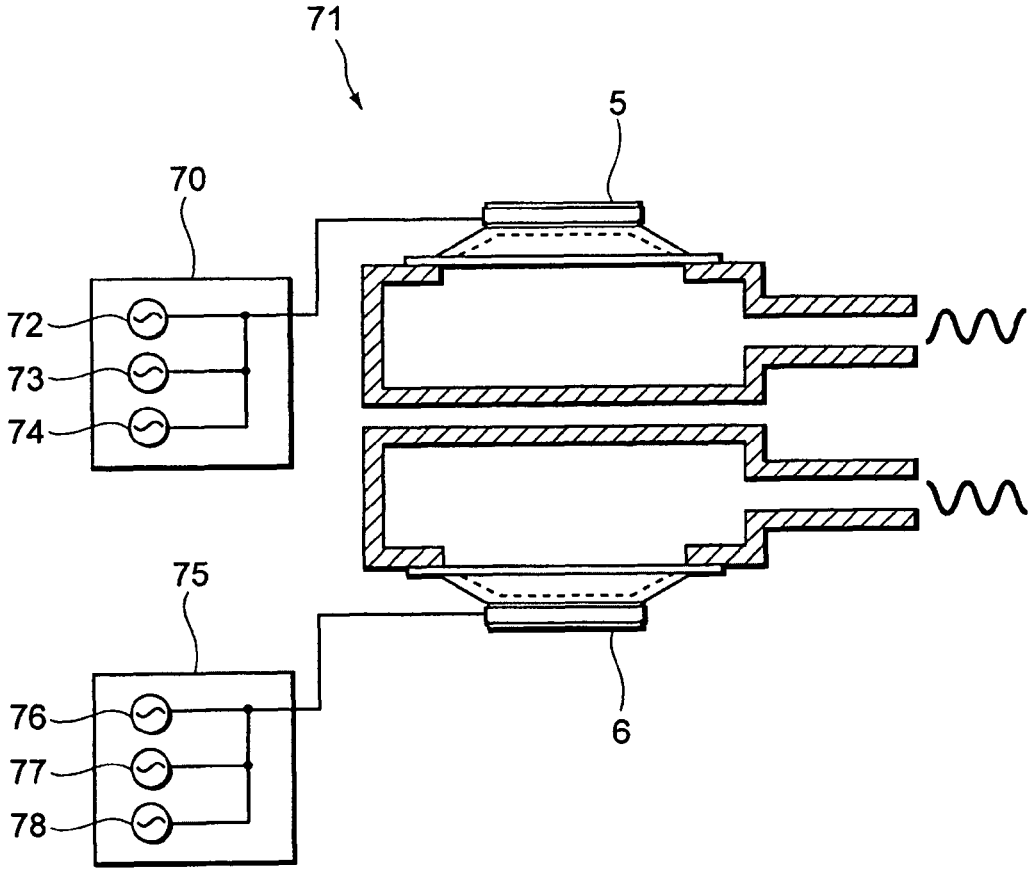
FIG. 19 is a schematic diagram showing a jet flow generating apparatus according to another embodiment.

FIG. 19 is a schematic diagram showing a jet flow generating apparatus according to another embodiment of the present invention. In FIG. 19, members, functions, and so forth similar to those shown in FIG. 1 and FIG. 2 will be briefly described or their description will be omitted.

The jet flow generating apparatus according to this embodiment is denoted by reference numeral 71. The jet flow generating apparatus 71 has a vibration control unit 70. The vibration control unit 70 controls a vibrating mechanism 5. The vibration control unit 70 has drive signal sources 72, 73, and 74 that output drive signals having different frequencies to the vibrating mechanism 5.

The jet flow also has a vibration control unit 75. The vibration control unit 75 controls a vibrating mechanism 6. The vibration control unit 75 has drive signal sources 76, 77, and 78 that output drive signals having different frequencies to the vibrating mechanism 6. The drive signal sources 72 and 76 generate signals having the same basic frequency.

The drive signal sources 73 and 74 generate drive signals so that harmonic components of the vibrating mechanism 5 do not vibrate. The drive signals cause the vibrating mechanisms such as the vibrating mechanism 5 and so forth to generate harmonics whose phases are inversed and whose amplitudes and frequencies are the same. Likewise, the drive signal sources 77 and 78 generate drive signals so that harmonic components of the vibrating mechanism 6 do not vibrate.

In this structure, since the phase differences and amplitudes of the signals generated by, for example, the drive signal sources 72 and 76 are controlled (so that, for example, the signals have the same amplitude and phases shifted by 180°), the vibrations of the base frequency weaken each other. The drive signal sources such as the drive signal sources 73 and 77 generate drive signals so that the vibrating mechanisms 5 and 6 do not vibrate harmonic components. In other words, the sound waves of basic frequency components weaken each other. In addition, since the harmonic components are not generated, the noise of the apparatus can be decreased.

In addition, the structure shown in FIG. 19 and the structure shown in FIG. 12 can be combined. In other words, a jet flow generating apparatus having one vibration plate, two chambers, and the vibration control unit 70 connected to one vibration plate shown in FIG. 19 allows the sound waves of basic frequency components to weaken each other and harmonic components not to be generated. Thus, the noise of the apparatus can be decreased.

Figures 20, 21:
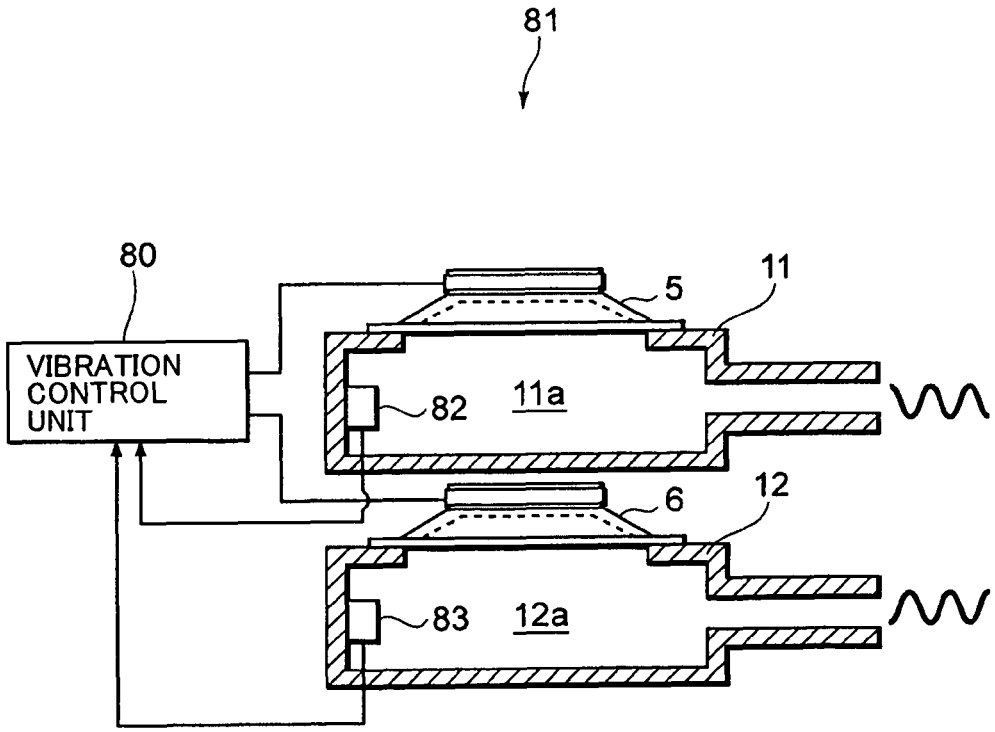
FIG. 20 is a table showing an example in the case that a signal of a vibration control unit is adjusted at a basic frequency of 100 (Hz) so that distortion components as harmonic components are decreased.
FIG. 21 is a schematic diagram showing a jet flow generating apparatus according to another embodiment.

FIG. 20 shows an example in which a signal of the vibration control unit 70 is adjusted so as to decrease distortion components as harmonic components in the case that the basic frequency is 100 (Hz). In the example, signals of 200 (Hz) and 300 (Hz) are superimposed with a signal of a basic frequency of 100 (Hz). As a result, a second harmonic (200 (Hz)) and a third harmonic (300 (Hz)) are decreased.

FIG. 21 is a schematic diagram showing a jet flow generating apparatus according to another embodiment of the present invention. The jet flow generating apparatus according to this embodiment is denoted by reference numeral 81. The jet flow generating apparatus 81 has chambers 11*a* and 12*a*. In the chambers 11*a* and 12*a*, microphones 82 and 83 that detect the states (amplitudes, phases, and so forth) of the sound waves generated by vibrating mechanisms 5 and 6 are disposed, respectively. The detected states are fed back as signals to a vibration control unit 80. The vibration control unit 80 controls the vibrations of the vibrating mechanisms 5 and 6 so that the sound waves generated thereby weaken each other.

According to the embodiment, even if vibration characteristics vary because of the aged tolerance of the vibrating mechanisms 5 or 6, the noise of the apparatus can be decreased. Since the microphones 82 and 83 are disposed in the chambers 11*a* and 12*a*, respectively, the microphones 82 and 83 can detect the sound waves of the respective chambers without interference of the sound waves of the other chambers. Thus, the vibrations of the vibrating mechanisms 5 and 6 can be accurately controlled.

The jet flow generating apparatuses 1, 21, 41, 61, 71, and 81 according to the foregoing embodiments are used to discharge air to a heat generating member and cool it. However, the present invention is not limited to do that. For example, the jet flow generating apparatuses 1, 21, 41, 61, 71, and 81 can be used for means for supplying a fuel of a fuel cell. In reality, in this case, an oxygen (air) intake opening of the fuel cell is disposed so that the oxygen intake opening faces a nozzle (opening portion) of a chamber of the jet flow generating apparatus according to each of the foregoing embodiments. In this structure, the jet air discharged from the jet flow generating apparatus is sucked as an oxygen fuel from the intake opening. Thus, while the overall apparatus is more thinly structured than the case that a fuel is supplied with an axial flow fan, the same power generation efficiency as the case that the axial flow fan is used can be obtained.

Figure 22:
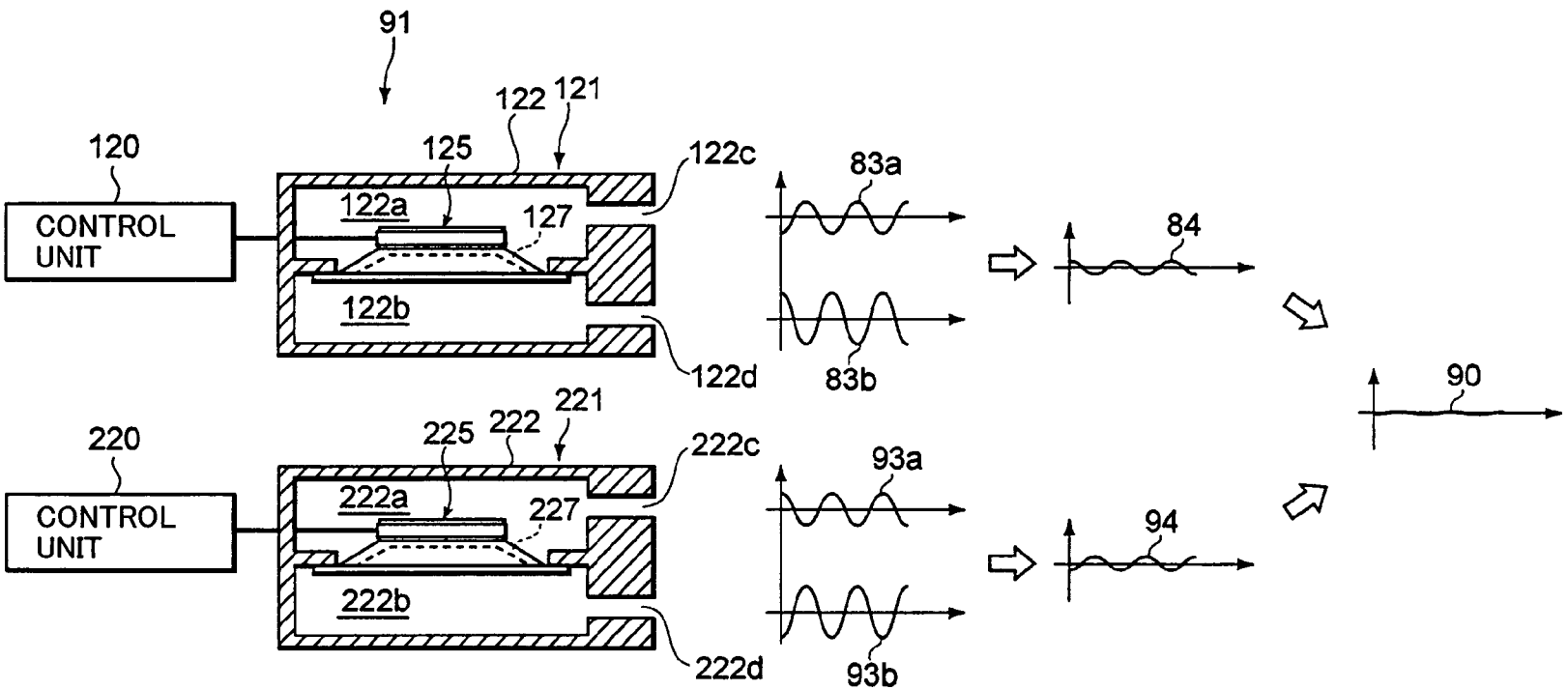
FIG. 22 is a sectional view showing a jet flow generating apparatus according to another embodiment.

FIG. 22 is a sectional view showing a jet flow generating apparatus according to another embodiment of the present invention.

The jet flow generating apparatus according to this embodiment is denoted by reference numeral 91. The jet flow generating apparatus 91 has two jet flow generating apparatuses shown in FIG. 12. These jet flow generating apparatuses are denoted by reference numerals 121 and 221. The jet flow generating apparatuses 121 and 221 are substantially the same. Controlling portions 120 and 220 control vibration plates 127 and 227 so that their vibrations have almost the same amplitude, the same frequency, and inverted phases. In other words, while the vibration plate 127 of the vibrating mechanism 125 moves in the direction in which the inner pressure of a chamber 122*b* increases (in the lower direction shown in the drawing), the vibration plate 227 of the vibrating mechanism 225 moves in the direction in which the inner pressure of a chamber 222*b* decreases (in the upper direction shown in the drawing). In addition, while the vibration plate 127 moves in the direction in which the inner pressure of a chamber 122*a* increases (in the upper direction shown in the drawing), the vibration plate 227 moves of the vibrating mechanism 225 in the direction in which the inner pressure of a chamber 222*a* decreases (in the lower direction shown in the drawing).

The speaker type vibrating mechanisms such as the vibrating mechanism 125 and so forth are asymmetrical with respect to the vibration direction of the vibration plate 127. In addition, the voice coil portion and yoke portion are asymmetrical with respect to the vibration direction. The pressure difference of the chamber 122*b* owning to the vibration of the vibration plate 127 is larger than the pressure difference of the chamber 122*a*. Wave forms of the sound pressures generated by the openings 122*c*, 122*d*, 222*c*, and 222*d* are denoted by reference numerals 83*a*, 83*b*, 93*a*, and 93*b*, respectively. The amplitudes of these sound waves have the relation of wave form 83*b*>wave form 83*a* and wave form 93*b*>wave form 93*a*. When the wave forms 83*a* and 83*b* are combined, a combined wave form 84 (first combined wave form) is generated. Likewise, when the wave forms 93*a* and 93*b* are combined, a combined wave form 94 (second combined wave form) is generated. Since the control units 120 and 220 control the vibrations in inversed phases, the first combined wave form 84 and the second combined wave form 94 weaken each other. Finally, a flat wave form 90 is generated.

The first combined wave form 84 weakened in the chambers 122*a* and 122*b* and the second combined wave form 94 weakened in the chambers 222*a* and 222*b* are combined and weakened. Thus, the noise of the apparatus can be further decreased.

Figure 23:
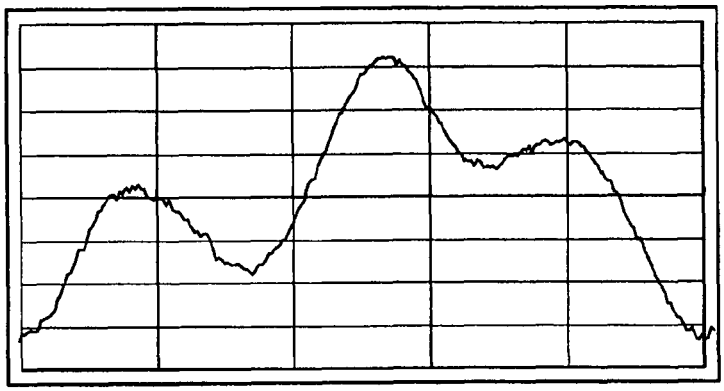
FIG. 23 is a schematic diagram showing a sound wave in the case that one jet flow generating apparatus shown in FIG. 22 is used at a drive frequency of 200 (Hz).
Figure 24:
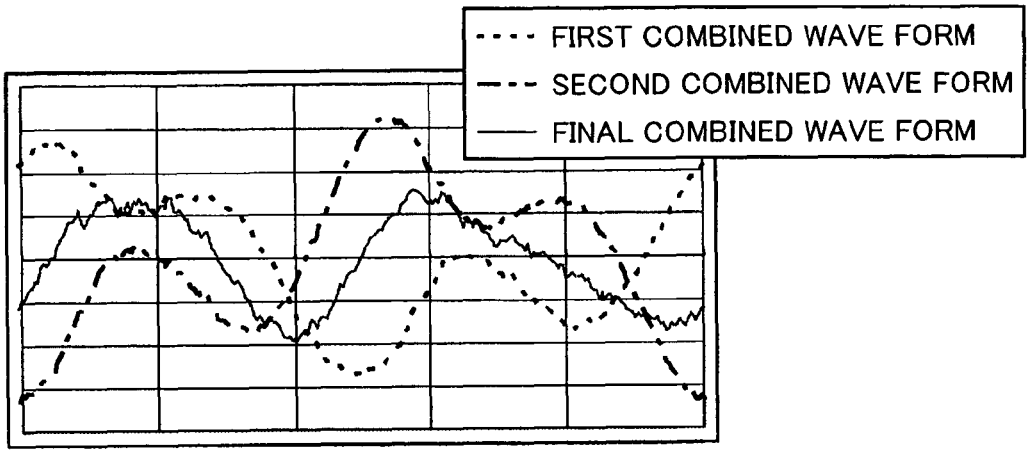
FIG. 24 is a schematic diagram showing a first combined wave form and a second combined wave form generated by two jet flow generating apparatuses shown in FIG. 22 and their combined wave form.

FIG. 23 and FIG. 24 show a result of an experiment about the embodiment. FIG. 23 shows a wave form of a sound pressure in the case that only the jet flow generating apparatus 121 of the jet flow generating apparatus 91 is used and that the drive frequency is 200 (Hz). In other words, FIG. 23 shows the first combined wave form. As is clear from FIG. 23, since the vibrating mechanism 125 is asymmetrical, the sound wave is not perfectly flat.

FIG. 24 shows the first combined wave form 84, the second combined wave form 94, and the final combined wave form 90 generated by the jet flow generating apparatuses 121 and 221. The drive frequencies of these signals are 200 (Hz) and the phase difference is 170°. As shown in FIG. 24, the combined wave forms weaken each other. The sound pressure of the final combined wave form is around ½ of that of each combined wave form. In FIG. 23 and FIG. 24, since the levels and relative phases of sound pressures generated by the jet flow generating apparatuses 121 and 222 are considered, the present invention is not limited to the unit of the graph and scale values shown in FIG. 23 and FIG. 24.

Figure 25:
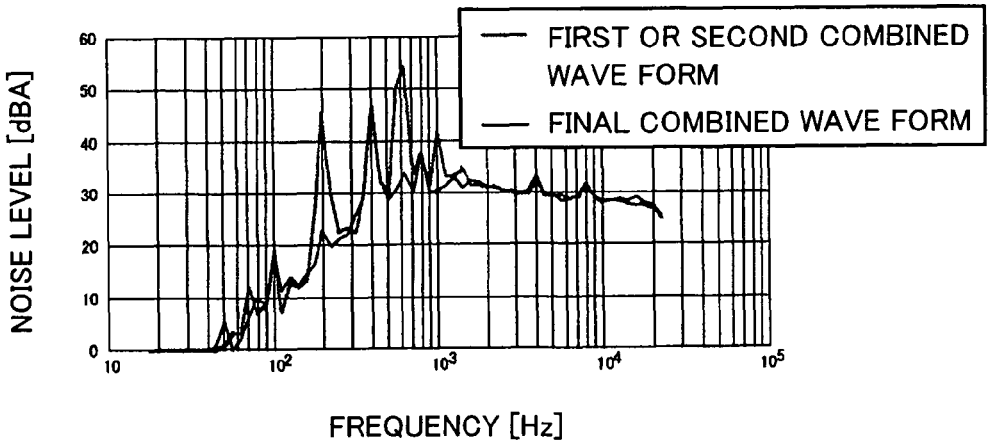
FIG. 25 is a schematic diagram showing a noise spectrum.

FIG. 25 shows a noise spectrum of the experiment. As shown in the graph, it is clear that noise is decreased by around 20 (dB) at frequencies 200 (Hz) and 600 (Hz).

According to the embodiment, when the distance between two openings that are the most spaced apart satisfies the foregoing formula (2) or formula (4), there is no portion in which the first combined wave form and the second combined wave form strengthen each other. In other words, the distance between the opening 122*c* of the chamber 122*a* and the opening 222*d* of the chamber 222*b* needs to satisfy the foregoing formula (2) or formula (4).

Although the structure of the jet flow generating apparatus 121 is the same as the structure of the jet flow generating apparatus 221, their structures may be different. When the structures of the two apparatuses are different, the phases, amplitudes, and so forth need to be controlled so that the final combined wave form weakens.

The jet flow generating apparatus 91 according to the embodiment has two casings (121 and 221). Alternatively, the jet flow generating apparatus 91 may have three or more casings.

The foregoing description does not mention the number of openings formed in the chambers such as the chamber 122*a* and so forth. However, many openings may be formed.

In the foregoing description, the phase difference is 170°. However, the present invention is not limited to the value. The phase difference can be a value with which the noise levels of the combined wave forms decrease. For example, when the phase difference of the sound waves is other than 170°, the drive frequencies thereof can be controlled so as to decrease the noise.

In addition to the jet flow generating apparatuses 121 and 221, another sound wave generating means, for example, a speaker (not shown), may be disposed. When the sound pressure and phase of the sound wave generating means are adjusted, the noise level can be decreased. For example, when a sound wave that has an inverted phase of the final combined wave form shown in FIG. 24 is generated by the speaker unit, the noise level of the combined wave can be further decreased.

In the foregoing description, the vibration plates such as the vibration plate 127 and so forth are driven with sine waves. Alternatively, the vibration plates such as the vibration plate 127 and so forth may be driven with signals of which the sound waves generated by the vibration plates such as the vibration plate 127 and so forth do not contain harmonic components. In this case, since there are no harmonic components in the sound waves generated by the jet flow generating apparatuses 121 and 221, the noise decreasing effect is further improved. That means that the peak in the noise level at 400 (Hz) shown in FIG. 25 disappears.

Figure 26:
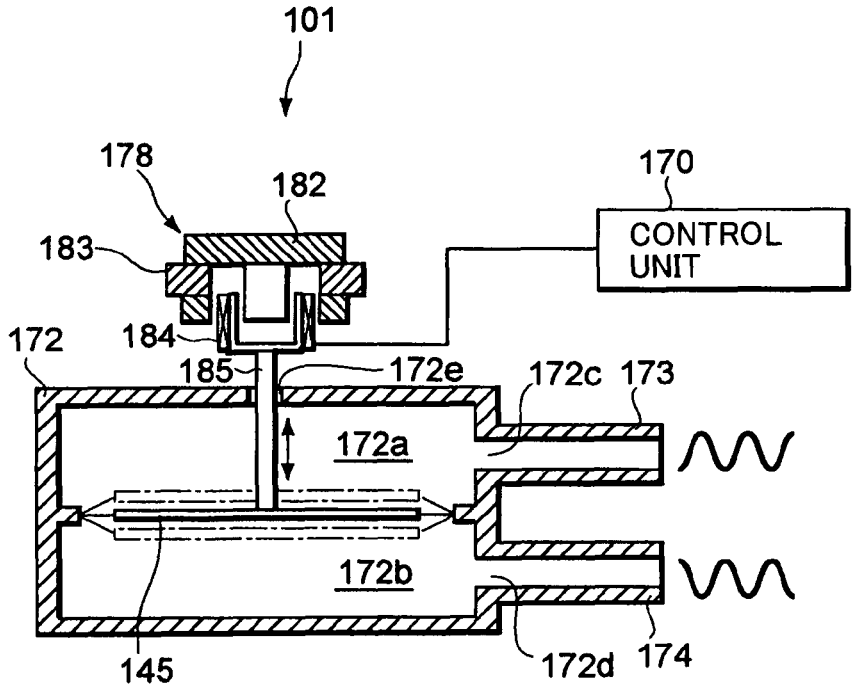
FIG. 26 is a sectional view showing a jet flow generating apparatus according to another embodiment of the present invention.

FIG. 26 is a sectional view showing a jet flow generating apparatus according to another embodiment of the present invention. The jet flow generating apparatus according to this embodiment is denoted by reference numeral 101. The jet flow generating apparatus 101 has a casing 172. The casing 172 has chambers 172*a* and 172*b* partitioned by a vibration plate 145. An actuator 178 that vibrates the vibration plate 145 is disposed outside the casing 172. A rod 185 of the actuator 178 is connected to the vibration plate 145. The actuator 178 moves the vibration plate 145. The rod 185 passes through a through-hole 172*e* formed in the casing 172. The actuator 178 has a yoke 182, a magnet 183, a coil 184, and so forth. A control unit 170 applies for example, an AC voltage to the coil. As a result, the coil causes the rod 185 to move in the upper and lower directions shown in the drawing. Consequently, the vibration plate 145 vibrates. When the vibration plate 145 vibrates, nozzles 173 and 174 alternately generate a jet flow. In addition, the nozzles 173 and 174 generate the sound wave having inverted phases. The sound waves weaken each other.

According to the embodiment, since the actuator 178 is disposed outside the casing 172, the volumes of the chambers 172*a* and 172*b* can be almost the same. If the actuator 178 were disposed inside the casing 172, heat of the actuator 178 would remain in the chamber 172*a* or 172*b*. If the vibration plate 145 were vibrated in this state, a heated air stream would be discharged. As a result, the heat radiation capacity would deteriorate. However, according to the embodiment, the disadvantage can be solved.

Figure 27:
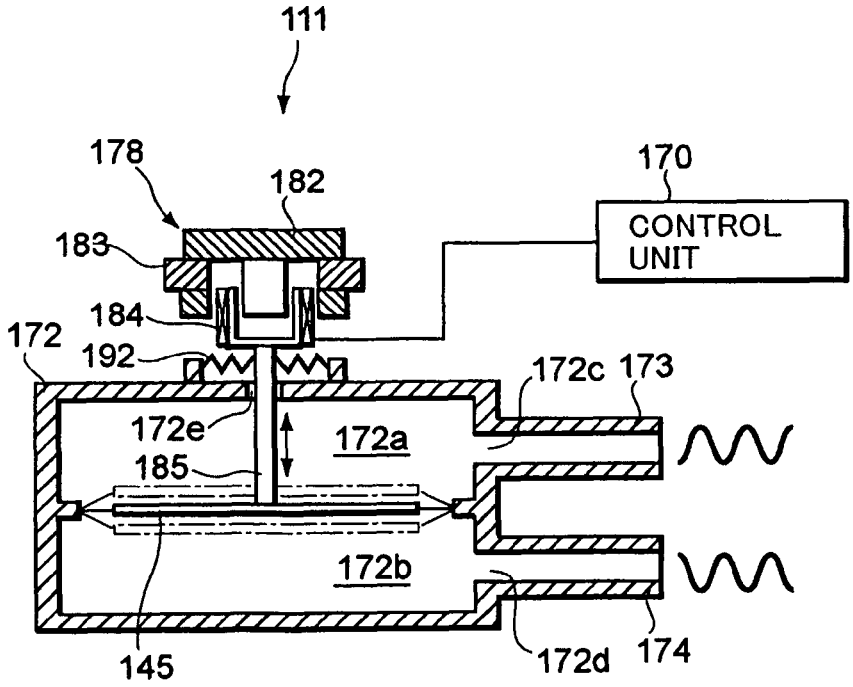
FIG. 27 is a sectional view showing a jet flow generating apparatus according to a modification of the embodiment shown in FIG. 26.
Figure 28:
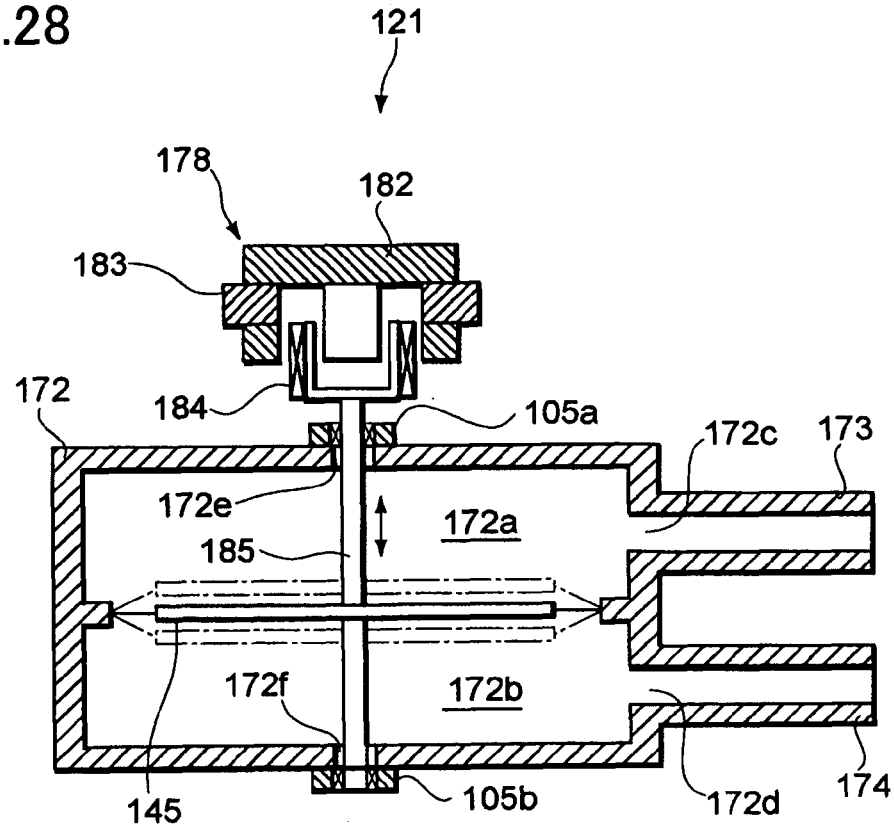
FIG. 28 is a sectional view showing a jet flow generating apparatus according to another modification of the embodiment shown in FIG. 26.
Figure 29:
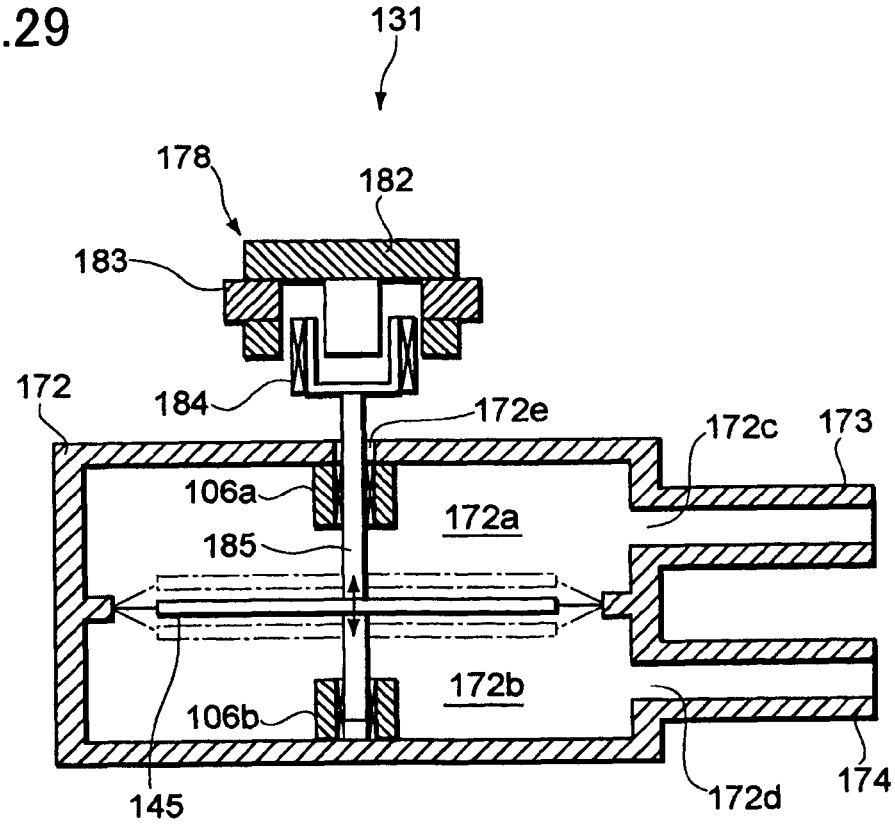
FIG. 29 is a sectional view showing a jet flow generating apparatus according to another modification of the embodiment shown in FIG. 26.

FIG. 27 is a sectional view showing a jet flow generating apparatus according to a modification of the embodiment shown in FIG. 26. In FIG. 27 to FIG. 29, members, functions, and so forth similar to those shown in FIG. 26 will be briefly described or their description will be omitted.

The jet flow generating apparatus according to this modification is denoted by reference numeral 111. The jet flow generating apparatus 111 has an absorption member 192 that absorbs a lateral vibration of a rod 185. The absorption member 192 is composed of, for example, a bellows member. Alternatively, the absorption member 192 may be composed of flexible resin or rubber. The absorption member 192 can suppress the lateral vibration of the rod 175 against the vibration of the vibration plate 145. As a result, the vibration plate 145 can be stably vibrated. If the rod 185 laterally vibrated, a coil 184 would contact a yoke 182 and so forth. As a result, a rubbing sound would generate. In contrast, according to the modification, such a rubbing sound does not generate. If a lateral vibration takes place, the vibration of another mode that is different from the basic vibration wave tends to generate. As a result, harmonics generate. Since the harmonics have to be suppressed as described above, it is meaningful to prevent the rod 175 from laterally vibrating.

In addition, according to the embodiment, the absorption member 192 seals a through-hole 172*c* formed in the casing 172 so as to keep the casing 172 airtight. Thus, when the vibration plate 145 vibrates, the absorption member 192 can prevent air from leaking from the casing 172 through the through-hole 172*e*. In other words, the absorption member 192 also functions as a seal member. Thus, coolant can be effectively discharged from the chambers 172*a* and 172*b*.

Instead of the solid seal member 192, a viscous fluid seal member that seals the through-hole 172*e* may be disposed.

FIG. 28 is a sectional view showing a jet flow generating apparatus according to another modification of the embodiment shown in FIG. 26. The jet flow generating apparatus according to this modification is denoted by reference numeral 121. The jet flow generating apparatus 121 has a casing 172. On the casing 172, bearings 105*a* and 105*b* for a rod 108 are mounted. The bearings such as the bearing 105*a* and so forth are composed of, for example, linear ball bearings, fluid bearings, or the like. The rod 185 passes through a vibration plate 145. In addition, the rod 185 passes through a through-hole 172*f* formed in a chamber 172*b* side opposite to a through-hole 172*e*. The bearings 105*a* and 105*b* are disposed in the vicinity of the through-holes 172*e* and 172*f*, respectively. This structure using both the bearings 105*a* and 105*b* can more suppress the lateral vibration of the rod 185 than the structure using only the bearing 105*a*. As a result, the rod 185 can be stably moved. Thus, the vibration plate 145 can be effectively vibrated. In addition, since the rod 185 extends from one side to the other side of the casing 172, the volumes, shapes, or the like of the chambers 172*a* and 172*b* can become the same. Thus, the noise of the apparatus can be further decreased.

When the bearing 105*a* or 105*b* is a solid bearing, the solid bearing 105*a* may be filled with a liquid. In this case, the casing 172 can be air-tightly sealed against a gap between the rod 185 and the bearing 105*a* or bearing 105*b*.

FIG. 29 is a sectional view showing a jet flow generating apparatus according to another modification of the embodiment shown in FIG. 26. The jet flow generating apparatus according to the modification is denoted by reference numeral 131. The jet flow generating apparatus 131 has chambers 172*a* and 172*b*. In the chambers 172*a* and 172*b*, bearings 106*a* and 106*b* for a rod 185 are mounted. Unlike the jet flow generating apparatus 121 shown in FIG. 28, the jet flow generating apparatus 131 does not have a through-hole 172*f* at the lower portion of the casing. The jet flow generating apparatus 131 can have the same operation and effect as the jet flow generating apparatus 121.

In FIG. 26 and FIG. 27 to FIG. 29, a seal member may be disposed in the through-holes such as the through-hole 172*e* and so forth of the casing 172 through which the rod 185 passes. Thus, since the inner air-tightness of the casing is improved, coolant can be effectively discharged.

Figure 30:
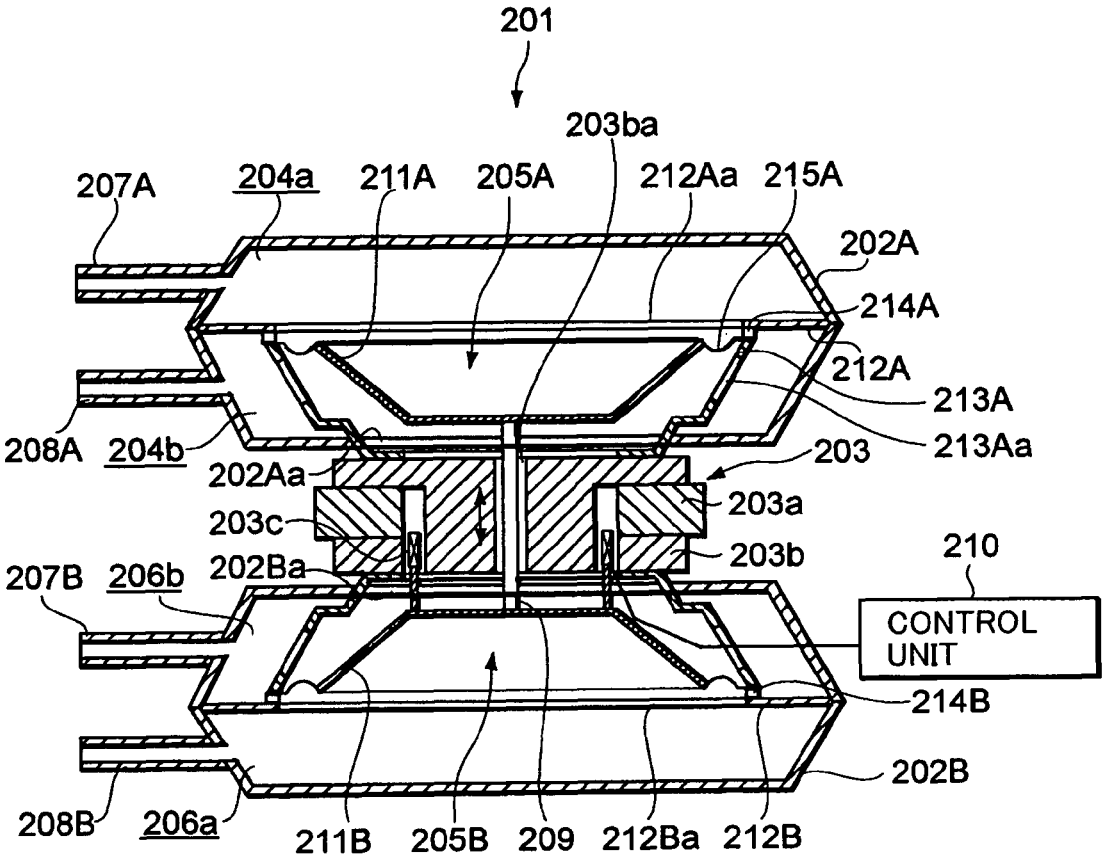
FIG. 30 is a sectional view showing a jet flow generating apparatus according to another embodiment of the present invention.

FIG. 30 is a sectional view showing a jet flow generating apparatus according to another embodiment of the present invention. The jet flow generating apparatus according to this embodiment is denoted by reference numeral 201. The jet flow generating apparatus 201 has an upper casing 202A and a lower casing 202B. The upper casing 202A forms the contours of chambers 204*a* and 204*b*. The lower casing 202B forms the contours of chambers 206*a* and 206*b*. The casing 202A and the casing 202B have almost the same shape, size, and so forth. Nozzles 207A, 208A, 207B, and 208B protrude from the chambers 204*a*, 204*b*, 206*a*, and 206*b*, respectively, in the casings 202A and 202B. Speaker type vibration generating devices 205A and 205B are disposed in the upper casing 202A and the lower casing 202B, respectively. An actuator 203 that is a driving unit for both the vibration generating devices 205A and 205B is disposed between the upper casing 202A and the lower casing 202B. The actuator 203 is composed of a magnet 203*a*, a yoke 203*b*, a coil 203*c*, and so forth. A control unit 210 that controls the vibrations of the vibration generating devices 205A and 205B is electrically connected to the coil 203*c*.

The vibration generating device 205A has a frame 213A and a vibration plate 211A mounted thereon through an edge member 215A. A frame 213A is fitted to a through-hole 202Aa formed at a lower portion of the upper casing 202A. An air hole portion 213Aa is formed in the frame 213A. The edge member 215A has flexibility or elasticity. The edge member 215A is made of, for example, resin or rubber. A partition member 212A is disposed in the upper casing 202A. The partition member 212A forms the chambers 204*a* and 204*b*. A hole 212Aa is formed at the center of the partition member 212A. The frame 213A of the vibration generating device 205A is mounted on the partition member 212A through a vibration absorption member 214A so that the frame 213A covers the hole 212Aa.

The lower vibration generating device 205B has almost the same structure as the upper vibration generating device 205A. They differ in that the coil 203*c* is mounted on a vibration plate 2111B. Like the vibration generating device 205A, the vibration generating device 205B is disposed above the hole 212Ba of the partition member 212B so that the vibration generating device 205B covers the hole 212Ba.

A rod 209 passes through a through-hole 203*ba* of the yoke 203*b*. In addition, the rod 209 passes through the through-holes 202Aa and 202Ba. The rod 209 is connected to the vibration plate 211A and the vibration plate 211B. This structure causes the two vibration plate 211A and 211B to integrally vibrate.

The upper casing 202A is formed so that the volume of the chamber 204*a* is almost the same as the volume of the chamber 204*b*. In reality, the upper casing 202A is formed so that the height of the lower chamber 204*b* is larger than that of the upper chamber 204*a* by the volume of the vibration generating device 205A. The lower casing 202B has the same structure as the upper casing 202A.

Next, the operation of the jet flow generating apparatus 201 having the foregoing structure will be described. When the control unit 210 applies an AC voltage to the coil 203*c*, the rod 209 moves in the upper and lower directions shown in the drawing. As a result, the vibration plates 211 and 211B vibrates in the upper and lower directions. When the vibration plates 211A and 211B move in the upper direction shown in the drawing, the inner pressures of the chambers 204*a* and 206*b* increase. As a result, air is discharged from nozzles 208A and 208B. Since the phases of the sound waves (in particular, sound waves of basic frequency) generated by the nozzles 207A and 208A are inverted, the sound waves weaken each other. Likewise, since the phases of the sound waves (in particular, sound waves of basic frequency) generated by the nozzles 207B and 208B are inverted, the sound waves weaken each other.

According to the embodiment, the noise of the apparatus can be decreased. In addition, since one actuator 203 and four chambers are disposed, the discharge amount of air can be increased with a small electric power and the cooling efficiency can be improved.

In addition, according to the embodiment, since two edge members 215A and 215B are disposed, lateral vibrations of the vibration plates 211A and 211B, the rod 209, and so forth become weak. FIG. 30 shows a jet flow generating apparatus using a conventional speaker 235. The speaker 235 has a frame 213, a vibration plate 211, an edge member 215, and a dumper 236. The edge member 215 and the dumper 236 are disposed between the frame 213 and the vibration plate 211. In contrast, the jet flow generating apparatus 201 does not need the dumper 236. Although the dumper 236 is effective to prevent the apparatus from laterally vibrating, since the vibration plate becomes a resistance against the vibration of the vibration plate, it consumes an extra power. Thus, when the dumper 236 is not required, the vibration plates such as the vibration plate 211A and so forth can be vibrated with a low power consumption. When the same power as the case that the dumper 236 is used is supplied, since the amplitude of the vibration plate can be increased, the cooling efficiency is improved.

Figure 31:
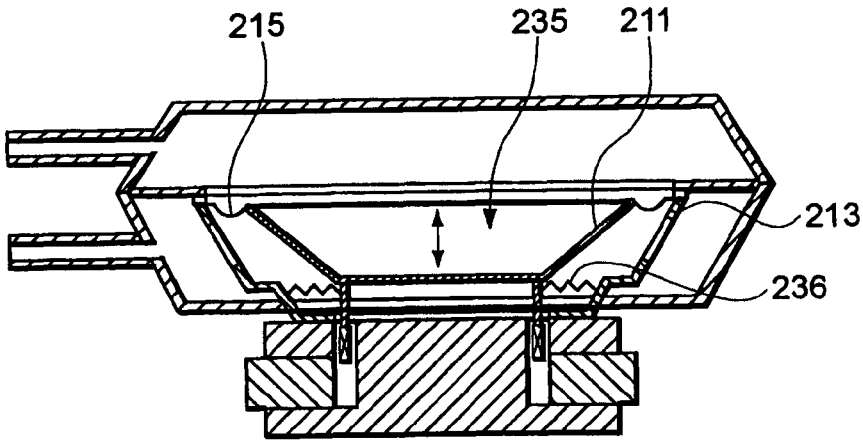
FIG. 31 is a sectional view showing a jet flow generating apparatus having one speaker.

A power of 2 (W) was applied to the speaker 235 shown in FIG. 31 and the vibration generating devices such as the vibration generating device 205A and so forth shown in FIG. 30 and their displacements were measured. In the speaker 235 and the vibration generating devices, the same magnets and same yokes having the same size as the magnets were used. The size of the vibration plate 211A was the same as the size of the size of the vibration plate 211B. The diameter and weight of each of the vibration plates 211A and 211B were around 70 (mm) and 300 (g), respectively. In this condition, the amplitude of the vibration plate 211 shown in FIG. 31 was 1.32 (mm) (vibration amount was 1.32×2=2.64 (mm)). On the other hand, in the structure shown in FIG. 31, the amplitude of the vibration plate 211A was 2.26 (mm), which was twice as large as the case that the structure shown in FIG. 31 was used with the same power. In addition, since the structure shown in FIG. 30 has two vibration plates, the efficiency thereof is doubled.

In addition, according to the embodiment, since the jet flow generating apparatus 201 has one actuator 203, the apparatus can be miniaturized.

Figure 32:
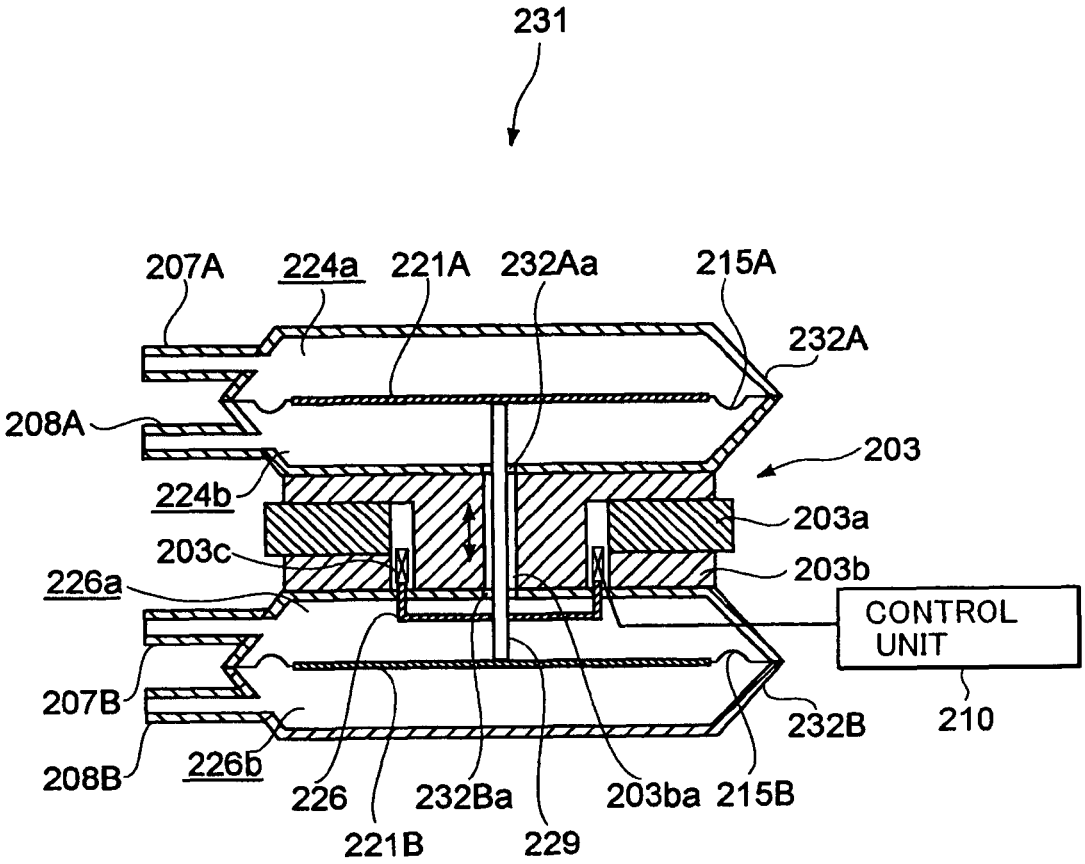
FIG. 32 is a schematic diagram showing a jet flow generating apparatus according to a modification of the embodiment shown in FIG. 30.

FIG. 32 shows a jet flow generating apparatus according to a modification of the embodiment (jet flow generating apparatus 201) shown in FIG. 30. The jet flow generating apparatus according to this modification is denoted by reference numeral 231. In FIG. 32 to FIG. 38, members, functions, and so forth similar to those shown in FIG. 30 will be briefly described or their description will be omitted.

A flat vibration plate 221A is mounted on an upper casing 232A of the jet flow generating apparatus 231 through an edge portion 215A. Likewise, a flat vibration plate 221B is mounted on a lower casing 232B through an edge member 215B. A coil 203*c* is mounted on a mounting member 226. The mounting member 226 and a rod 229 are connected. The rod 229 is connected to the vibration plates 221A and 221B through through-holes 232Aa and 232Ba. Thus, as an actuator is driven, the rod 229 is moved. As a result, the vibration plates 221A and 221B integrally vibrate. Thus, since the symmetry of the jet flow generating apparatus 231 is more improved than that of the jet flow generating apparatus 201 shown in FIG. 30, the noise of the apparatus can be further decreased.

Figure 33:
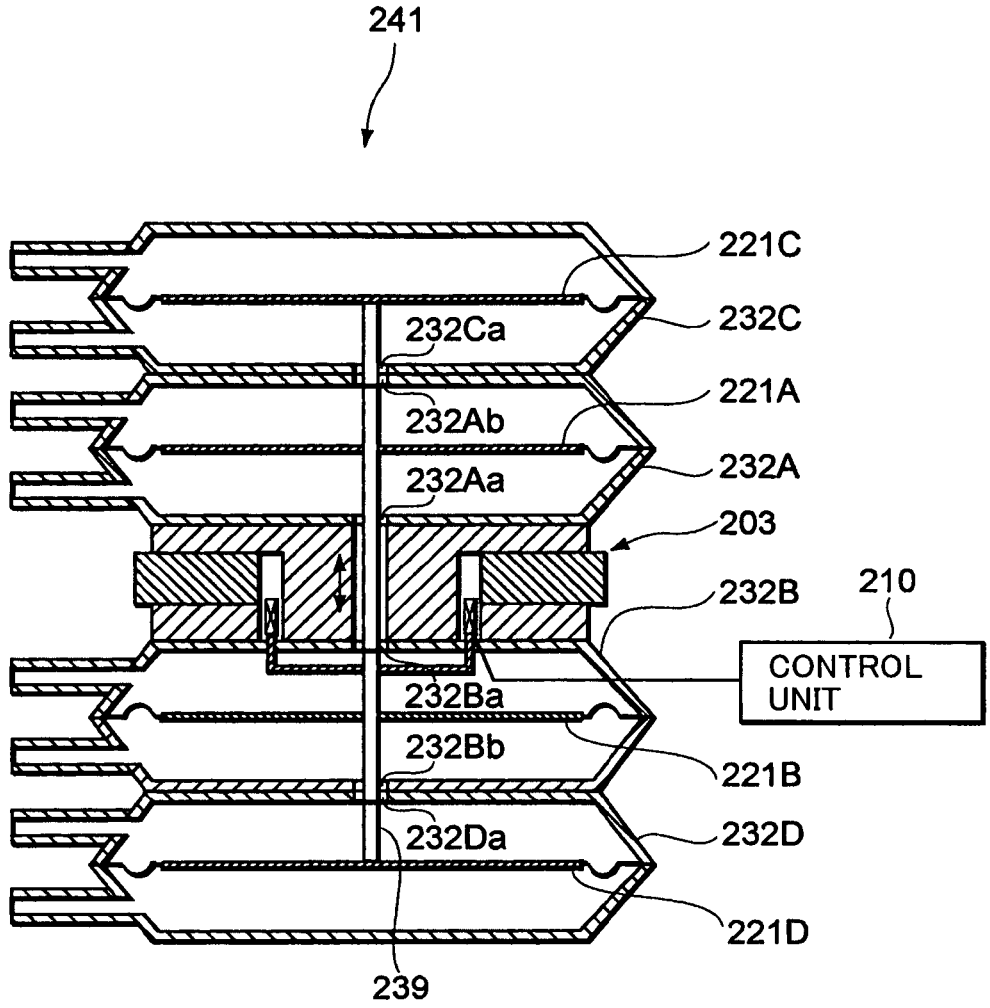
FIG. 33 is a schematic diagram showing a jet flow generating apparatus according to a modification of the embodiment shown in FIG. 32.

FIG. 33 shows a jet flow generating apparatus according to another modification against the modification (jet flow generating apparatus 201) shown in FIG. 32. The jet flow generating apparatus according to this modification is denoted by reference numeral 241. The jet flow generating apparatus 241 has four casings. A rod 229 is connected to a vibration plates 221A and 221B through through-holes 232Aa and 232Ba. In addition, the rod 239 passes through the vibration plates 221A and 221B. The rod 239 is connected to vibration plates 221C and 221D through through-holes 232Ab, 232Bb, 232Ca, and 232Da. Thus, since the four vibration plates 221A, 221B, 221C, and 221D are integrally vibrated, the discharge amount of coolant can be further increased. In addition, depending on the number of heat generating members to be cooled and their arrangement, the number of casings can be adjusted. In addition, while the discharge amount of coolant can be increased in proportion with the number of casings, only one actuator 203 is required. In addition, since the actuator 203 is disposed at the center of the casings 232A, 232B, 232C, and 232D, namely between the upper casings 232A and 232B, the symmetry of the apparatus is not deteriorated.

In the jet flow generating apparatus 231 shown in FIG. 32, the rod 229 may pass through the vibration plates 221A and 221B. In addition, as shown in FIG. 28 or FIG. 29, the bearings of the rod that passes through the vibration plates 221A and 221B may be disposed at an upper portion of the upper casing 232A and a lower portion of the lower casing 232B. This structure applies to the jet flow generating apparatus 241 shown in FIG. 33.

FIG. 34 to FIG. 37 are enlarged sectional views showing actuators according to modifications of the actuator 203 of the jet flow generating apparatuses 201, 231, and 241.

Figure 34:
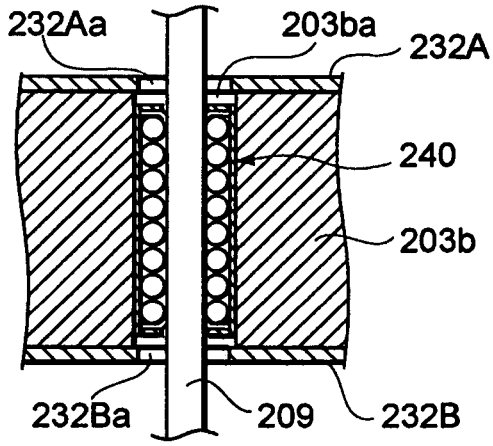
FIG. 34 is an enlarged sectional view showing an actuator according to a modification (No. 1).

As shown in FIG. 34, a bearing 240 of a rod 209 is disposed in a through-hole 203*ba* of a yoke 203*b*. As shown in the drawing, the bearing 240 is, for example, a ball bearing. The bearing 240 can prevent the rod 209 from laterally vibrating. The bearing may be a fluid bearing rather than the forgoing solid bearing. When a fluid bearing is used, the noise of the apparatus can be further decreased. In this case, fluid is preferably liquid. Fluid is more preferably magnetic fluid. Alternatively, viscous liquid may be contained in the bearing 240. The bearing 240 seals the inside of the upper casing 232A against the inside of the lower casing 232B. As a result, coolant can be effectively discharged from the upper casings 232A and 232B.

Figure 35:
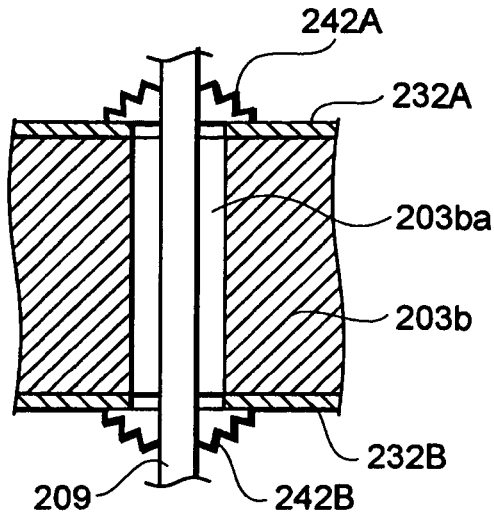
FIG. 35 is an enlarged sectional view showing an actuator according to another modification (No. 2).

In FIG. 35, a seal member 242A is disposed between an upper casing 232A and a rod 209, whereas a seal member 242B is disposed between a lower casing 232B and a rod 209. The seal members 242A and 242B are made of, for example, rubber, resin, or the like. The seal members 242A and 242B can seal the inside the upper casing 232A against the inside of the lower casing 232B. As a result, coolant can be effectively discharged from the casing 232A and 232B. In addition to the solid seal members 242A and 242B, a through-hole 203*ba* and so forth may be filled with a liquid seal member.

Figure 36:
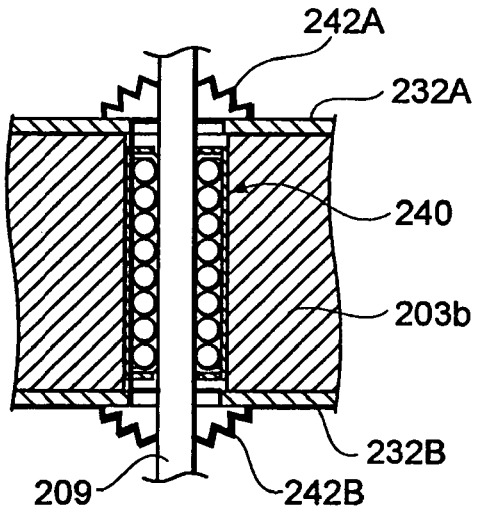
FIG. 36 is an enlarged sectional view showing an actuator according to another modification (No. 3).

FIG. 36 shows a combination of the structure shown in FIG. 34 and the structure shown in FIG. 35. The structure shown in FIG. 36 can prevent the rod 209 from laterally vibrating. In addition, the structure shown in FIG. 36 can seal the inside of an upper casing 232A against the inside of a lower casing 232B.

Figure 37:
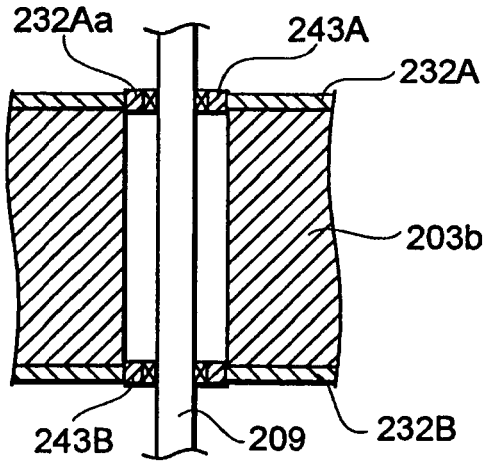
FIG. 37 is an enlarged sectional view showing an actuator according to another modification (No. 4).

FIG. 37 shows a structure in which bearings 243A and 243B are fitted to through-holes 232Aa and 232Ba of an upper casing 232A and a lower casing 232B, respectively. The bearings 243A and 243B are solid bearings or fluid bearings. In this structure, a rod 209 can be stably moved.

Figure 38:
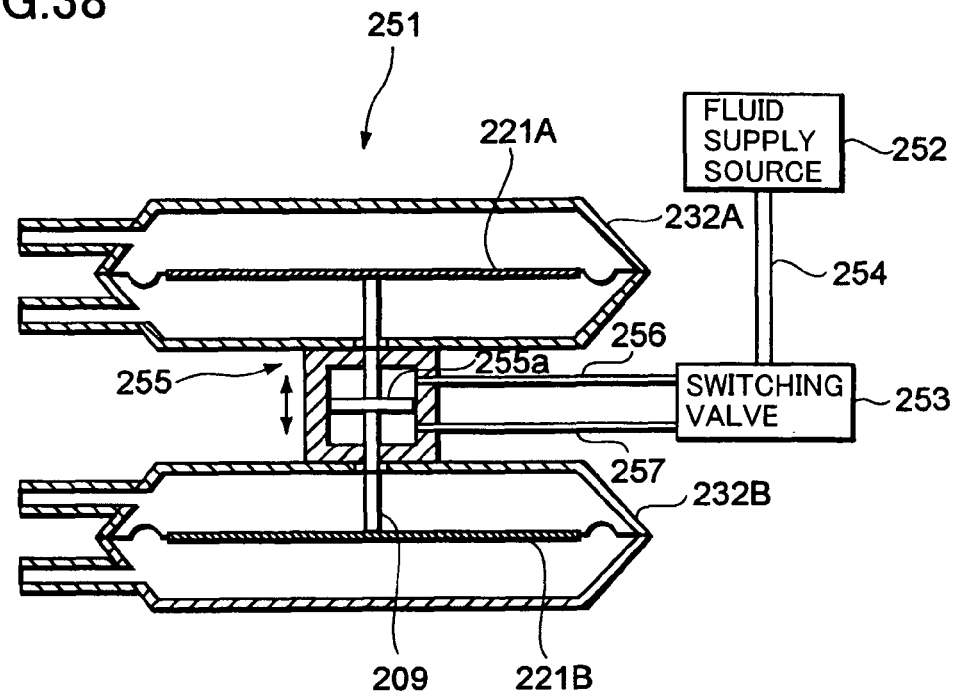
FIG. 38 is a schematic diagram showing a jet flow generating apparatus according to another modification of the embodiment shown in FIG. 32.

FIG. 38 shows a jet flow generating apparatus according to another modification of the modification (the jet flow generating apparatus 231) shown in FIG. 32. The jet flow generating apparatus according to this modification is denoted by reference numeral 251. The jet flow generating apparatus 251 uses a driving mechanism in which an actuator 255 drives a piston 255*a* with the pressure of fluid. The fluid is supplied from a fluid supply source 252 to the actuator 255 through a fluid pipe 254 or one of pipes 256 and 257 selected by a selection valve such as a solenoid valve or the like. The piston 255*a* is secured to a rod 209. This structure also allows vibration plates 221A and 221B to vibrate. The fluid may be any of solid and gas.

Figure 39:
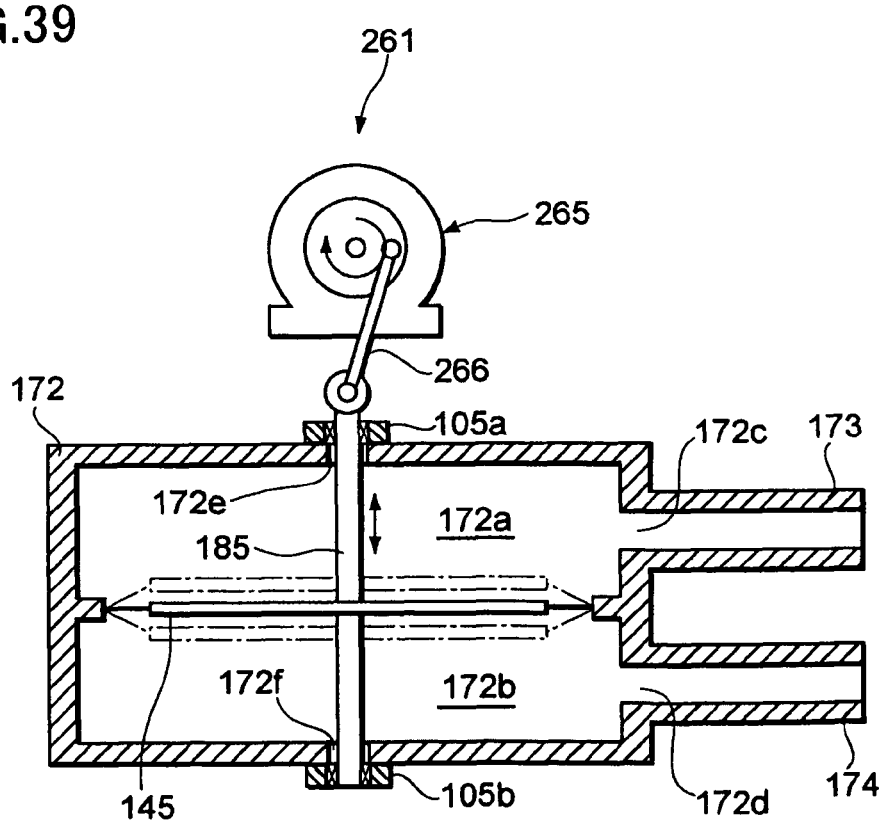
FIG. 39 is a schematic diagram showing a jet flow generating apparatus according to another modification of the embodiment shown in FIG. 28.

FIG. 39 shows a jet flow generating apparatus according to another modification of the modification (jet flow generating apparatus 121) shown in FIG. 28. The jet flow generating apparatus according to this modification is denoted by reference numeral 261. The jet flow generating apparatus 261 has an actuator 265. The actuator 265 uses a conventional rotational motor. The rotational motion of the motor is converted into a linear motion of a rod 185 by a link mechanism 266. This structure also allows the vibration plate 145 to vibrate.

Figure 40:
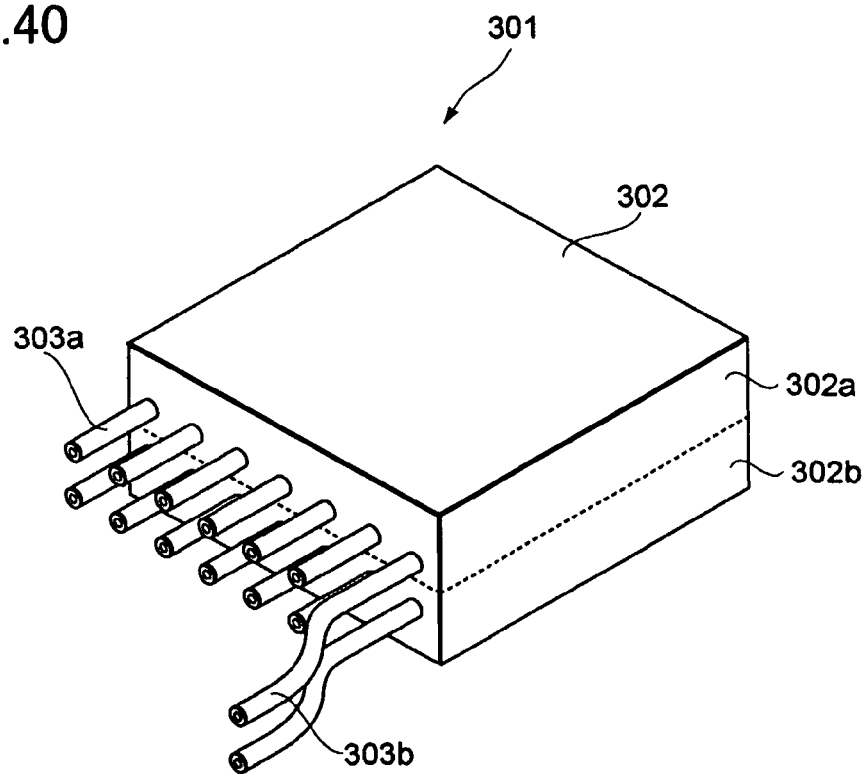
FIG. 40 is a perspective view showing a jet flow generating apparatus according to another embodiment of the present invention.

FIG. 40 is a perspective view showing a jet flow generating apparatus according to another embodiment of the present invention.

The jet flow generating apparatus according to this embodiment is denoted by reference numeral 301. The jet flow generating apparatus 301 has a casing 302. The casing 302 forms the contours of chambers 302*a* and 302*b*. The casing 302 has one of the foregoing vibration plates. The vibration plate partitions the casing 302 and forms the chambers 302*a* and 302*b*. The casing 302 has short nozzles 303*a* and long nozzles 303*b*. The long nozzles 303*b* are made of, for example, metal, resin, or the like. The long nozzles 303*b* are bent. For example, six short nozzles 303*a* and one long nozzle 303*b* are disposed on each of the chambers 302*a* and 302*b*.

The short nozzles 303*a* disposed on the upper and lower chambers 302*a* and 302*b* have the same length. Likewise, the long nozzles 303*b* disposed on the upper and lower chambers 302*a* and 302*b* have the same length. This is because the phases of the sound waves generated by the upper nozzles disposed on the upper chamber 302*a* and the phases of the sound waves generated by the lower nozzles disposed on the lower chamber 302*b* are inversed so that the sound waves weaken each other.

Figure 41:
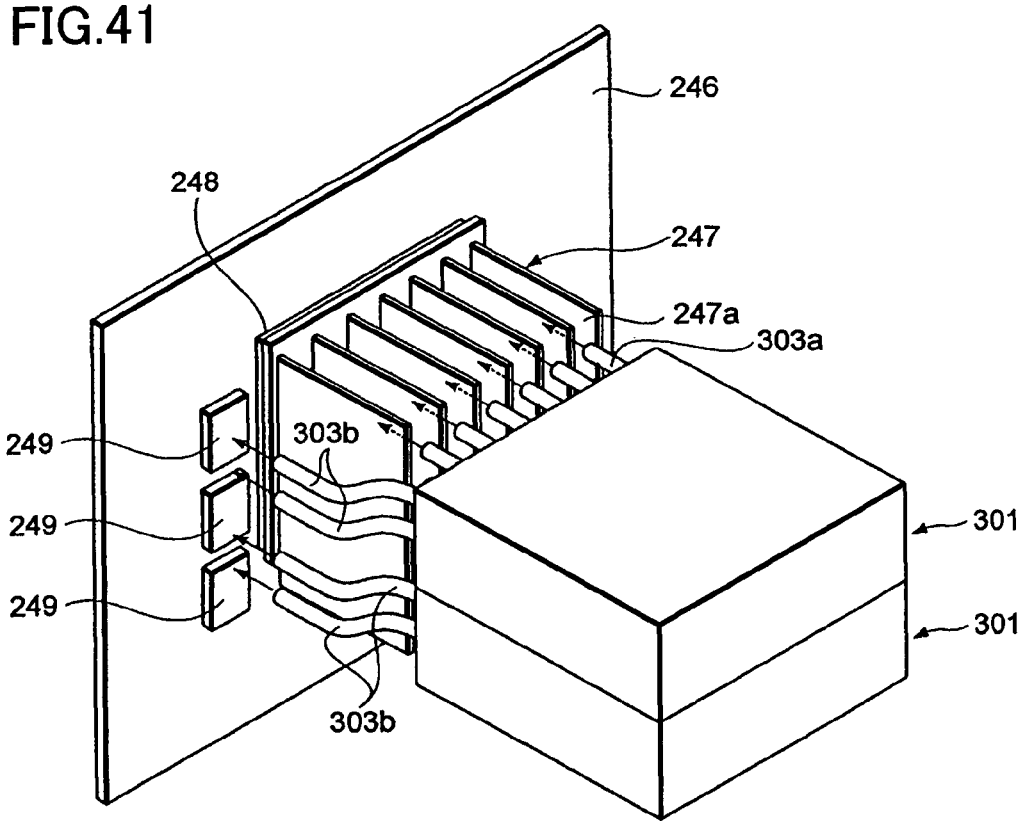
FIG. 41 is a perspective view describing a practical usage of the jet flow generating apparatus shown in FIG. 40.

FIG. 41 is a perspective view describing a practical usage of the jet flow generating apparatus 301 shown in FIG. 40. As shown in the drawing, a circuit board 246 has a CPU 248. A heat sink 247 is contacted to the CPU 248. The heat sink 247 diffuses heat of the CPU 248. In the vicinity of the CPU 248 on the circuit board 246, for example, a plurality of IC chips 249 are mounted. For example, two jet flow generating apparatuses 301 are stacked. The jet flow generating apparatuses 301 are arranged so that coolant discharged from the short nozzles 303*a* are discharged to heat radiation fins 247*a* of the heat sink 247 and that coolant discharged from the long nozzles 303*b* are discharged to the IC chips 249. Since the jet flow generating apparatuses 301 are arranged in the foregoing manner, they can directly cool the IC chips 249.

Thus, according to the embodiment, even if various heat generating member are arranged at any positions, they can be cooled by the long nozzles 303*b* that are bend corresponding to the arrangement of the heat generating members. When a conventional fan that rotates an impeller is used, heat generating members cannot be locally cooled unlike the embodiment.

The jet flow generating apparatus 301 is not limited to the foregoing embodiment. In other words, the number of long nozzles 303*b* and the number of short nozzles 303*a* are not limited to those of the foregoing embodiment. In addition, the long nozzles 303*b* can be made of, for example, a flexible material. In this case, the long nozzles 303*b* can be made of rubber, flexible resin, bellows, or the like. Thus, the directions of the nozzles can be changed in accordance with the arrangement of various heat generating members.

Figure 42:
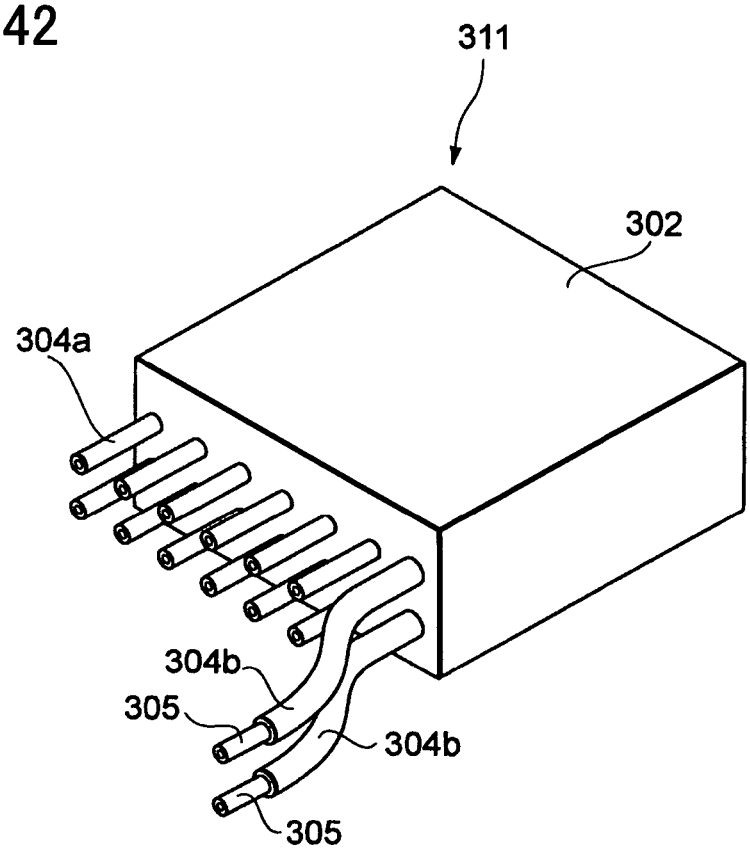
FIG. 42 is a perspective view showing a jet flow generating apparatus according to a modification of the embodiment shown in FIG. 40.

FIG. 42 shows a jet flow generating apparatus according to a modification of the embodiment (jet flow generating apparatus 301) shown in FIG. 40. In FIG. 42 to FIG. 46, members, functions, and so forth similar to those shown in FIG. 40 will be briefly described or their description will be omitted.

The jet flow generating apparatus according to this modification is denoted by reference numeral 311. In the jet flow generating apparatus 311 shown in FIG. 42, long nozzles 304*b* are thicker than the foregoing long nozzles 303*b*. In other words, the cross section of flow path which is perpendicular to the flow direction of coolant is larger than the cross section of each of the longer nozzle 303*b*. A nozzle 305 is disposed on the discharge opening side of each of the long nozzles 304*b*. The nozzles 305 can be omitted.

Since the flow path of each of the long nozzles 304*b* is larger than the flow path of each of the short nozzles 304*a*, the resistance of the former is larger than that of the latter by the difference between the lengths. However, when the cross section of the flow path is increased, the resistance of the flow path of each of the long nozzles 304*b* can be prevented from increasing. Thus, coolant can be discharged from the long nozzles 304*b* with a proper flow amount and a proper flow rate.

Figure 43:
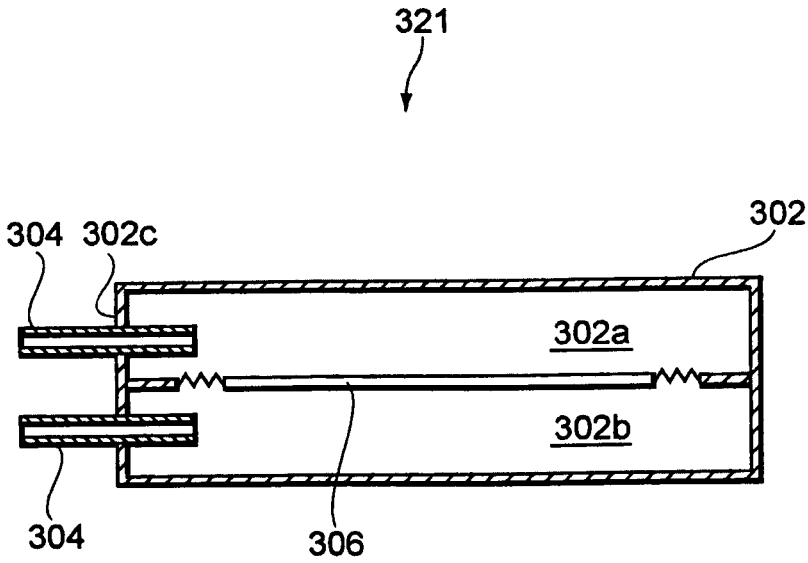
FIG. 43 is a sectional view showing a jet flow generating apparatus according to another embodiment.

FIG. 43 shows a jet flow generating apparatus according to another embodiment. The jet flow generating apparatus according to this embodiment is denoted by reference numeral 321. Nozzles 304 of the jet flow generating apparatus 321 inwardly protrude from a side wall 302*c* of a casing 302. The thickness and length of each of the nozzles 304, the volume of each of chambers such as a chamber 302*a* and so forth, the performance of an actuator (not shown), and the amplitude, frequency, and so forth of a vibration plate 306 are parameters of the flow rate of coolant discharged from each of the nozzle 304. When coolant is discharged at a desired flow rate and at a desired frequency, they are affected by the length of each of the nozzles 304. Thus, each of the nozzles may be adjusted to a predetermined length. However, the length of each of the nozzles may not be freely adjusted due to the restriction of the arrangement of the jet flow generating apparatus 321 and the restriction of the position of a heat sink (not shown). In this case, when the nozzles 304 are partly protruded in the chambers 302*a* and 302*b*, the lengths of the nozzles 304 can be adjusted for the desired values.

In addition, according to the embodiment, the lengths of the nozzles 304 can be increased as much as possible. As a result, the frequency of the generated sound can be lowered. According to the hearing sense of human, as the frequency becomes lower, the sound is more weakly heard. Thus, according to the embodiment, the generated sound can be weakened as much as possible.

Figure 44:
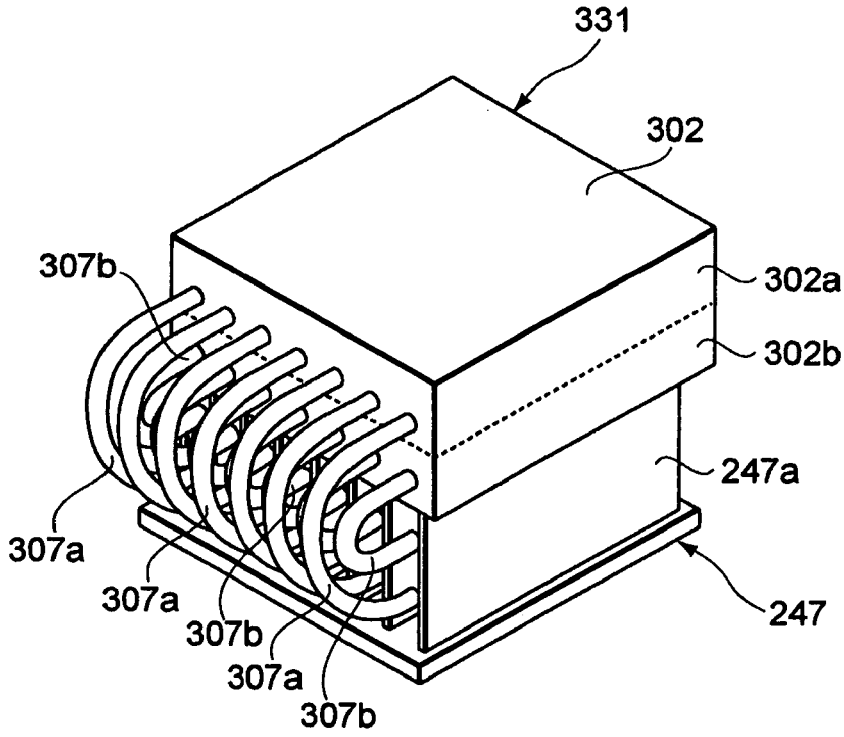
FIG. 44 is a perspective view showing a jet flow generating apparatus according to another modification of the embodiment shown in FIG. 40.
Figure 45:
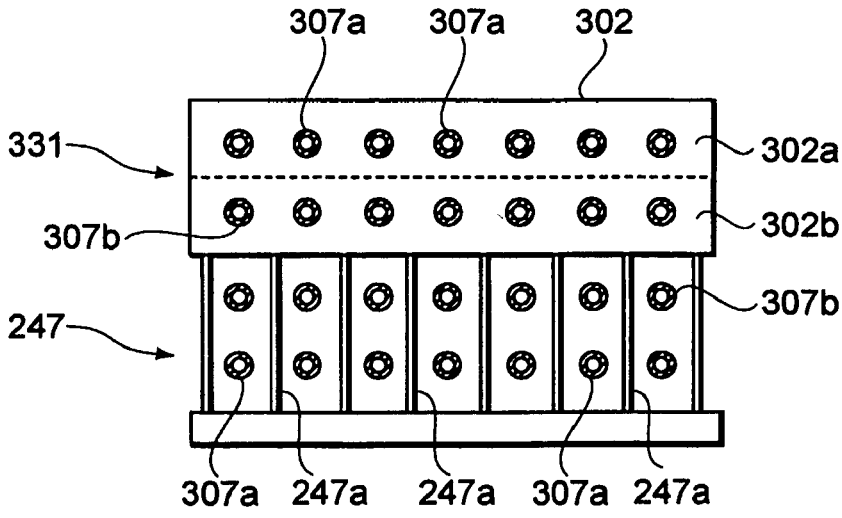
FIG. 45 is a sectional view showing nozzles shown in FIG. 44.

FIG. 44 shows a jet flow generating apparatus according to another modification of the embodiment (jet flow generating apparatus 301) shown in FIG. 40. The jet flow generating apparatus according to this modification is denoted by reference numeral 331. All nozzles 307*a* and 307*b* of the jet flow generating apparatus 331 are bent so that coolant is discharged to heat radiation fins 247*a* of a heat sink 247 disposed at a lower portion of the jet flow generating apparatus 331. FIG. 45 is a sectional view taken from the direction in which the heat radiation fins 247*a* are disposed, namely, the nozzles 307*a* and 307*b* are cut in the vertical direction of the drawing. Tips of the nozzles 307*a* protruding from the upper chamber 302*a* are arranged at positions lower than tips of the nozzles 307*b* against the position of the heat radiation fins 247*a*.

Although the jet flow generating apparatus and the heat sink are simply arranged as shown in FIG. 41, their installation area becomes large. In contrast, according to the embodiment, the installation area can be decreased as much as possible. When heat of the heat sink 247 needs to be prevented from being transferred from the heat sink 247 to the jet flow generating apparatus 331, a heat insulator or the like can be interposed between the heat sink 247 and the jet flow generating apparatus 331.

Figure 46:
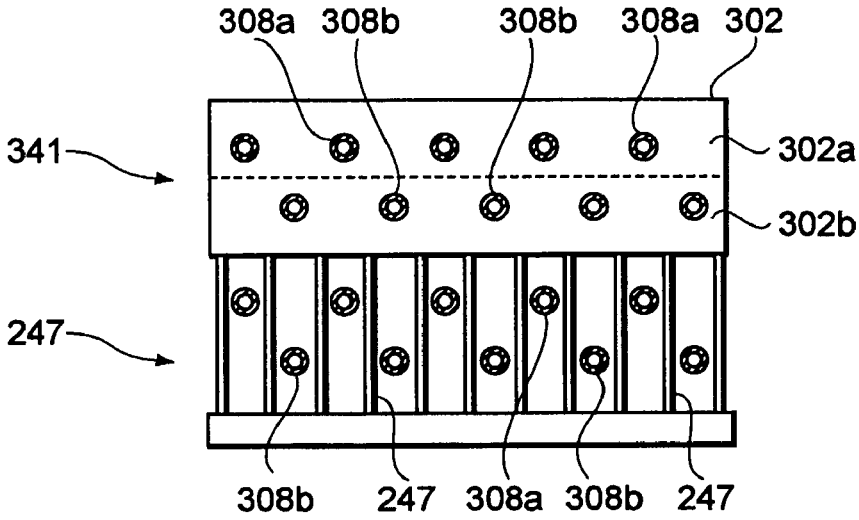
FIG. 46 is a sectional view showing nozzles of a jet flow generating apparatus according to a modification of the embodiment shown in FIGS. 44 and 45.

FIG. 46 shows a jet flow generating apparatus according to another modification of the modification (jet flow generating apparatus 331) shown in FIG. 44 and FIG. 45. The jet flow generating apparatus according to this modification is denoted by reference numeral 341. In the jet flow generating apparatus 341, nozzles 308*a* and nozzles 308*b* are arranged in a zigzag pattern. In other words, the nozzles 308*a* and 308*b* are alternately arranged on the chambers 302*a* and 302*b* (in the vertical direction in the drawing). Thus, since the length of each of the nozzles 308*a* can be the same as that of each of the nozzles 308*b*, the arrangement can contribute to the improvement of the muting effect.

Figure 47:
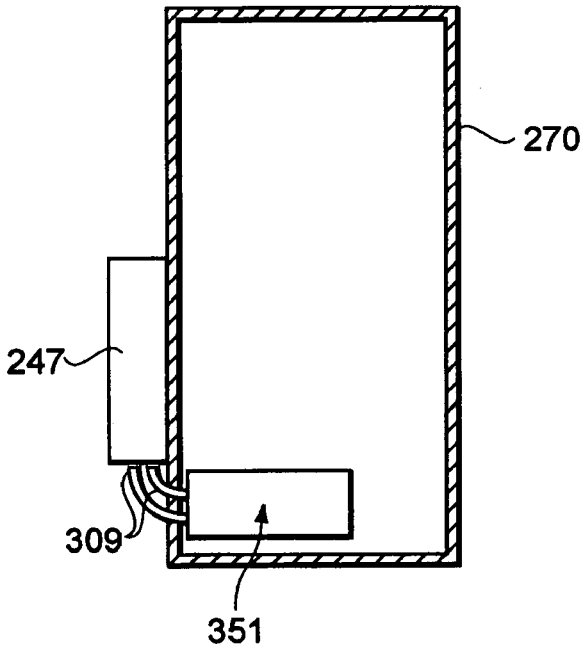
FIG. 47 is a schematic diagram showing an example of the usage of the jet flow generating apparatus having nozzles that are bent (No. 1).
Figure 48:
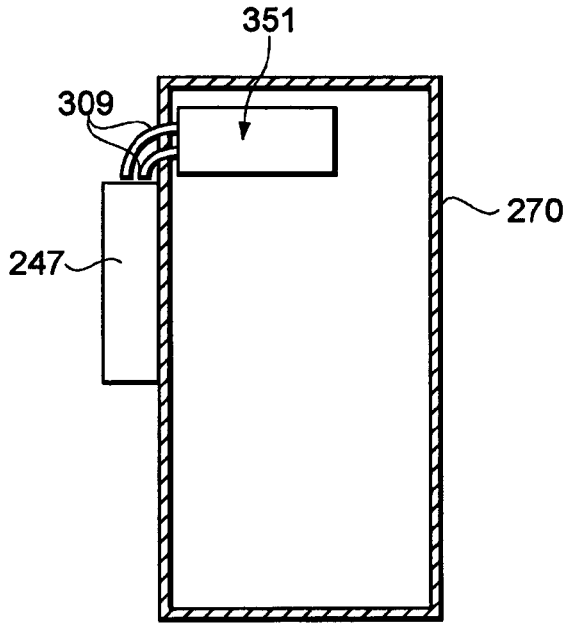
FIG. 48 is a schematic diagram showing an example of the usage of the jet flow generating apparatus having nozzles that are bent (No. 2).

FIG. 47 and FIG. 48 show an example of the usage of the jet flow generating apparatus having the foregoing bent nozzles. As shown in FIG. 47 and FIG. 48, for example, the heat sink 247 is disposed outside a case 270 of a computer. The jet flow generating apparatus 351 is disposed in the case 270 so that nozzles 309 protrude toward the heat sink 247.

Generally, coolant discharged to a heat sink should be at a low temperature. Generally, the outer temperature of the case 270 is the lowest. The inner temperature of the case 270 is higher than the outside of the case 270 because of heat generated by inner parts of the case 270. Thus, it is unfavorable to dispose both the heat sink and the jet flow generating apparatus in the case 270. In reality, to cool a CPU disposed in a desktop PC or the like, air in the case is discharged to the CPU. Thus, a heat radiation device that has high efficiency is desired. Although it is preferred to dispose the heat sink and the jet flow generating apparatus outside the case, if there is a need to neatly package them because of limited space or desired design, structures shown in FIG. 47 and FIG. 48 can be considered.

In the structure shown in FIG. 48, since coolant is discharged downward from the nozzles 309, foreign matters such as dust can be preventing from enter the nozzles 309. From this point of view, the discharge direction of coolant of the nozzles 309 may be sideways.

Figure 49:
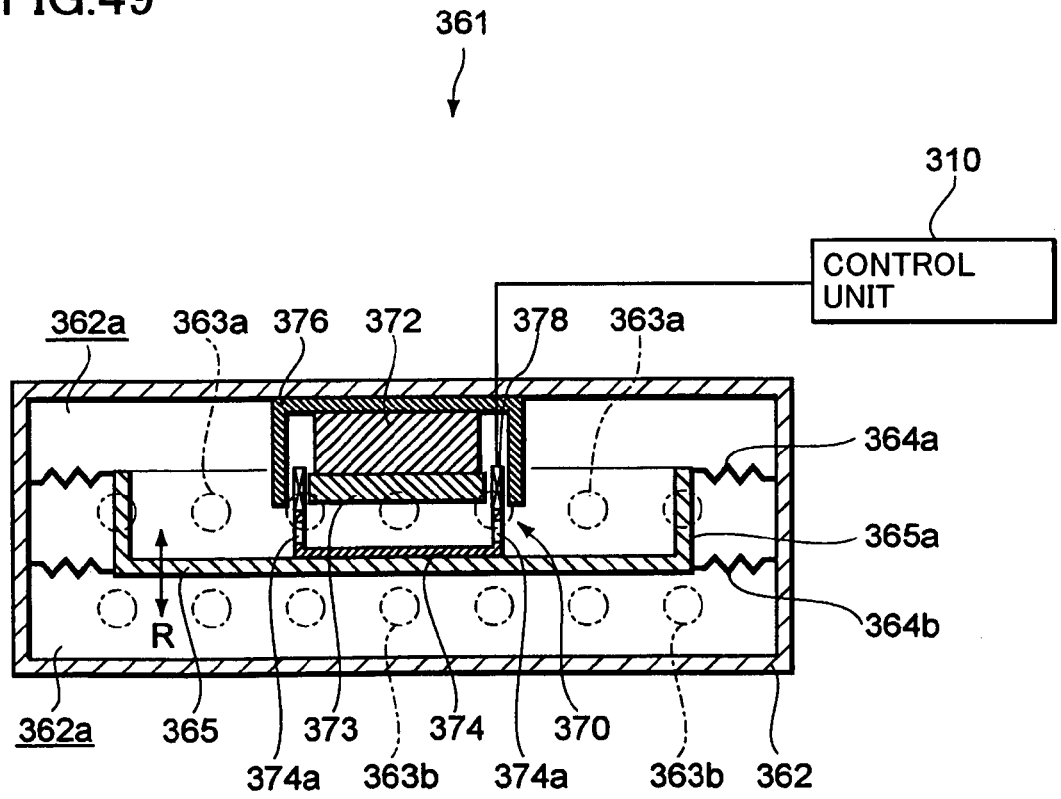
FIG. 49 is a sectional view showing a jet flow generating apparatus according to another embodiment.

FIG. 49 is a sectional view showing a jet flow generating apparatus according to another embodiment. The jet flow generating apparatus according to this embodiment is denoted by reference numeral 361. The jet flow generating apparatus 361 has a casing 362. A vibration plate 365 is disposed in the casing 362. The vibration plate 365 has a cylindrical side wall 365*a*. The side wall 365*a* of the vibration plate 365 is formed in the vibration direction R of the vibration plate 365. An upper edge portion and a lower edge portion formed on the side wall 365*a* are supported by edge members 364*a* and 364*b*, respectively. The edge members 364*a* and 364*b* are mounted on the casing 362. The edge members such as the edge member 364*a* and so forth as supporting members have bendability or elasticity. The edge members are made of, for example, bellows shape resin or rubber. The side wall 365*a* may be formed successively or intermittently in the peripheral direction. The casing 362, the vibration plate 365, and the edge member 364*a* compose a chamber 362*a*. The casing 362, the vibration plate 365, and the edge member 364*b* compose a chamber 362*b*. The chambers 362*a* and 362*b* are structured so that the volume of the chamber 362*a* is almost the same as the volume of the chamber 362*b*. The chamber 362*a* has a plurality of openings 363*a* denoted by dotted circles. Likewise, the chamber 362*b* has a plurality of openings 363*b*. The openings 363*a* and 363*b* may be formed in a nozzle shape as described in each of the foregoing embodiments.

An actuator 370 is disposed in the chamber 362*a*. The actuator 370 vibrates the vibration plate 365. The actuator 370 is composed of a yoke 376, a magnet 372, a plate 373, a coil 378, a movable member 374, and so forth. The plate 373 has a function of a yoke. The coil 378 is wound on the movable member 374. The vibration plate 373 is secured to the movable member 374. A control unit 310 is electrically connected to the coil 378. The control unit 310 generates a drive signal for the actuator 370. Air holes 374*a* are formed on the side surfaces of the movable member 374.

In the jet flow generating apparatus 361, since the side wall 365*a* is supported by the edge members 364*a* and 364*b* disposed along the vibration direction R, the vibration plate 365 can stably vibrate, but not laterally vibrate. Since the vibration plate 365 suppresses lateral vibration, the magnet 372, the plate 373, and so forth are prevented from colliding with the movable member 374. Thus, the space between the plate 373 and so forth and the movable member 374 can be narrowed. As a result, the magnetic field applied to the coil 378 can be strengthen. Consequently, the driving mechanism can effectively obtain drive force. In addition, since the members of the actuator 370 are prevented from colliding with each other, higher mode vibrations can be suppressed. As a result, the noise of the apparatus can be decreased.

As the length of the side wall 365*a* in the vibration direction R becomes larger, the distance between the edge member 364*a* and the edge member 364*b* becomes larger and the vibration plate 365 more stably vibrates. However, when the size of the casing 362 is not changed, if the distance between the edge member 364*a* and the edge member 364*b* is largely increased, the volumes of the chambers 362*a* and 362*b* are decreased. Thus, the distance between the edge member 364*a* and the edge member 364*b* needs to be properly adjusted.

Figure 50:
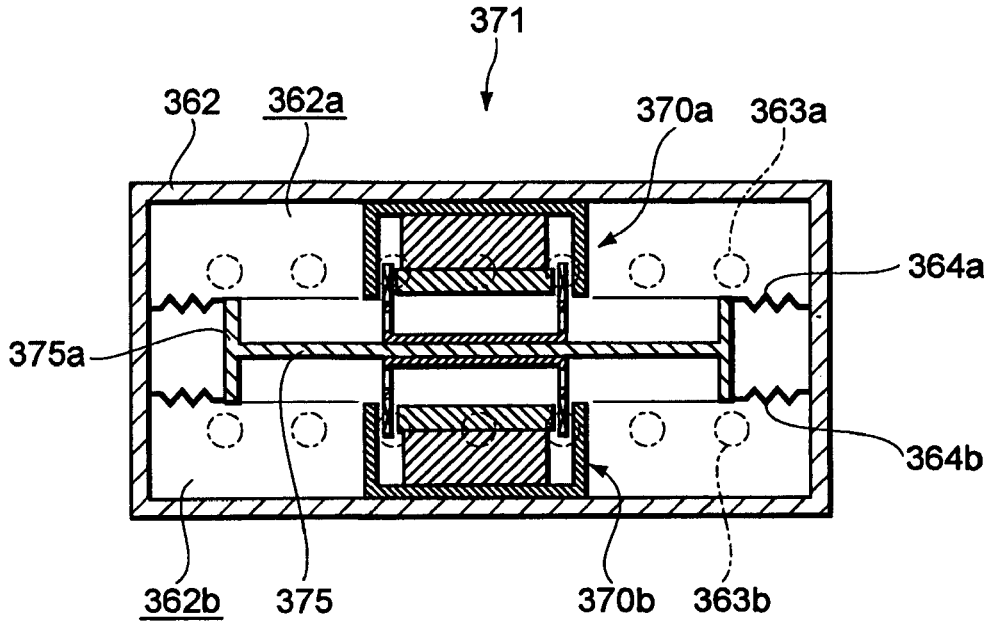
FIG. 50 is a sectional view showing a jet flow generating apparatus according to a modification of the embodiment shown in FIG. 49.
Figure 51:
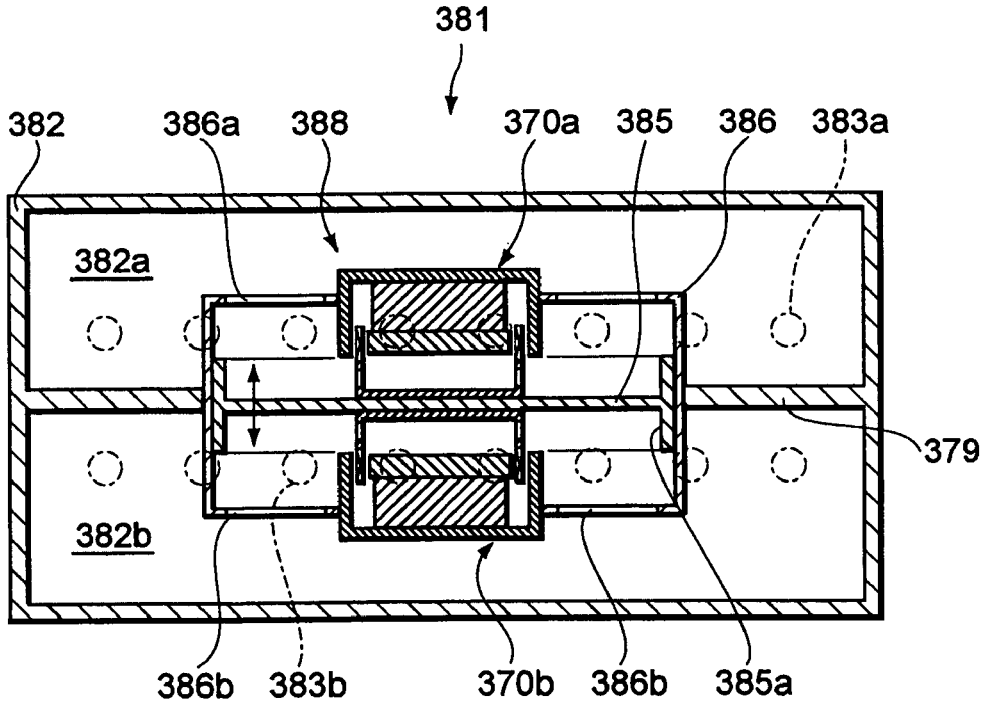
FIG. 51 is a sectional view showing a jet flow generating apparatus according to another modification of the embodiment shown in FIG. 49.
Figure 52:
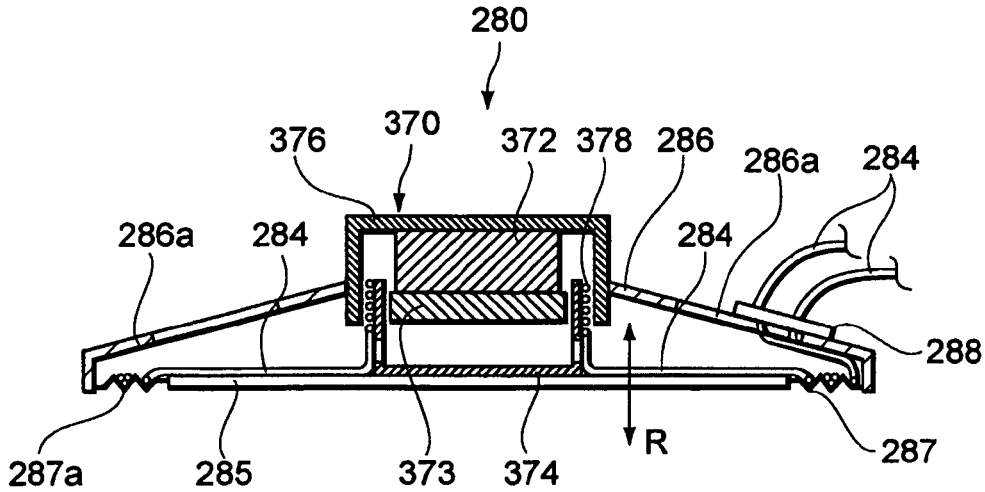
FIG. 52 is a sectional view showing a speaker type vibrating mechanism used in a jet flow generating apparatus according to another embodiment.

FIG. 50 is a sectional view showing a jet flow generating apparatus according to a modification of the embodiment (jet flow generating apparatus 361) shown in FIG. 49. In FIG. 50 to FIG. 52, members, functions, and so forth similar to those shown in FIG. 49 will be briefly described or their description will be omitted.

The jet flow generating apparatus according to this modification is denoted by reference numeral 371. The jet flow generating apparatus 371 shown in FIG. 50 has a vibration plate 375 whose cross section has an almost a shape of a character H. The jet flow generating apparatus 371 also has chambers 362*a* and 362*b*. In the chambers 362*a* and 362*b*, actuators 370*a* and 370*b* are disposed. The actuators 370*a* and 370*b* are similar to the actuator shown in FIG. 49. The shape and volume of the chamber 362*a* are the same as those of the chamber 362*b*. Thus, this structure contributes to the reduction of the noise.

FIG. 51 is a sectional view showing a jet flow generating apparatus according to another modification of the embodiment (jet flow generating apparatus 361) shown in FIG. 49. The jet flow generating apparatus according to this modification is denoted by reference numeral 381. The jet flow generating apparatus 381 has a casing 382. A vibrating mechanism 388 is disposed in the casing 382. The vibrating mechanism 388 has a frame 386, actuators 370*a* and 370*b*, and a vibration plate 385. The actuators 370*a* and 370*b* are supported by the frame 386. A side wall 385*a* of the vibration plate 385 is slidably supported by the frame 386. The vibration plate 385 is vibrated by the actuators 370*a* and 370*b*. The side wall 385*a* of the vibration plate 385 is slidable to the frame 386 in the vibration direction of the vibration plate 385. In other words, the vibrating mechanism 388 according to the embodiment has the vibration plate 385 formed in a piston shape and the frame 386 as a cylinder. The periphery of the frame 386 of the vibrating mechanism 388 is mounted on a partition member 379. As a result, chambers 382*a* and 382*b* are formed. Air holes 386*a* and 386*b* are formed in the frame 386.

In the jet flow generating apparatus 381 according to this embodiment, since the support area (contact area) of the side wall 385*a* of the vibration plate 385 can be increased, the vibration plate 385 can stably vibrate, not laterally vibrate.

According to the embodiment, a bearing (not shown) may be interposed between the frame 386 and the side wall 385*a*. Alternatively, lubricant may be interposed between them. Lubricant of mineral oil type, synthetic type, or the like can be used. Alternatively, solid type lubricant of molybdenous type may be used. When liquid type lubricant is used, the airtightness between the front portion and rear portion of the vibration plate 385 can be effectively improved. When magnetic type fluid lubricant or the like is used, the fluid can be easily retained.

FIG. 52 is a sectional view showing a speaker type vibrating mechanism used in the foregoing jet flow generating apparatuses according to another embodiment of the present invention. The vibrating mechanism according to this embodiment is denoted by reference numeral 280. The vibrating mechanism has an actuator 370. The actuator 370 is composed of a yoke 376, a magnet 372, a plate 373, a coil 378, a movable member 347, and so forth. The plate 373 has a function of a yoke. The coil 378 is wound around the movable member 374. A vibration plate 285 is secured to the movable member 374. The structure of the actuator 370 is the same as that of the actuator 370 shown in FIG. 49 and so forth. The yoke 370 of the actuator 370 is mounted on a frame 286 having air holes 286*a*. The vibration plate 285 is also mounted on an opening edge portion of the frame 286 through an edge member 287.

Figure 53:
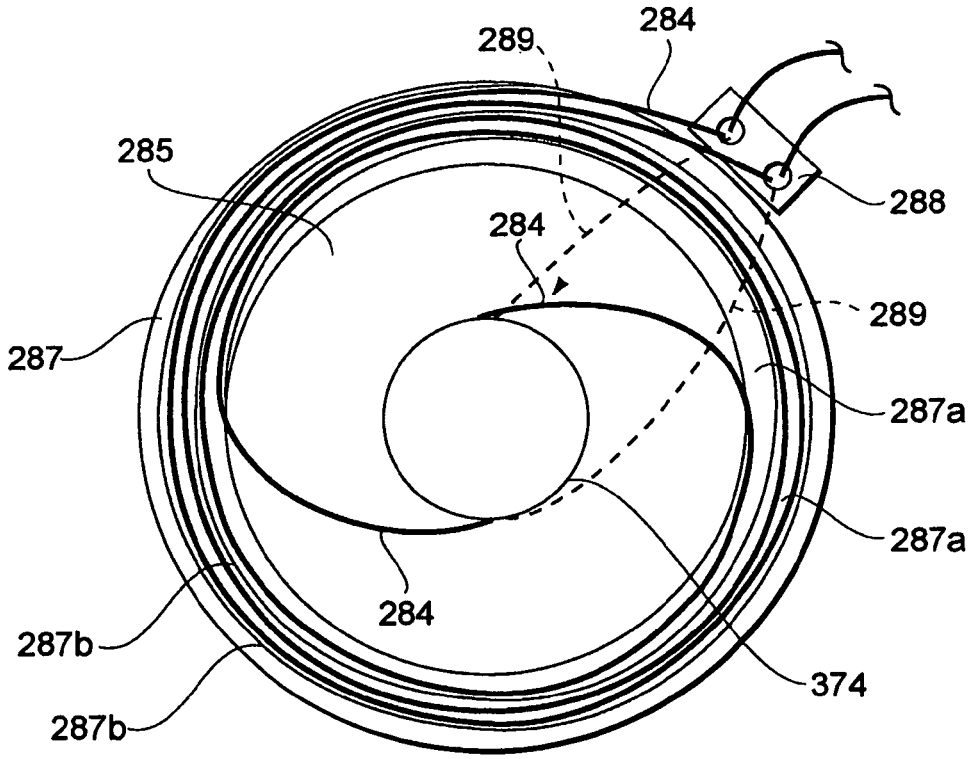
FIG. 53 is a plan view showing a vibration plate, an edge member, and so forth shown in FIG. 52.

FIG. 53 is a plan view showing the vibration plate 285, the edge portion 287, and so forth shown in FIG. 52. As shown in the drawing, a lead wire 284 through which a control signal is supplied from a control unit (not shown) to the coil 378 is wired along thread-shaped grooves 287*a* formed on the edge member 287. The lead wire 284 is connected to a terminal board 288 secured to the frame 286. A portion denoted by reference numeral 287*b* is a ridge line of the edge member 287. Since the lead wire 284 is wired along the thread-shaped grooves 287*a*, the stress applied to the lead wire can be decreased. As a result, the lead wire can be prevented from breaking.

In a conventional speaker, such a lead wire (referred to as tinsel wire) is suspended and connected directly to a terminal board from a solenoid coil. In other words, since the vibration plate is movable and the terminal board is secured, one side of the tinsel wire is movable, whereas the other side is secured. Since the tinsel wire is repeatedly stressed by the vibrations at frequencies of several 10 (Hz) to several 100 (Hz) of the vibration plate, the durability of the speaker depends on the service life of the tinsel wire.

In particular, when the jet flow generating apparatus according to each of the foregoing embodiments is miniaturized, since the area of the vibration plate is proportionally decreased, the amplitude of the vibration plate should be increased so as to increase the discharge amount of coolant. In this case, since the tinsel wire becomes short and the amplitude of the vibration plate becomes large, the stress applied to the tinsel wire tends to become large. In other words, the durability of the apparatus tends to deteriorate. In reality, when a lead wire 289 is wired as denoted by a dashed line shown in FIG. 53 (when the lead wire 289 is wired from the center of the vibration plate 285 along the outer periphery), the stress applied to the lead wire 284 is large. Thus, as shown in FIG. 53, when the tinsel wire 284 is spirally wired to the edge member 287, the tinsel wire 284 can be effectively prevented from breaking.

Figure 54:
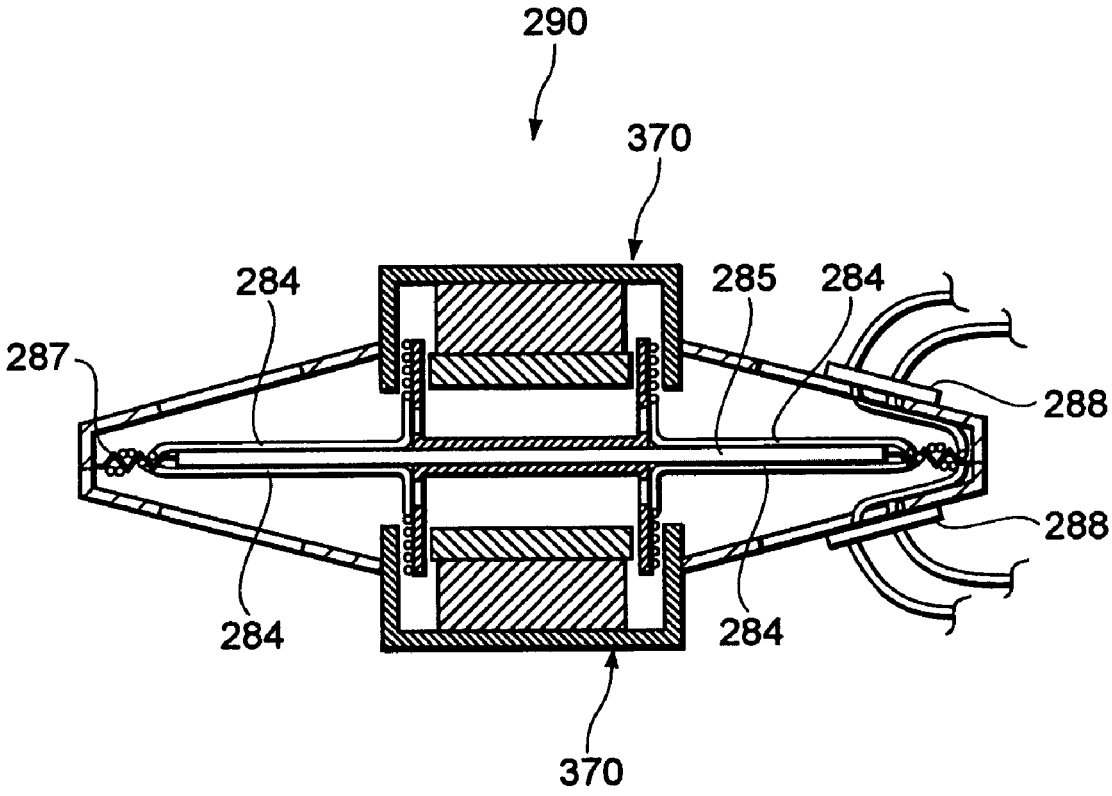
FIG. 54 is a sectional view showing a vibrating mechanism in which two vibrating mechanisms shown in FIG. 53 are symmetrically arranged.

FIG. 54 is a sectional view showing a vibrating mechanism in which two vibrating mechanisms 280 shown in FIG. 53 are symmetrically disposed. The vibrating mechanism shown in FIG. 54 is denoted by reference numeral 290. In the vibrating mechanism 290, lead wires 284 are wired in spiral grooves formed on the front and rear surfaces of an edge member 287. Using the bellows shape of the edge member 287, the lead wires 284 can be spirally wired on the frond and rear surfaces of the edge member 287.

The vibrating mechanism 290 having the foregoing structure is disposed in a casing 382 shown in FIG. 51 instead of the vibrating mechanism 388. As a result, a jet flow generating apparatus is structured.

The foregoing tinsel wire may be buried in the edge member 287. Alternatively, as long as the shape of the tinsel wire can be kept for a long time, it can be suspended in a spiral coil shape, not secured to the edge member 287 and so forth. In this case, the spiral grooves of the edge member are not required. As a result, the stress applied to the lead wire can be decreased.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A jet flow generating apparatus comprising:

a plurality of jet flow generating devices, each jet flow generating device comprising:

a plurality of chambers each having a single opening and each containing a coolant, a shape of each chamber being at least substantially the same as a shape of each opening;

a vibrating mechanism positioned entirely within the chambers and for vibrating the coolant contained in each of the plurality of chambers and for alternately discharging the coolant through the single opening of one of the plurality of chambers and drawing the coolant in through the single opening of said chamber; and a control unit for controlling a sinusoidal vibration of the vibrating mechanism so that the sound waves having frequencies in an audible range of a human that are generated by the coolant discharged from the plurality of chambers weaken each other, wherein the vibrating mechanism in adjacent jet flow generating devices vibrate with inverted phases.

2. The jet flow generating apparatus as claimed in claim 1, wherein, for at least one jet flow generating device, when a distance of adjacent openings of at least one set of chambers is denoted by d (m) and a wave length of a sound wave generated in the chamber is denoted by $\lambda$(m), a condition of $d<\lambda/2$ is satisfied.

3. The jet flow generating apparatus as claimed in claim 1, wherein, for at least one jet flow generating device, when a distance of adjacent openings of at least one set of chambers is denoted by d (m) and a wave length of a sound wave generated in the chamber is denoted by $\lambda$(m), a condition of $d<\lambda/6$ is satisfied.

4. The jet flow generating apparatus as claimed in claim 1, wherein, for at least one jet flow generating device, said control unit is configured to control vibrations of the vibrating mechanism that range from about 80 Hz to about 150 Hz.

5. The jet flow generating apparatus as claimed in claim 1, wherein, for at least one jet flow generating device, said vibrating mechanism has a vibration plate that partitions the first one of the plurality of chambers from the second one of the plurality of chambers.

6. The jet flow generating apparatus as claimed in claim 1, wherein, for at least one jet flow generating device, said control unit is configured to control a phase difference of respective sound waves generated in the plurality of chambers to be 360°/n, where n represents a number of chambers.

7. The jet flow generating apparatus as claimed in claim 6, wherein, for at least one jet flow generating device, said control unit is configured to control amplitudes of the sound waves generated in the plurality of chambers so that the amplitudes are almost equal.

8. The jet flow generating apparatus as claimed in claim 1, wherein, for at least one jet flow generating device, said control unit is configured to vibrate the vibrating mechanism with a lower input than a rated input of the vibrating mechanism.

9. An electronic device comprising:

a heat generating member;

a plurality of jet flow generating devices, each jet flow generating device comprising:

a plurality of chambers containing a coolant, each chamber having a single opening, and a shape of each chamber being at least substantially the same as a shape of each opening;

a vibrating mechanism positioned entirely within the chambers and for vibrating the coolant contained in the plurality of chambers and for alternately discharging the coolant through the single opening of one of said plurality of chambers toward the heat generating member and drawing the coolant in through the single opening of said chamber; and a control unit for controlling a sinusoidal vibration of the vibrating mechanism so that the sound waves having frequencies in an audible range of a human generated by the coolant discharged from the plurality of chambers weaken each other, wherein the vibrating mechanism in adjacent jet flow generating devices vibrate with inverted phases.

10. A jet flow generating method comprising the steps of:

vibrating a coolant contained in a plurality of jet flow generating devices each having a plurality of chambers, each chamber having a single opening so as to alternately discharge the coolant through the single opening of one of said plurality of chambers and draw the coolant in through the single opening of said chamber, a shape of each chamber being at least substantially the same as a shape of each opening; and controlling sinusoidal vibrations of the coolant in each of the plurality of chambers so that sound waves having frequencies in an audible range of a human generated by the coolant discharged from the plurality of chambers weaken each other, and so that the sinusoidal vibrations of the coolant in adjacent jet flow generating devices have inverted phases.

11. The jet flow generating apparatus as claimed in claim 1, wherein, for at least one jet flow generating device, the control unit electrically controls the vibration of the vibrating mechanism.

12. The electronic device as claimed in claim 9, wherein, for at least one jet flow generating device, the control unit electrically controls the vibration of the vibrating mechanism.

13. The jet flow generating apparatus as claimed in claim 1, wherein, for at least one jet flow generating device, said vibrating mechanism is configured to discharge the coolant through the single opening of a first one of the plurality of chambers while simultaneously drawing the coolant in through the single opening of a second one of the plurality of chambers.

14. The electronic device as claimed in claim 9, wherein, for at least one jet flow generating device, said vibrating mechanism is configured to discharge the coolant through the single opening of a first one of the plurality of chambers while simultaneously drawing the coolant in through the single opening of a second one of the plurality of chambers.

15. The jet flow generating method as claimed in claim 10, wherein vibrating the coolant contained in the plurality of chambers includes discharging the coolant through the single opening of a first one of the plurality of chambers while simultaneously drawing the coolant in through the single opening of a second one of the plurality of chambers.

16. The jet flow generating apparatus as claimed in claim 1, wherein, for at least one jet flow generating device, the vibrating mechanism includes a coil and a magnet.

17. The electronic device as claimed in claim 9, wherein, for at least one jet flow generating device, the vibrating mechanism includes a coil and a magnet.

18. The jet flow generating method as claimed in claim 10, wherein the coolant contained in at least one of the plurality of jet flow generating devices having the plurality of chambers is vibrated by a vibrating mechanism that includes a coil and a magnet.

* * * * *